US007356924B2

(12) United States Patent
Johnson et al.

(10) Patent No.: US 7,356,924 B2
(45) Date of Patent: Apr. 15, 2008

(54) MANUFACTURING PROCESS FOR A POWER DISTRIBUTION ASSEMBLY OF AN ELECTRICAL SYSTEM

(75) Inventors: Ross S. Johnson, Jenison, MI (US); Harold R. Wilson, Hudsonville, MI (US); Randy Borgman, Holland, MI (US); Dave Emery, North Muskegon, MI (US); Ronald H. Brown, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 11/176,955

(22) Filed: Jul. 7, 2005

(65) Prior Publication Data

US 2006/0052009 A1 Mar. 9, 2006

Related U.S. Application Data

(63) Continuation-in-part of application No. 11/173,935, filed on Jul. 1, 2005, which is a continuation-in-part of application No. 11/036,756, filed on Jan. 14, 2005, now abandoned, which is a continuation of application No. PCT/US03/22278, filed on Jul. 15, 2003.

(60) Provisional application No. 60/396,863, filed on Jul. 15, 2002.

(51) Int. Cl.
*H01R 43/00* (2006.01)

(52) U.S. Cl. ..... 29/858; 29/830; 29/840; 29/842; 29/846; 29/860; 174/255; 439/215

(58) Field of Classification Search ..... 29/825, 29/857, 858, 866, 868, 745, 748, 830–832, 29/840, 842, 846, 860; 174/88 R, 95–98, 174/481–484, 504, 505, 255; 439/112, 120, 439/209, 211, 216, 221, 590, 660
See application file for complete search history.

(56) References Cited

U.S. PATENT DOCUMENTS

| | | | | | |
|---|---|---|---|---|---|
| 2,175,144 | A | * | 10/1939 | Davison | 439/216 |
| 2,666,907 | A | * | 1/1954 | Hensley, Jr. | 439/111 |
| 2,720,635 | A | * | 10/1955 | Odegaard | 439/418 |
| 4,313,646 | A | | 2/1982 | Millhimes et al. | |
| 4,825,540 | A | | 5/1989 | Kelly | |
| 5,096,433 | A | | 3/1992 | Boundy | |
| 5,582,522 | A | * | 12/1996 | Johnson | 439/214 |
| 5,938,462 | A | | 8/1999 | Wilson et al. | |
| 6,123,562 | A | | 9/2000 | King et al. | |

(Continued)

FOREIGN PATENT DOCUMENTS

WO WO 2004/057716 A1 7/2004

*Primary Examiner*—Minh Trinh
*Assistant Examiner*—Donghai D. Nguyen
(74) *Attorney, Agent, or Firm*—Flynn, Thiel, Boutell & Tanis, P.C.

(57) ABSTRACT

A modular multi-component power distribution system is provided having a plurality of modular components which includes a bus-bar-like power distribution assembly (PDA), branching connectors, flex connectors, and receptacles. A manufacturing process relates to the manufacture of extruded power distribution assemblies and the insertion of multiple, lengths of conductor wire along the longitudinal length thereof. In such PDA's, multiple parallel bores are formed interiorly of the PDA casing or housing wherein such conductors are not inserted into the bores until after the PDA extrusions are cut to length and plug ports are formed therein.

19 Claims, 45 Drawing Sheets

U.S. PATENT DOCUMENTS 6,163,958 A 12/2000 Suzuki
6,539,617 B2 4/2003 Abe
6,640,425 B1 11/2003 Suzuki

* cited by examiner

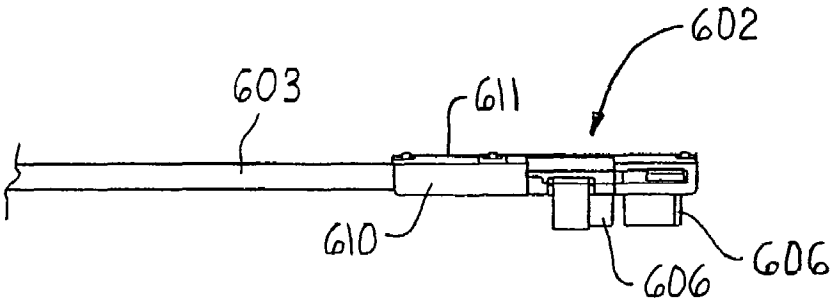
FIG. 38
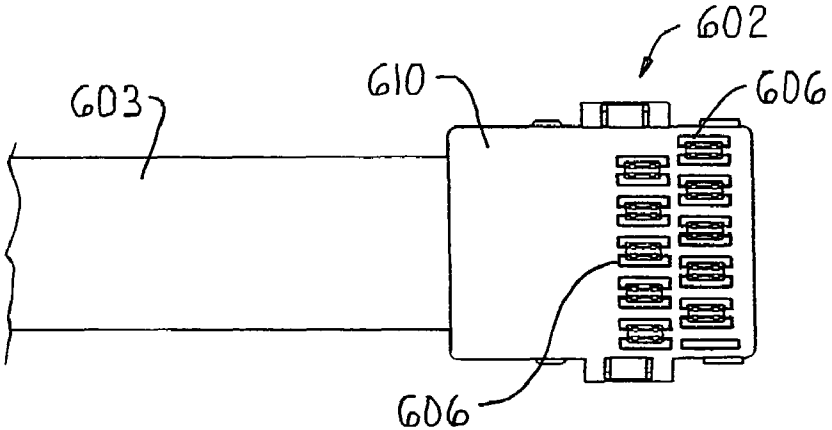
FIG. 37
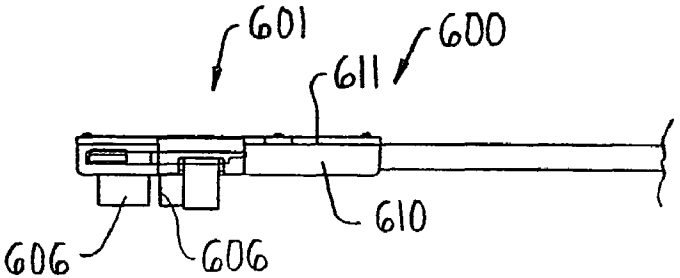
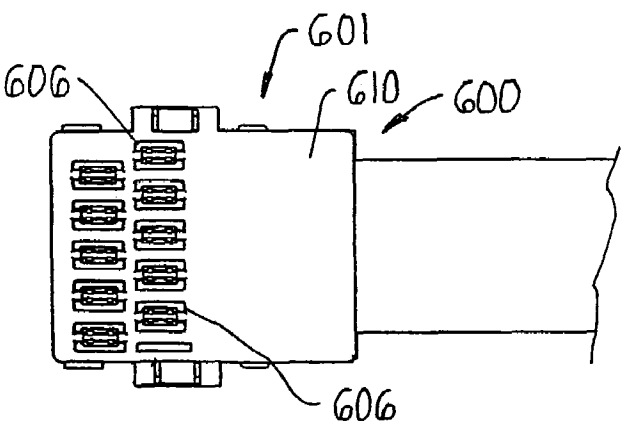

FIG. 48
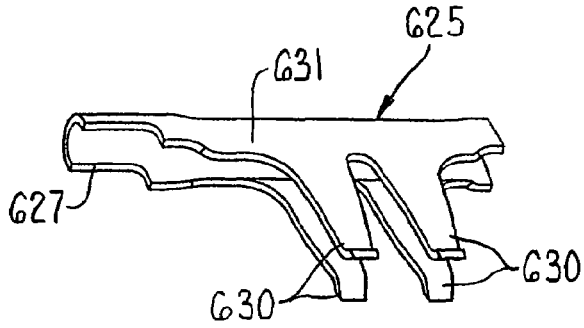
FIG. 49
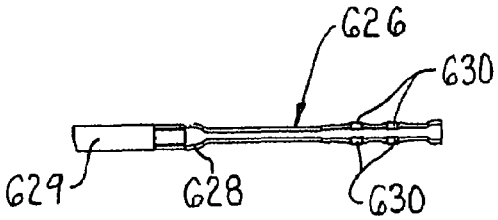
FIG. 51
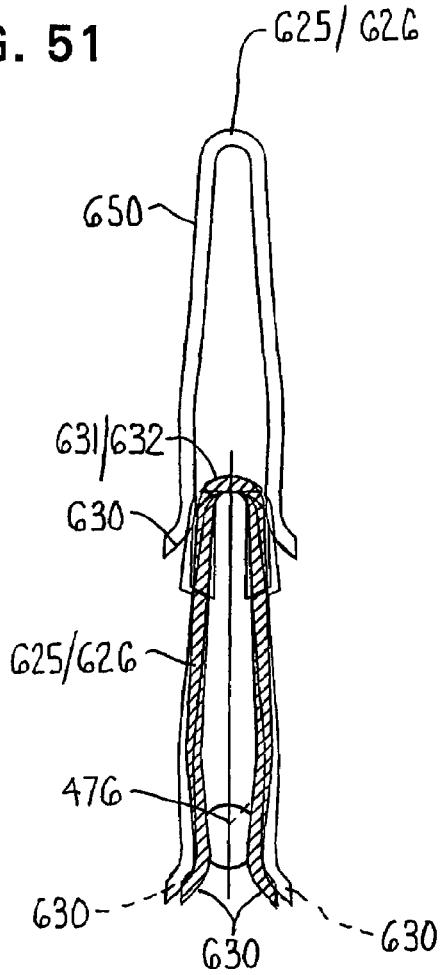
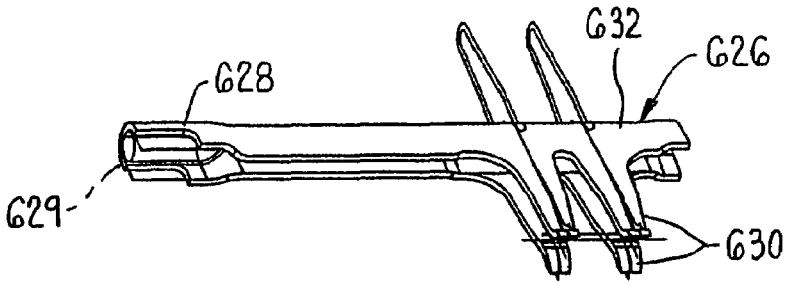
FIG. 50

MANUFACTURING PROCESS FOR A POWER DISTRIBUTION ASSEMBLY OF AN ELECTRICAL SYSTEM

CROSS-REFERENCE TO RELATED APPLICATIONS

This application is a continuation-in-part of U.S. patent application Ser. No. 11/173 935, filed Jul. 1, 2005, which is a continuation-in-part of U.S. patent application Ser. No. 11/036 756, filed Jan. 14, 2005, now abandoned, which is a continuation of PCT/US03/22278, filed Jul. 15, 2003, which claims priority of U.S. Provisional Patent Application No. 60/396 863, filed Jul. 15, 2002.

FIELD OF THE INVENTION

The invention relates to a modular electrical system for supplying power through an office area and more particularly, to a manufacturing process for manufacturing components of the electrical system.

BACKGROUND OF THE INVENTION

In office buildings, large open areas are often finished off to define an office environment configured for the specific needs of a business. This may be accomplished through combinations of different building systems such as raised floor systems, ceiling systems, wall panel systems, and desking or other furniture systems.

In typical offices, it is necessary to provide data communication systems and power distribution systems to route power and communications circuits throughout multiple workstation areas. One inventive power distribution system comprises modular electrical components which are readily connectable together in multiple configurations depending upon the specific environment in which the power system will be used. The modular components include a solid wire power distribution assembly which forms a solid wire bus, a receptacle and flexible connector cables wherein the system is generally disclosed in Published PCT Application Publication No. WO/2004/057716 A1, which is owned by the assignee hereof, namely, Haworth, Inc. The disclosure of this published PCT application is incorporated herein by reference.

The present invention relates to a manufacturing process for manufacturing components of the afore-mentioned power distribution system, and is specifically directed to the manufacture of extruded power distribution assemblies (herein PDA's) and the insertion of multiple, lengths of conductor wire along the longitudinal length thereof. In such PDA's, multiple parallel bores are formed interiorly of the PDA casing or housing wherein such conductors are preferably inserted into the bores after the PDA extrusions are cut to length and plug ports are formed therein. These ports permit receptacles, connector cables and the like to be plugged into the extruded PDA's for engagement with the interior PDA conductors and the electrical circuits carried thereby.

Other objects and purposes of the invention, and variations thereof, will be apparent upon reading the following specification and inspecting the accompanying drawings.

BRIEF DESCRIPTION OF DRAWINGS

FIG. 37 is front view of a further flex connector.

FIG. 38 is a bottom view of the flex connector.

FIG. 48 is an isometric view of a short quad-point terminal or contact.

FIG. 49 is a bottom view of a long terminal.

FIG. 50 is an isometric view of the long terminal.

FIG. 51 is an end cross sectional view of the terminals diagrammatically illustrating a PDA conductor inserted therein as well as a further terminal engaged therewith.

Figure 1:
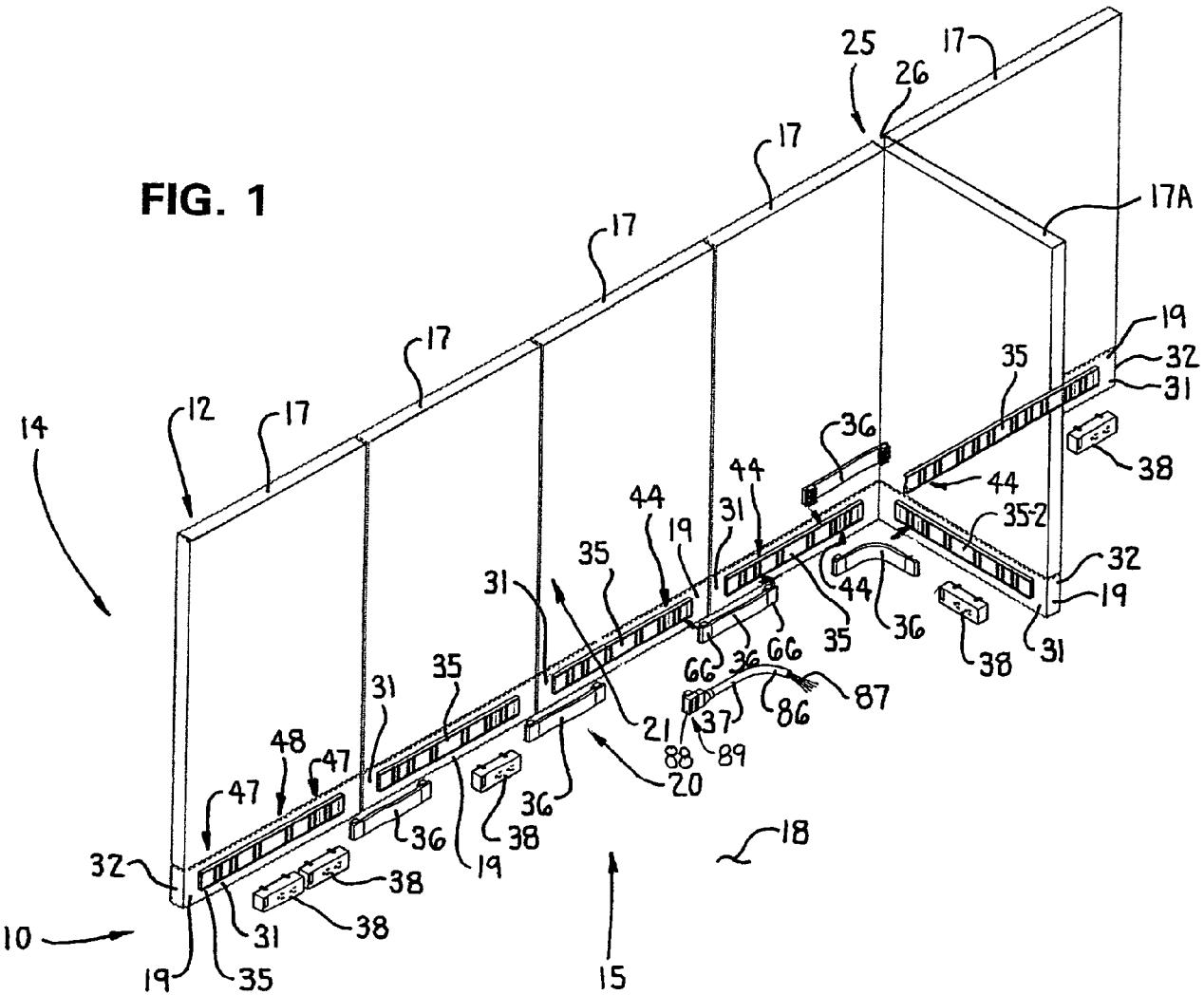
FIG. 1 is a perspective view of a space-dividing wall panel system having modular components of the inventive power distribution system arranged in a bus-bar based configuration.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, components of a modular multi-component power distribution system 10 are illustrated in use within a wall panel system 12. The wall panel system 12 is used to subdivide an open office area 14 into individual subdivided areas 15 such as for walkways, individual work stations and the like.

Generally, the wall panel system 12 includes a plurality of individual space-dividing wall panels 17 that are disposed in load bearing relation on a floor surface 18. Each wall panel 17 includes a horizontally elongate raceway 19 which in the illustrated arrangement is located at the base of the wall panel 17 as indicated by reference arrow 20 but which also may be located at other heights such as beltline height as indicated by reference arrow 21.

One of the wall panels 17A is interconnected with a pair of additional wall panels 17 through a three-way connection 25 with a gap defined therebetween. Each wall panel 17 also includes a raceway cover 31 which encloses the opposite side faces of the raceway 19 while still defining an opening 32 at each opposite end of the panel 17 or 17A. As seen in FIG. 1, a number of the components of the power distribution system 10 are illustrated including a distribution assembly 35 (herein "PDA") which is formed as a sold wire bus-bar, a flex-type connector 36, a flexible in-feed cable 37 and a plurality of receptacles 38.

Figure 2:
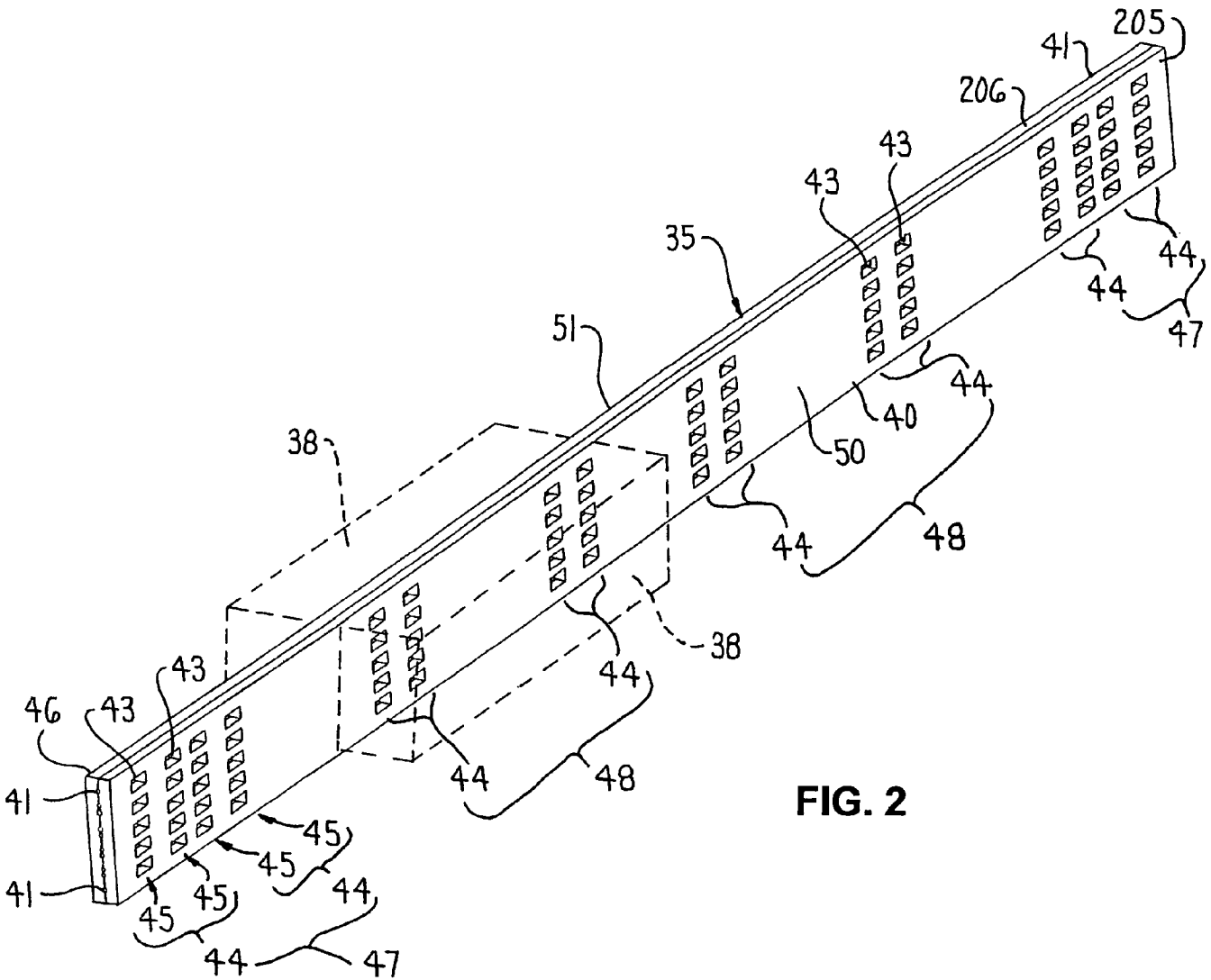
FIG. 2 is a perspective view of a power distribution assembly having receptacles illustrated in phantom outline.

Referring to FIG. 2, one construction of PDA 35 has an extruded construction formed by an insulative casing 40 which has a plurality of parallel, vertically spaced apart electrical conductors 41 which are embedded within the casing 40 and extend longitudinally along the entire length thereof. The conductors 41 define multiple electrical circuits for distribution throughout the office area 14 wherein the conductors 41 define multiple circuits of line, neutral and ground wires.

To provide access to the conductors 41 and permit the connection of system components thereto, the casing 40 is formed with a pre-defined pattern of plug openings 43 wherein the plug openings 43 have portions of the conductors 41 exposed therein. The plug openings 43 are grouped into multiple groups of openings 43 wherein each group 44 is defined by a pair of vertical rows 45 of vertically spaced apart openings 43. Each opening group 44 is adapted to be connected to one of the aforementioned system components, namely a flex connector 36, an in-feed cable 37 or a receptacle 38.

More specifically, two opening groups 44 are provided at each of the opposite ends 46 of the casing 40. Each end pair 47 of groupings 44 is intended to be connected to one of the flex connectors 36, the in-feed cable 37 or the branching connector 39. Each PDA 35 further includes at least one interior pair 48 of groupings 44 to which receptacles 38 may be connected.

In addition to the above components, the power distribution system 10 further includes components for interconnecting each PDA 35 with an adjacent one of the PDAs 35 so as to define continuous electrical circuits extending throughout the office area 14. In a wall panel based arrangement, the primary component is the flex connector 36 which connects serially between a pair of PDAs 35.

Figure 3:
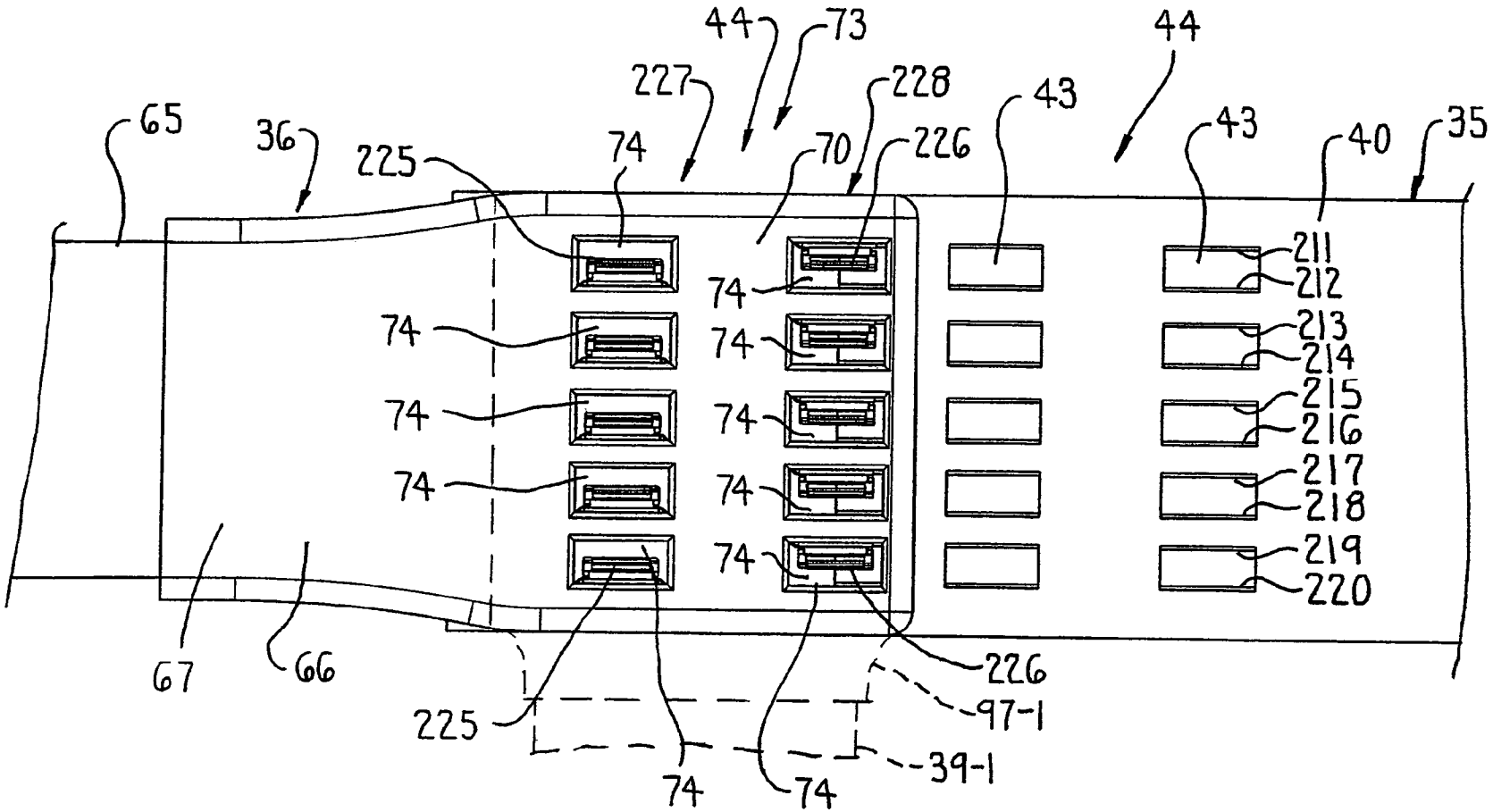
FIG. 3 is a front view illustrating the power distribution assembly interconnected with a connector plug of a flex connector.

Referring to FIG. 3, the flex connector 36 includes a bendable conductor body 65 which terminates at its opposite ends in connector plugs or terminal units 66. The conductor body 65 is relatively rigid in the vertical direction but is bendable in the horizontal direction. The conductor body 65 is formed of an extruded insulative cover in which a plurality of flexible electrical conductor wires extend.

Each connector plug 66 includes an outer terminal or plug housing 67 having an interior face 69 and an exterior face 70. The interior face 69 includes a plurality of plug posts 71 which are arranged in two vertical rows of posts 71. The posts 71 are adapted to be inserted into the openings of a corresponding one of the opening groups 44 in the PDA 35. The posts 71 when engaged with a grouping 44 of plug openings 43 electrically connects the flex connector 36 to the PDA 35 and when the opposite ends of the flex connector 36 are joined to a pair of PDAs 35, the electrical circuits extend continuously from one PDA 35 to a serially adjacent PDA. An alternative cable 39-1 is also illustrated with its plug 97-1 connected thereto.

In addition to the posts 71 on the interior face 69, the exterior face 70 of each connector plug 66 includes a further grouping 73 of plug openings 74. Each contact post 71 includes an exposed contact adapted to be engaged with a conductor of another component of the power distribution system 10 such as the PDA 35. The plug opening 74 also provides access to the same contact of the post 71. Thus, the electrical circuit completed between the connector plug 66 and a system component such as the PDA 35 may be further branched off or extended by plugging an additional system component into the grouping 73 of openings 74.

As to the in-feed cable 37 illustrated in FIG. 1, a length of flexible multi-conductor cabling 86 is provided which has a first end 87 which connects to a power supply. The cabling 86 defines a plurality of electrical circuits and has a cable plug 88 at the free end 89 thereof. For the in-feed cable 37, however, the electrical circuits are supplied to the flex connector 36 as generally illustrated in FIG. 1 and they supply electrical power to the PDA 35 when connected thereto.

Generally with the above-described components, a wide variety of cabling configurations may be constructed in order to accommodate the specific structural limitations of different building systems such as furniture, wall and floor systems.

More particularly, as to the PDA 35 (FIG. 2), the plug openings 43 of each group 44 are arranged in two vertical rows 45. The plug openings 43 have a rectangular shape and project through the entire thickness of the PDA casing 40 so as to open from the opposite casing faces 50 and 51. Each opening 43 is defined vertically by an upper edge 203 and a lower edge 204 (FIG. 4).

The casing 40 is defined by casing halves 205 and 206, which are interconnected together in facing relation to define an interface 207 therebetween. The conductors 41 are sandwiched between the casinq halves 205 and 206, as illustrated in FIG. 4 and furthermore, extend longitudinally along the entire length of the PDA 35.

More specifically, as to the conductors 41, the construction of the PDA 35 illustrated in FIG. 2 has ten conductors or wires 41 and is thereby referenced as a ten-wire configuration. The conductors 41 are arranged in vertically spaced relation wherein each pair of conductors 41 has a vertical spacing which corresponds to the vertical size of the opening 43 as defined between the upper and lower edges 203 and 204.

Figure 4:
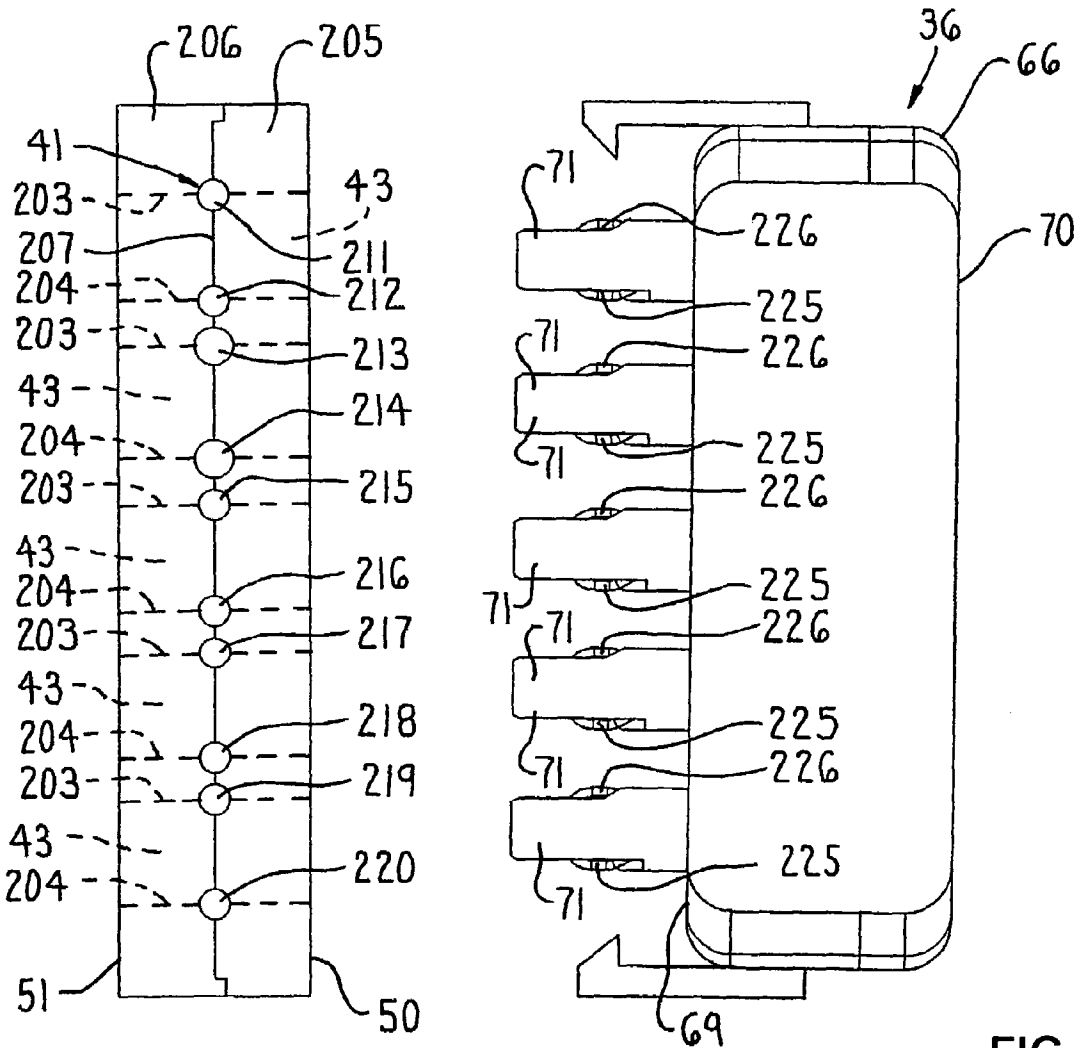
FIG. 4 is an end elevational view of the power distribution assembly and connector plug.

As illustrated in FIG. 4, each opening 43 provides access to an exposed portion of a pair of conductors 41. Specifically, each of the upper and lower edges 203 and 204 has one of the conductors 41 projecting vertically into the open area of the opening 43. The conductors 41 are specifically identified by reference numerals 211-220, with conductors 211, 212 and 215-220 being 12-gauge conventional conductor wire. The conductors 213 and 214 in this illustrated construction are formed of 10-gauge wire to provide a higher capacity, particularly where the conductors 213 and 214 are configured for use as a neutral wire which serves multiple circuits. A more detailed discussion of the assignment of ground, neutral and line wires is discussed in further detail hereinafter. It will be understood that all of the wires may be formed of the same wire gauge, or that different gauges and compositions of wires could be used.

Each of the conductors such as conductors 219 and 220, which are illustrated in phantom outline, extend along the casing 40 with horizontally spaced apart portions of each conductor being exposed along multiple openings 43. In view of the foregoing, each vertical row 45 of openings 43 provides access to all of the conductors 211 to 220.

Figure 5:
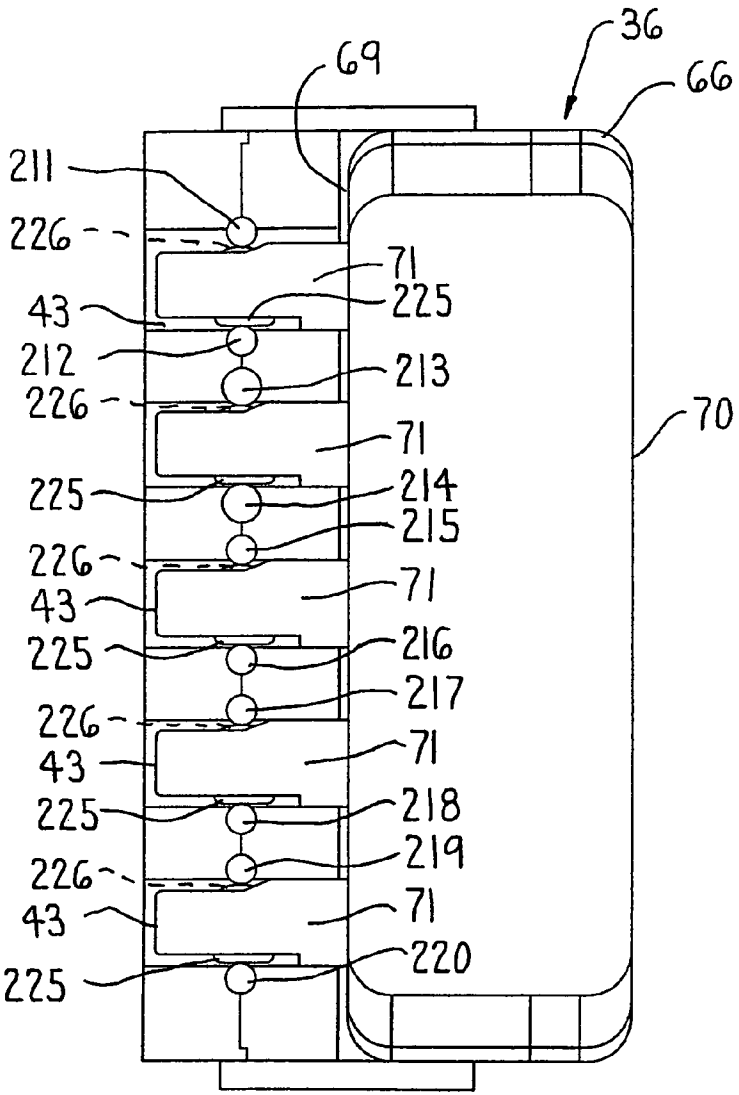
FIG. 5 is an end view of the power distribution assembly and connector plug of FIG. 4 plugged together.

More particularly as to FIGS. 3-5, the connector plug 66 of a flex connector 36 is illustrated therein. The plug 66 includes the grouping 73 of openings 74 in the exterior face 70. Each opening 74 has an electrical contact 225 or 226 accessible therethrough to permit connection of another system component to the flex connector 36 if desired.

As such, when the posts 71 are plugged into the PDA openings 43 as illustrated in FIG. 5, the contact 225 in the uppermost left opening 43 mechanically contacts the conductor 212 to complete an electrical circuit therebetween. Further, the sidewardly adjacent contact 226 contacts the conductor 211 in the uppermost right opening 43. In this manner, all of the contacts 225 and 226 contact all of the conductors 211 to 220.

With this arrangement, the flex connector 36 and the in-feed cable 37 in the identical manner plug into and thereby electrically connect to all of the conductors 211 to 212. The receptacles 38 connect through a similar connection but connect to less than all of the conductors 211 to 220 as will be described herein.

The circuit configuration of FIG. 4 has the ten solid-wire conductors 211-220 configured into four dedicated circuits of one line and one neutral, plus a ground and an isolated ground. Specifically, conductor 211 defines a ground, while conductor 212 serves as an isolated ground. Conductors 213, 215, 217 and 219 serve as line 1, line 2, line 3 and line 4 of the four dedicated circuits, while conductors 214, 216, 218 and 220 serve as neutral 1, neutral 2, neutral 3 and neutral 4. Notably, circuit 1 which comprises line 1 (213) and neutral 1 (214) is a higher capacity circuit since conductors 213 and 214 are 10 gauge wire rather than 12 gauge wire.

Referring to FIGS. 6-10, one manufacturing process for forming the PDAs is readily adaptable to forming the PDAs with different numbers of conductors, such as ten-wire and six-wire systems. Further, the different patterns of openings in these two systems can be readily modified through the manufacturing process to form different numbers of openings and different layouts thereof.

Generally in this process, the PDAs 35 are formed in a continuous length with the pattern of openings 43 being punched depending upon the specific type of PDA being formed, i.e. depending upon the number of opening groups 44 being provided. Thereafter, the length of PDA material is cut to the specific length required. This provides an improved manufacturing process with increased efficiency which thereby reduces the costs associated with the power distribution system 10.

Figure 6:
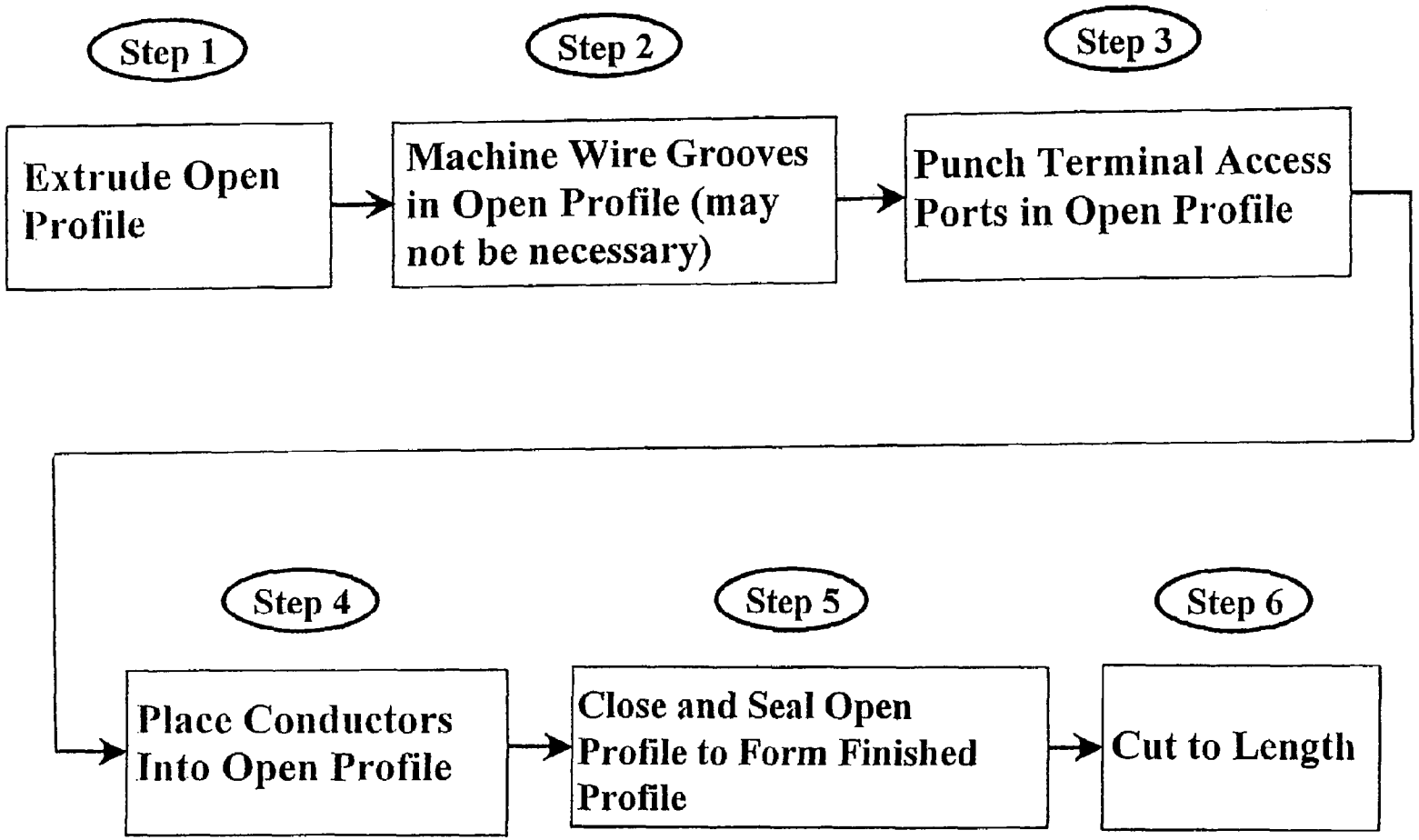
FIG. 6 is a block diagram of a manufacturing process for forming a power distribution assembly.

More specifically, FIG. 6 illustrates the multiple steps involved in the process with FIGS. 7-10 structurally illustrating process steps 1, 2, 4 and 5 respectively.

Figure 7:
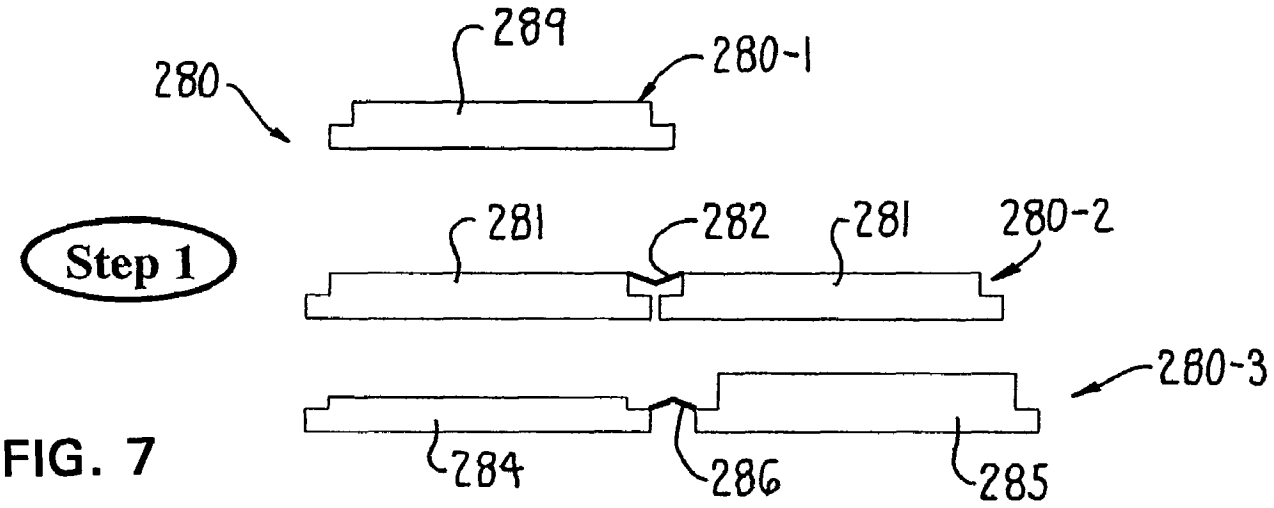
FIG. 7 is a diagrammatic end view of extrusion profiles for step 1 of the manufacturing process.

Referring to FIGS. 6 and 7 which relate to process step 1, this first step involves extruding a profile 280 for the PDA 35 in a continuous extrusion process. The PDA profile 280 is formed of an insulative, relatively rigid material such as plastic. This initial profile 280 may have different configurations including a single common profile 280-1 which is used in pairs to define both halves of the casing 40. This would require two extrusion processes or a single process from which two halves would be formed.

The profile 280-2 could also be formed having two mirror image profile halves 281 which are joined together by a flexible web 282 that defines a hinge about which the profile halves 281 are folded together. The following discussion is directed to profile 280-2 although it is understood that providing two profiles 280-1 is substantially the same as profile 280-2 except that web 282 is not present. Thus, the following discussion of profile 280-2 also applies to profile 280-1.

The profile 280-3 could be formed which has two different half profiles 284 and 285 which also are joined by a flexible web 286. One profile half 285 has a greater thickness.

Figure 8:
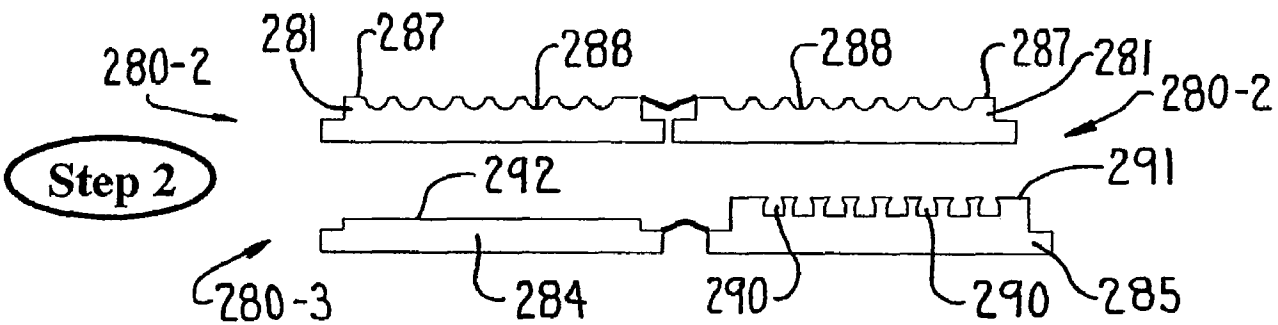
FIG. 8 is a diagrammatic end view of the extrusion profiles during step 2 of the manufacturing process.
Figure 10:
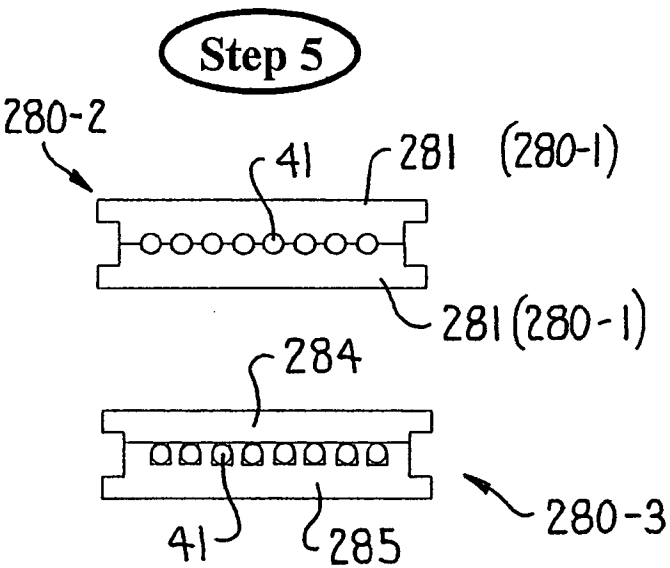
FIG. 10 is a diagrammatic end view of the completed PDA housing during step 5 of the manufacturing process.
Figure 9:
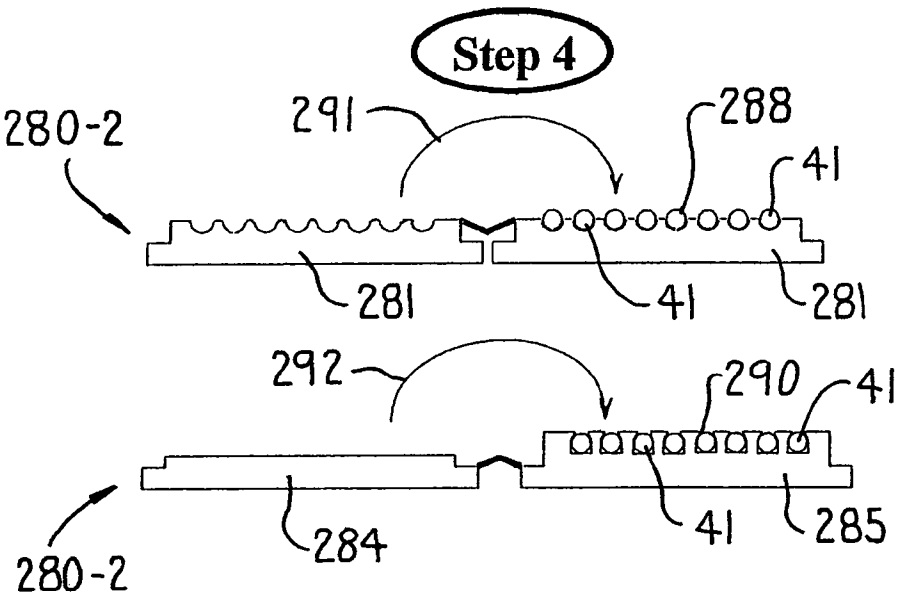
FIG. 9 is a diagrammatic end view of the extrusion profiles during step 4 of the process.

In Step 2, wire or conductor grooves are formed into the profile 280 for accommodating conductors 41. Referring to FIG. 8, the two profile halves 281 have inside faces 287 into which are formed partial-depth grooves 288. The grooves 288 extend longitudinally and are parallel to each other. These same grooves 288 would also be machined into the face 287 of the profile 289.

While the grooves 288 are configured to accommodate half the thickness of a conductor 41, full-depth grooves 290 are provided in parallel relation in the interior face 291 of the profile half 285. The depth of the grooves 290 accommodates the entire thickness of a conductor conductors 41, such that the interior face 292 of the profile half 284 does not require grooves to be machined therein. Further, the grooves 290 have features therein such as a narrow width opening which allows the conductors to be positively secured therein such as by a snap fit.

Step 2 is optional in that the grooves could be and preferably are formed during extrusion, rather than by a separate machining process.

In Step 3, the pattern of openings 43 are punched into the two profiles which make up the PDA. The number of opening groups 44 and the specific arrangement of openings 43 such as in two vertical rows may be varied. For example, groups 44 may be punched to form a PDA 35, which has two interior pairs 48 of groups 44, or another PDA which has more or less interior pairs 48.

In Step 4, the conductors 41 are pre-positioned in the open profile, for example in the grooves 288 of profile 280-2. The empty profile half 281 is hence positioned for folding. For profile 280-3, the conductors 41 are fitted into the grooves 290 with the profile half 284 positioned for folding generally in the direction of arrow 292. In Step 4, the conductors 41 are formed as a continuous length of solid conductor wire which is laid continuously into the groves 288 or 290.

In Step 5, the profile halves are then folded one onto the other at which time the two halves are sealed together to form the finished profile of the PDA. However, the profile still has a continuous length.

In Step 6, the finished profile is cut to length by severing sections from the finished profile to form a finished PDA 35. The finished length of the PDA 35 corresponds to the specific pattern of opening groups 44 punched therein. Thus, the PDAs may be formed from the same process by varying the pattern of groups 44 and severing the finished profile at the length corresponding to the specific pattern applied thereto. Where the conductors are pre-positioned, this severing step cuts through the insulative material as well as the conductors 41. With this manufacturing process, the PDAs 35 may be cost-effectively produced primarily by extruding the components in a continuous operation.

Referring to FIGS. 11-23, a further power distribution system 400 is illustrated therein, which system uses similar components and manufacturing techniques. In particular, the power distribution system 400 includes a power distribution assembly 401, which is formed with the same manufacturing process as that described herein. In particular, the PDA 401 includes an insulated casing 402, which is formed with multiple groups 403 and 404 of openings 405.

Figure 11:
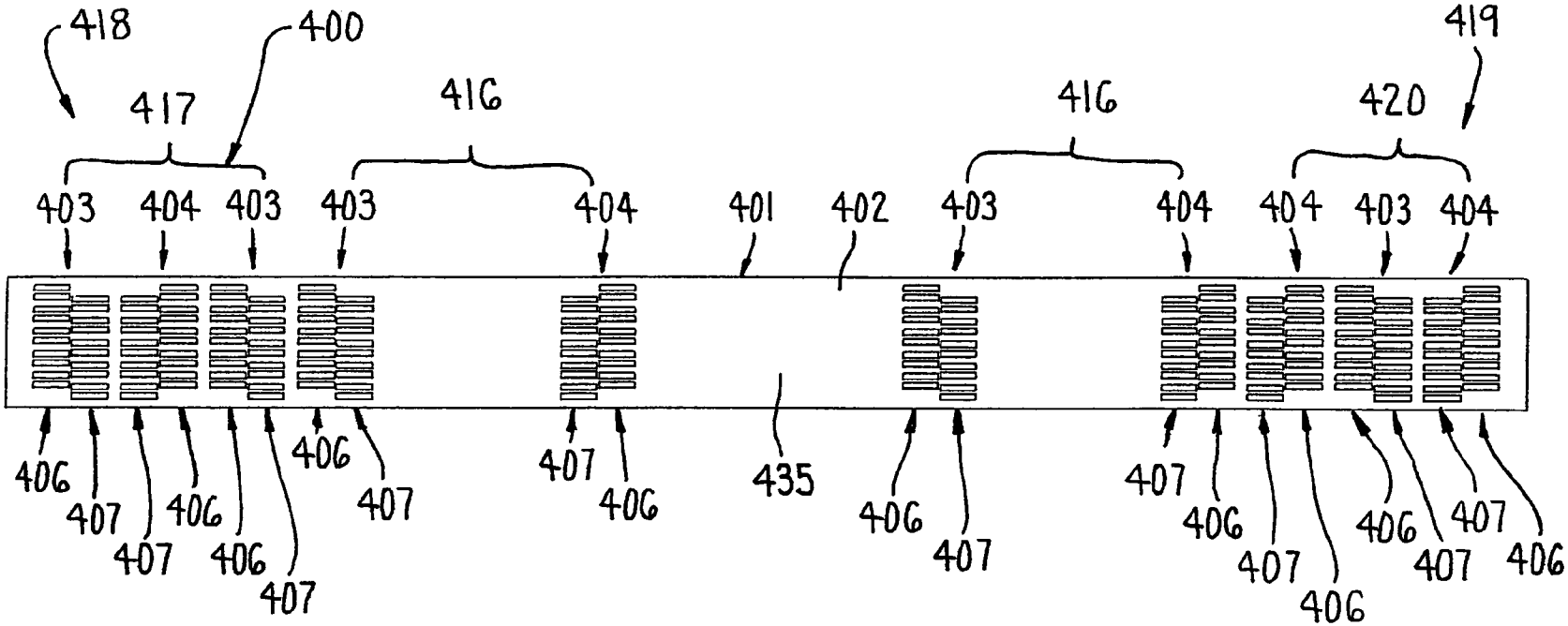
FIG. 11 is a front view of a power distribution assembly of a further power distribution system.

Referring to FIG. 11, each opening group 403 includes a first vertical row 406 of the apertures 405 and a second vertical row 407 of additional apertures 405. The row 406 of apertures 405 is at a higher elevation relative to the second row 407.

The adjacent group 404 of openings is formed similar to the group 403 in that group 404 includes a row 407 of apertures and another row 406 of apertures 405. However, the row 406 is located to the right of row 407 in group 404, which is opposite to the orientation of the rows 406 and 407 in the group 403. Thus, groups 403 and 404 are similar except that the higher elevation row 406 is located on different sides of their respective lower elevation rows 407.

With respect to the individual openings 405 of each row 406 or 407, each vertically adjacent pair of openings 405 is separated by a bridge or land of insulative material 410 which extends laterally across and vertically separates each vertically adjacent pair of openings 405. The openings 405 are formed in the same manner as the openings described previously in that during the extrusion process of the PDA 401, the individual openings 405 are punched into the insulative material of the casing 402.

Figure 12:
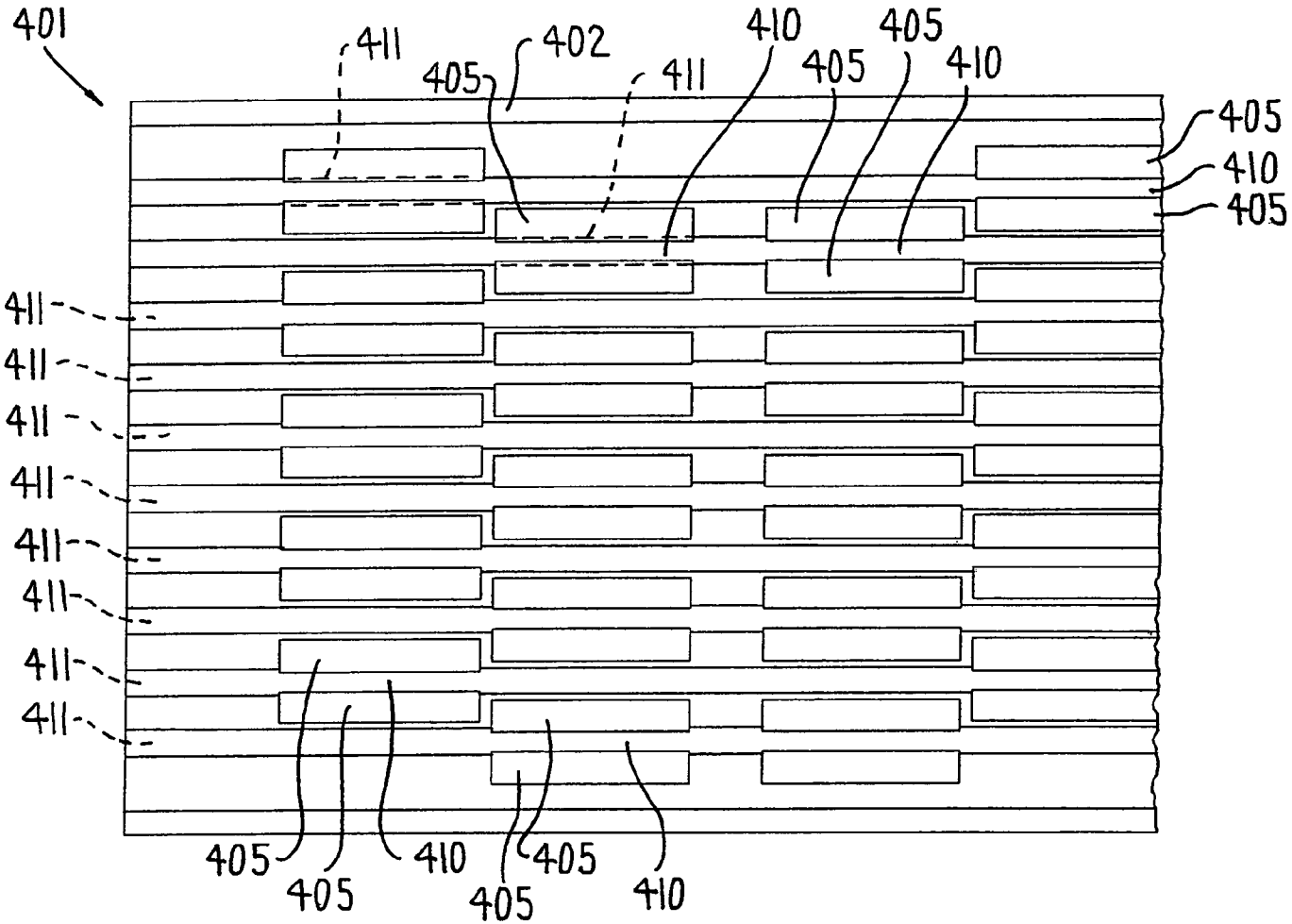
FIG. 12 is a front view of FIG. 11 illustrating conductors extending therethrough.

Referring to FIG. 12, the casing or extruded housing 402 of the PDA 401 is formed internally with a plurality of parallel grooves extending along the entire length of the PDA 401, in which a plurality of conductors 411 are received. Each conductor 411 extends the entire length of the PDA and extends below the bridge 410 disposed between an adjacent pair of openings 405. The conductor 411 for each pair of openings 405 is accessible therethrough and may be accessed through each of said openings 405.

Figure 13:
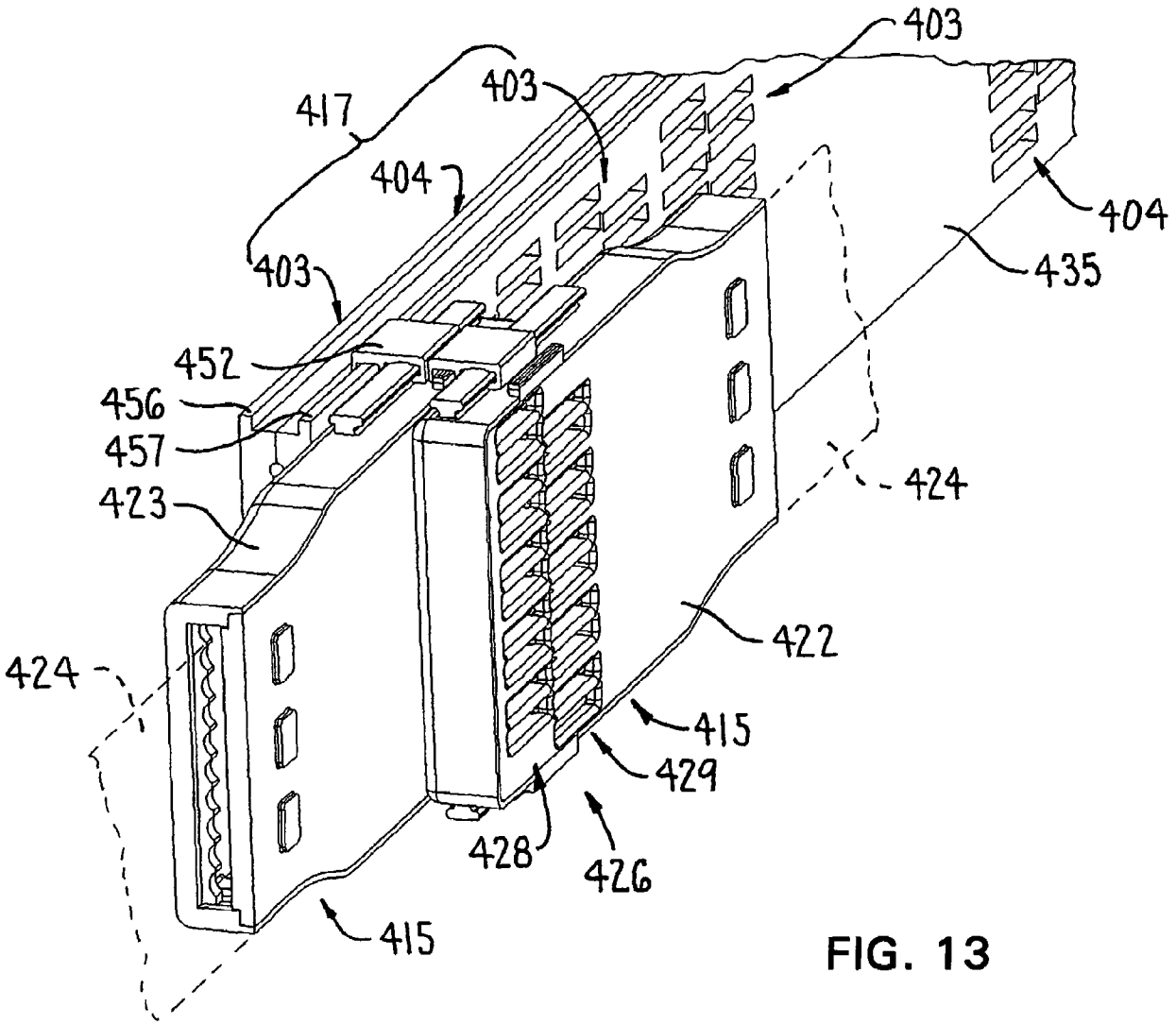
FIG. 13 is a perspective view of two flex connectors connected to the PDA.
Figure 14:
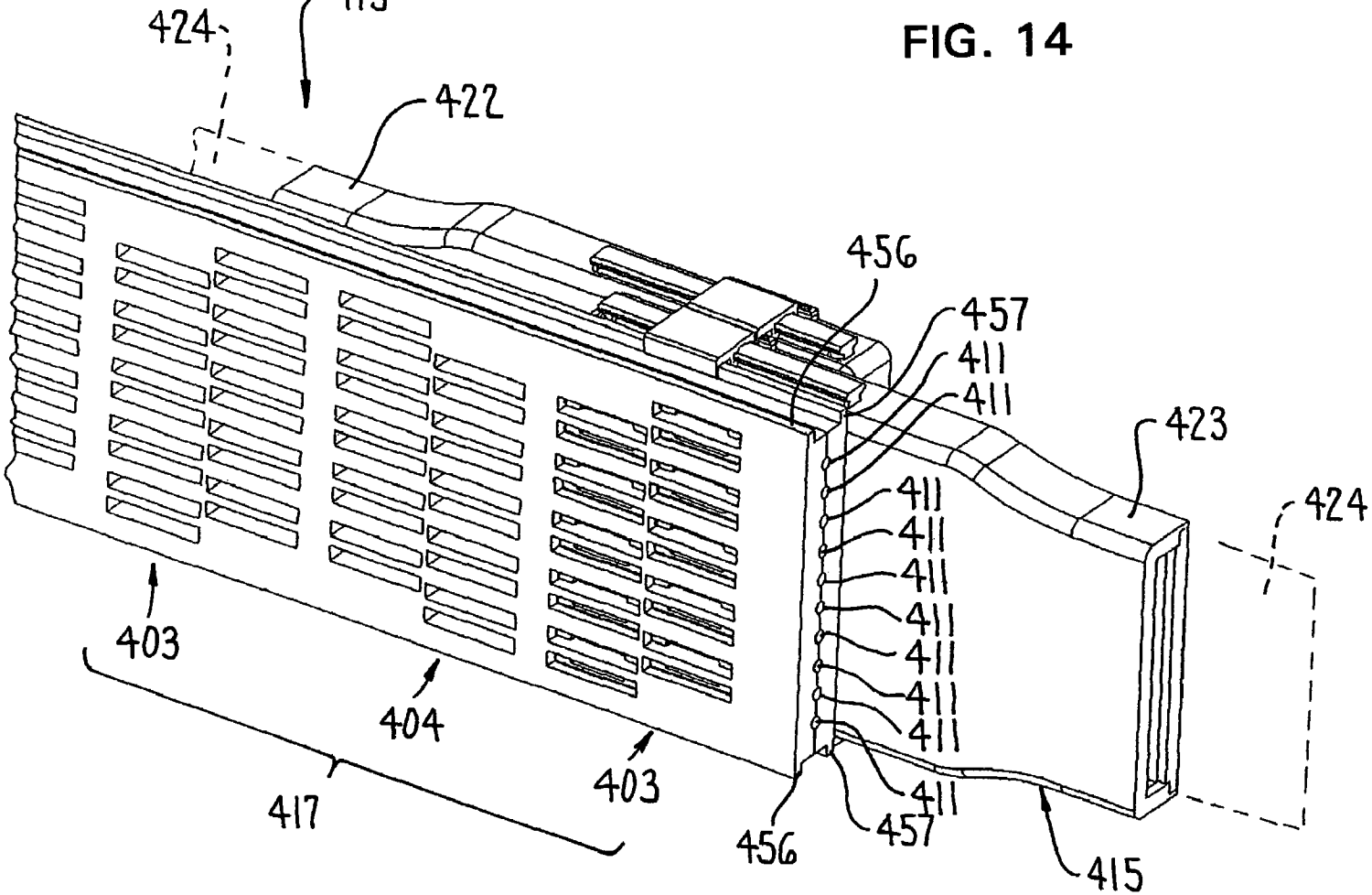
FIG. 14 is a rear perspective view of the flex connectors and PDA of FIG. 13.

Referring again to FIG. 11, the PDA 401 is formed with a set of three opening groups at each opposite end which are associated with each other and used to electrically connect serially adjacent PDAs 401 together through a flex connector 415 (FIGS. 13 and 14). Additionally, intermediate pairs of groups are associate with each other for the mounting of receptacles.

Specifically, the PDA 401 includes two intermediate grouping pairs 416 which each comprise an opening group 403 and an opening group 404. On the left end of the PDA 401, a group set 417 is provided on the left end 418 of the PDA 401. The group set 417 comprises a spaced apart pair of groups 403 with a croup 404 disposed therebetween. The opposite right end 419 of the PDA 401 includes a further group set 420 which comprises a spaced apart pair of groups 404 having another opening group 403 disposed centrally therebetween.

More particularly as to the flex connector 415 (FIGS. 15-20), each flex connector 415 includes a pair of connector plugs 422 and 423 at the opposite ends thereof, which are joined together by a bendable conductor body 424, which includes electrical conductors extending therethrough.

The plug 422 includes a group 426 of openings 427, which group 426 is defined by two vertical rows 428 and 429 of openings 427. The row 428 is at a higher elevation relative to the row 429 such that the opening group 426 has substantially the same configuration as the PDA opening group 403.

Figure 15:
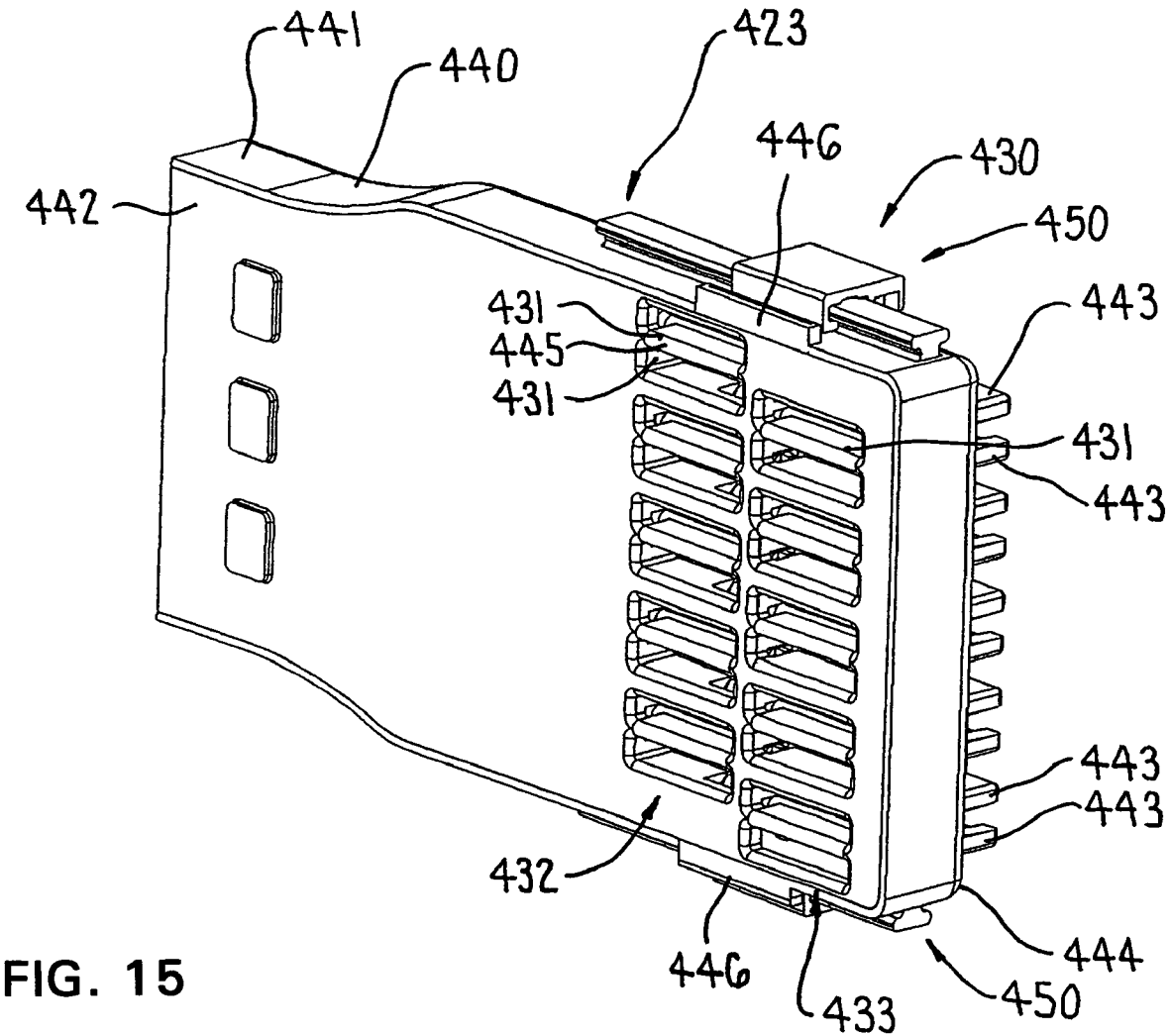
FIG. 15 is a front perspective view of a connector plug for the flex connector.

The plug 423 as illustrated in FIG. 15 similarly includes a group 430 of openings 431, which are arranged in two vertical rows 432 and 433, with row 432 being at a higher elevation. As such, the opening group 430 on the right end connector plug 423 is structurally and functionally similar to the opening group 403 described above.

The group set 417 and the group set 420 allow the flex connector 415 to be used on different sides of the PDA 401. Specifically, when the flex connector 415 is on the front PDA side 435, the plug 423 may be connected to either of the groups 403 in the group set 417. The plug 422 on the opposite end thereof would then be connected to the opening group 403 in the group set 420 on the serially adjacent PDA 401.

Specifically, as to the connector plugs 422 and 423, these components are formed substantially the same as each other and thus, while the following discussion is directed more specifically to the connector plug 423, this discussion also applies to the plug 422.

Figure 22:
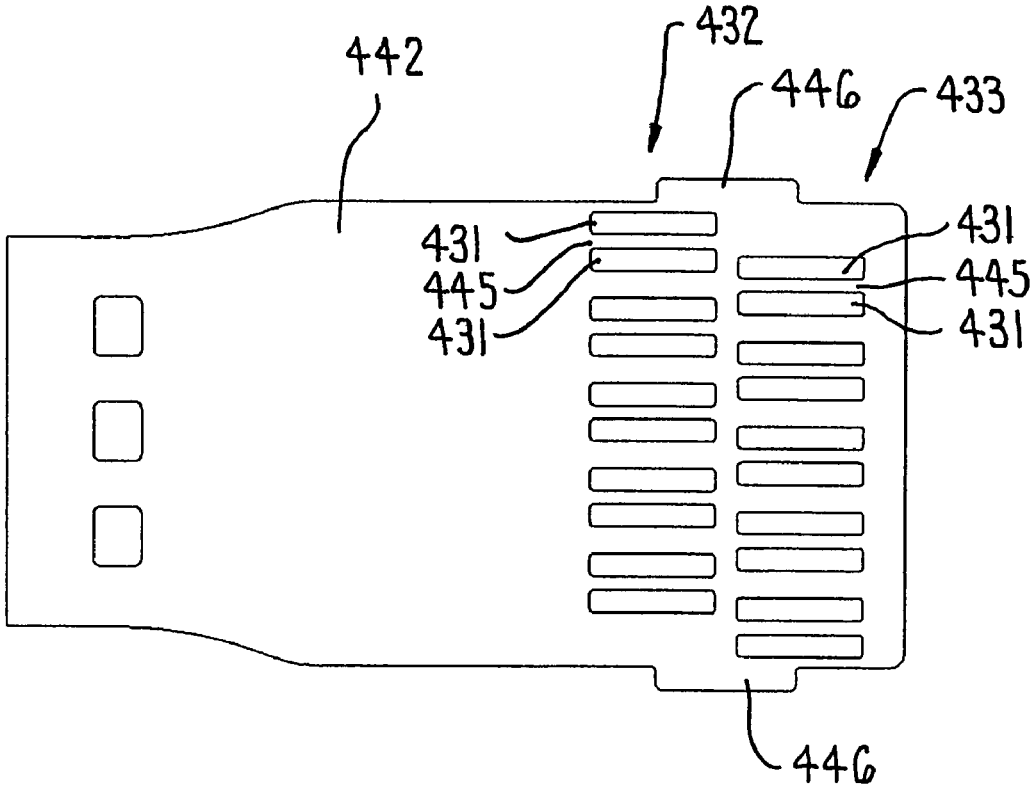
FIG. 22 is a plan view of a cover for the plug housing.

Referring to FIG. 15, the connector plug 423 includes a plug housing 440 defined by a housing base 441 and a housing cover 442. The plug housing 440 generally includes the opening group 430 formed in the cover 442 and also includes a plurality of contact posts 443 which project from an inside face 444 of the housing base 441. More particularly as to the cover 442, the cover 442 is illustrated in FIGS. 15 and 22. It is formed flat with the two rows 432 and 443 of openings 431 formed therein. Openings 431 are vertically spaced apart and generally arranged in pairs, wherein each pair of openings 431 is separated by a bridge or land 445. Additionally, locking flanges 446 project vertically from the upper and lower edges of the cover 442.

Figure 16:
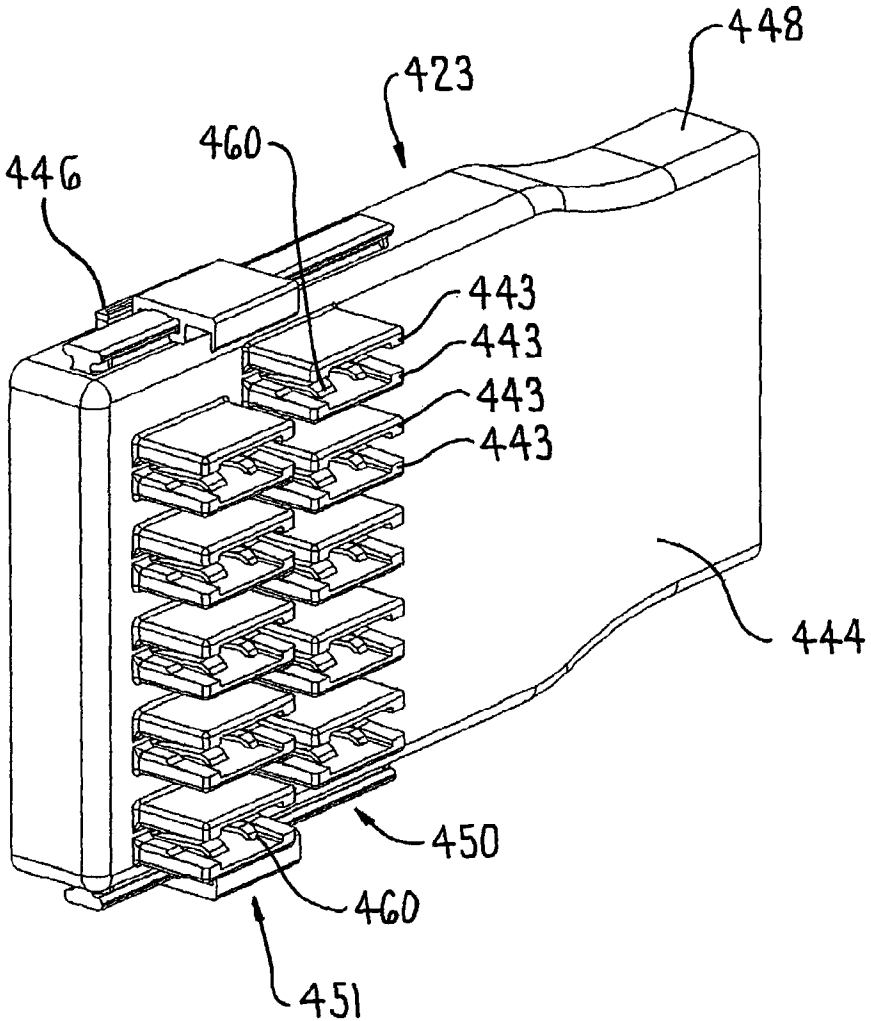
FIG. 16 is a rear view of the connector plug.
Figure 17:
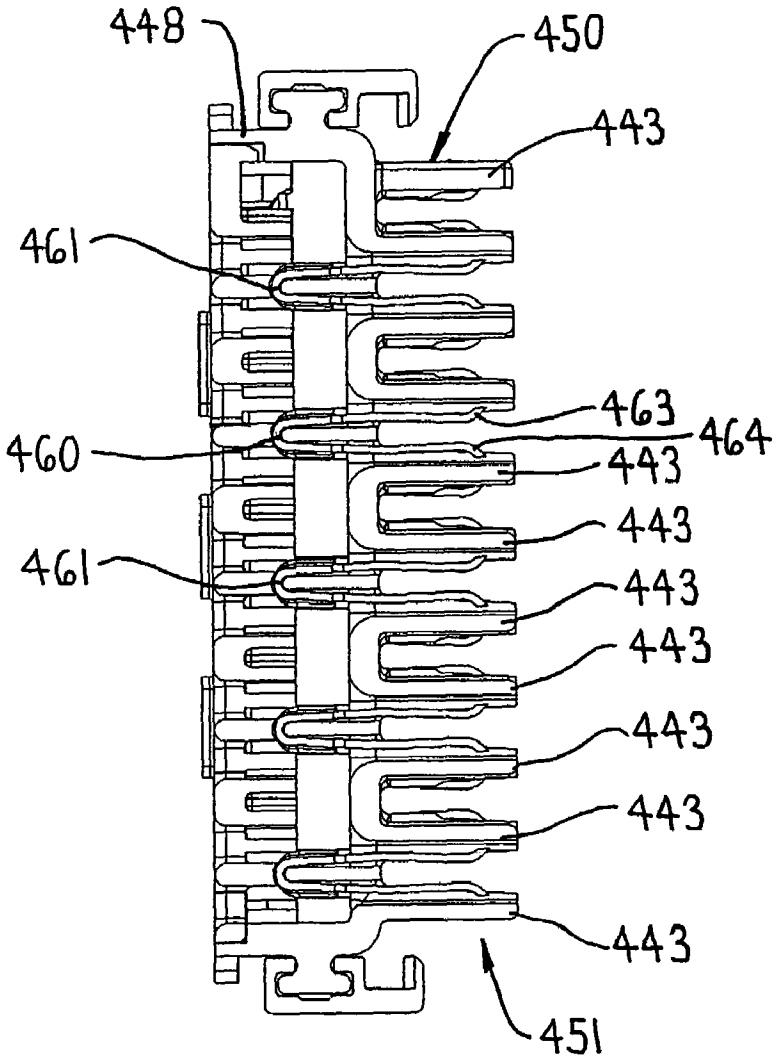
FIG. 17 is an end cross section of the connector plug.
Figure 18:
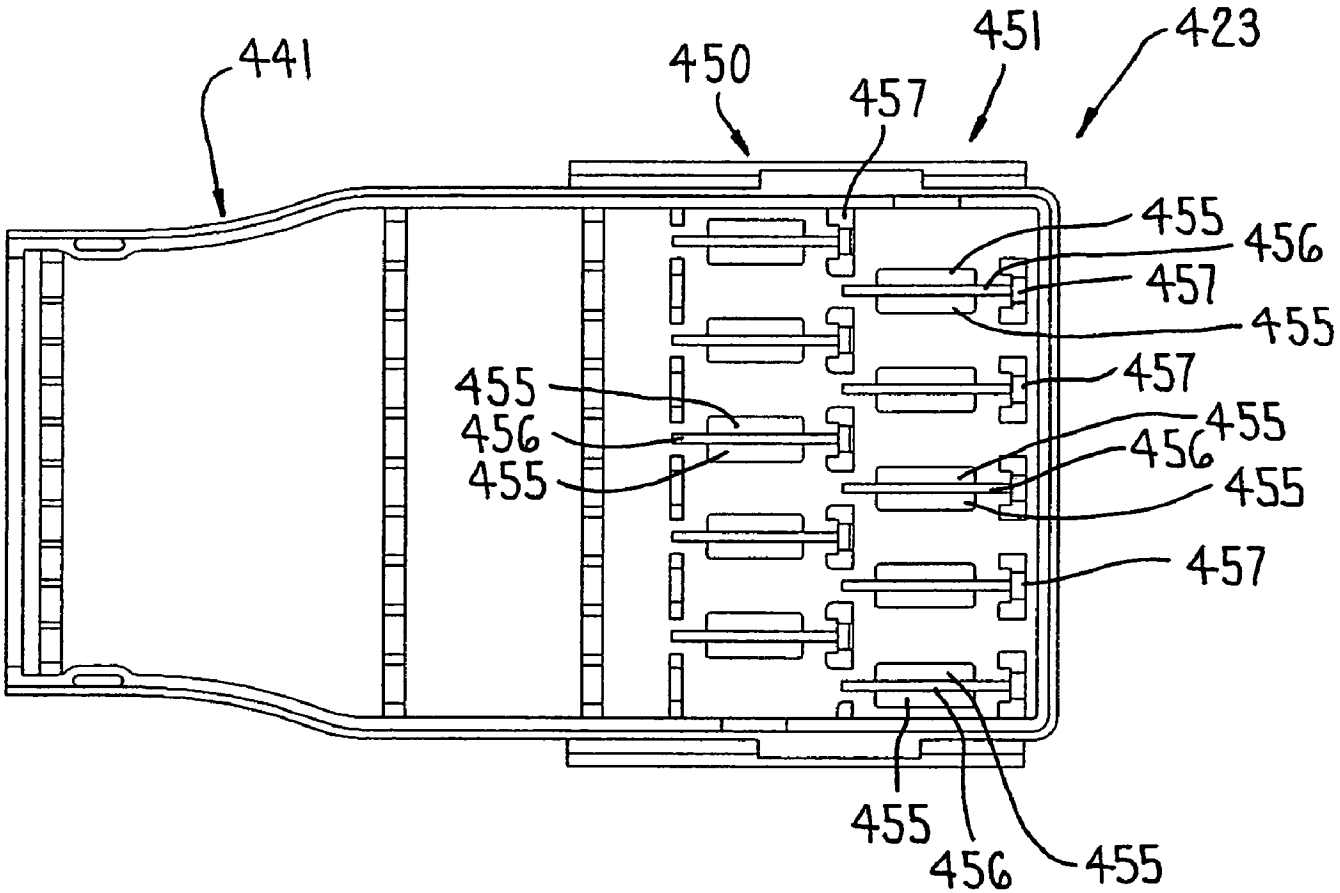
FIG. 18 is a plan view of a plug housing.
Figure 19:
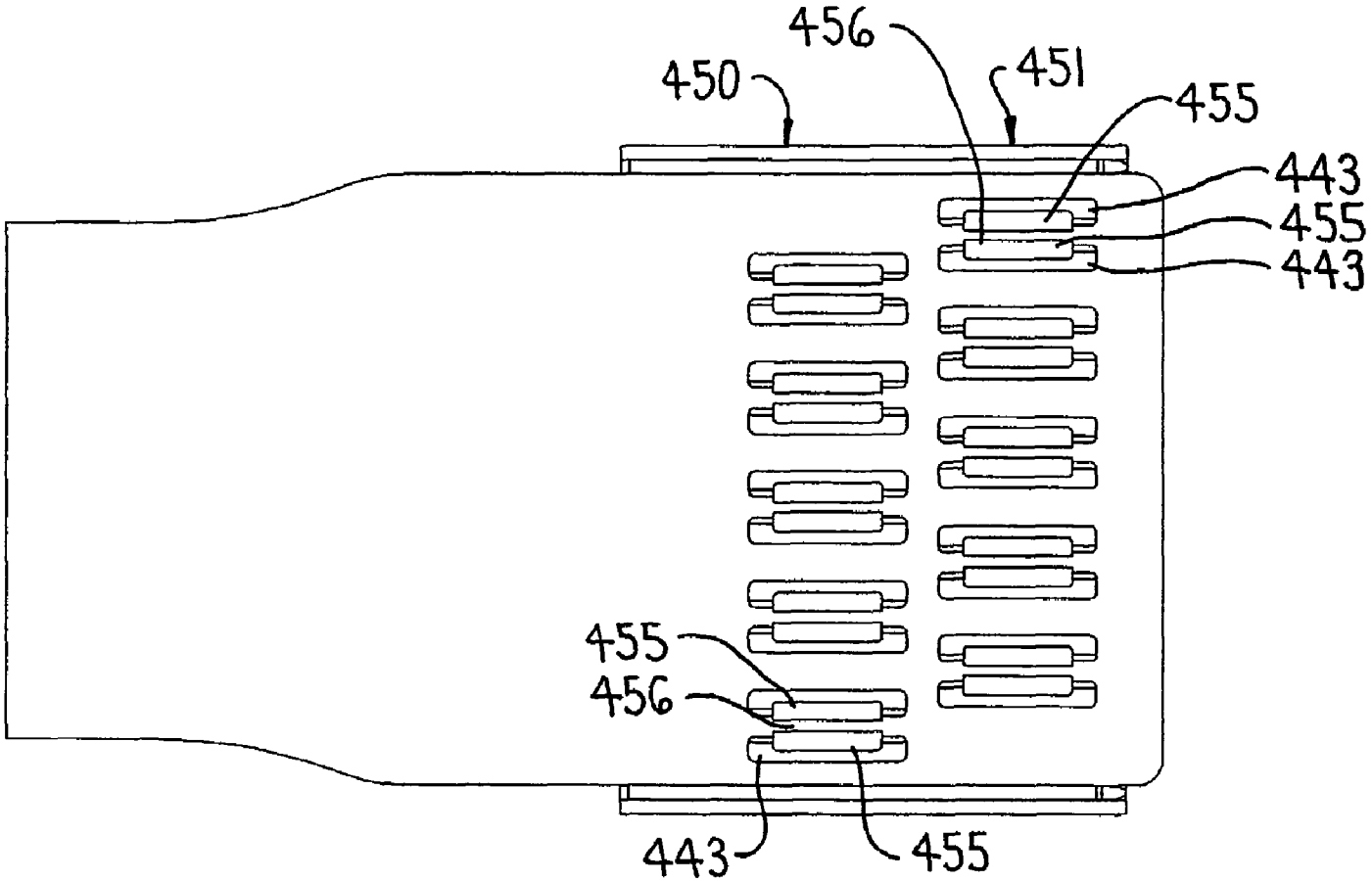
FIG. 19 is a bottom view of the plug housing.

Referring to FIG. 16, the base 442 has a peripheral side wall 448 and a main wall 449 from which the individual posts 443 project. The posts 443 are arranged in two vertical rows 450 and 451 having the same relative spacing as the openings 431 and specifically the vertical rows 432 and 433 thereof. The posts 443 are arranged in pairs of such posts 443 which are substantially identical to each other but arranged as mirror images in vertically spaced relation. The pairs of posts 443 are vertically spaced apart so as to fit within a corresponding pair of openings. For example, the posts 443 may fit into the openings 405 of the PDA 401 with the material bridge 410 being received between the posts 443. Alternatively, when one flex connector 415 is connected to another such as illustrated in FIGS. 13 and 14, the posts 443 would fit within the openings 427 of the connector plug 422, with a material bridge 455 being slideably received between the associated pair of posts 443.

More particularly, as to FIGS. 16-20, each post 443 has a rectangular opening 455 adjacent to an inside face thereof on the interior of the base 441. Each associated pair of openings 445 is separated by a rib 456. Additionally, each rib 456 extends and terminates at a support block 457.

Figure 20:
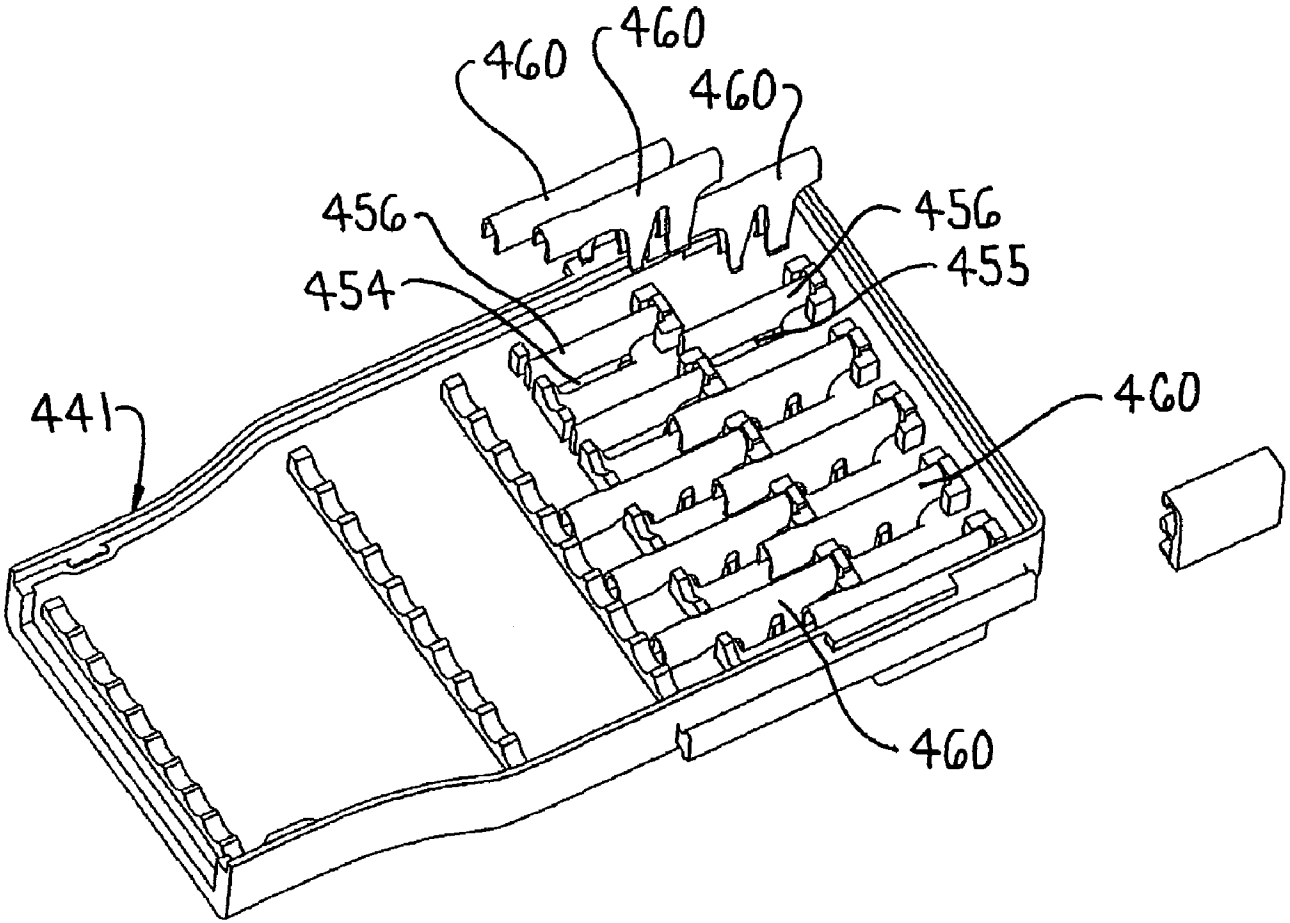
FIG. 20 is a perspective view of the plug housing.
Figure 21:
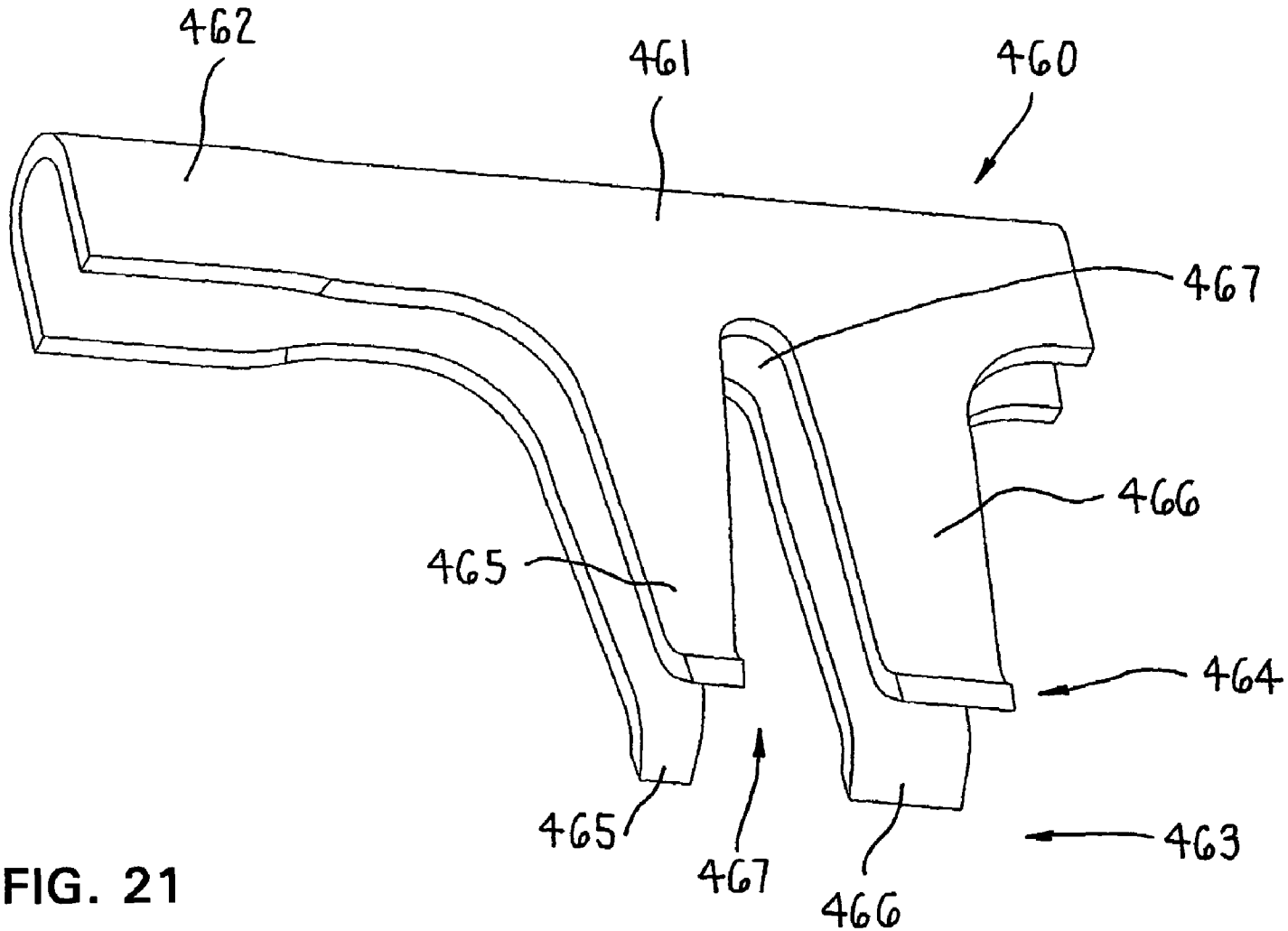
FIG. 21 is a perspective view of an electrical contact.

Referring to FIGS. 20 and 21, a generally U-shaped contact body 460 is mounted on each support rib 456. The front end of each contact body 460 fits within the support block 457 and is restrained from movement thereby. The contact body 460 is formed from a U-shaped barrel or spine section 461 having an enlarged semicylindrical conductor seat 462 at one end thereof. The conductor seat 462 is adapted to receive a conductor wire therein and which seat 462 is soldered to the free end of the wire. Additionally, a pair of contact prongs 463 and 464 project downwardly from the barrel 461. Each pair of prongs 463 and 464 comprises a narrow prong 465 and a wide prong 466 which are separated from each other by a gap 467.

When assembled together, the barrel portion 461 of each contact body is exposed within the interior and when the cover 442 is mounted in place, the barrel portions 461 are accessible through the openings 431 in the cover 442. Therefore, when joining two flex connectors 415 together such as in FIG. 13, the flex connectors can be electrically interconnected by engagement of the posts 443 therein. Additionally, the posts 443 of the plug 423 fit into a pair of openings 427. This allows the pairs of prongs 463 and 464 to resiliently fit over the barrel 461 of the lower contact body 460. Thus, the two plugs 422 and 443 are electrically connected together.

Referring to FIGS. 13-16, each connector plug 422 or 423 includes latching devices 450 on the upper and lower edges thereof. Each latching device comprises a T-shaped guide rail 451 and the locking flange 446 which is disposed parallel to but spaced sidewardly from the guide rail 451. Further, a slideable latch 452 is slideably connected to the rail 451 so as to be movable therealong. The latch 452 includes a groove 453 which fits over the guide rail 451. The latch 452 further includes a locking flange 454 which slides over and lockingly engages the flange 446 to prevent separation of the two plugs 422 and 423. When the two plugs 422 and 423 are fitted together, the latch 452 is then slid along the guide rail 451 until the flange 454 slides over and engages the flange 446. Thus, all of the components can be positively locked together.

Referring to FIG. 13, the same latch 452 also may be used to engage one of two locking ribs 456 or 457 which extend along both of the opposite side edges of the PDA 401.

In addition to the foregoing, each plug 422 or 423 may be fitted to the PDA 401 by insertion of the posts 443 into the openings 405. The prongs 463 and 464 spread apart as they pass over the bridge 410 between the openings 405 and then resiliently spring back together into contact with the respective conductor 411.

The system 400 functions similar to the above described power distribution system 10 such that further discussion of the system components such as a branch connector or a receptacle is not required.

Figure 23:
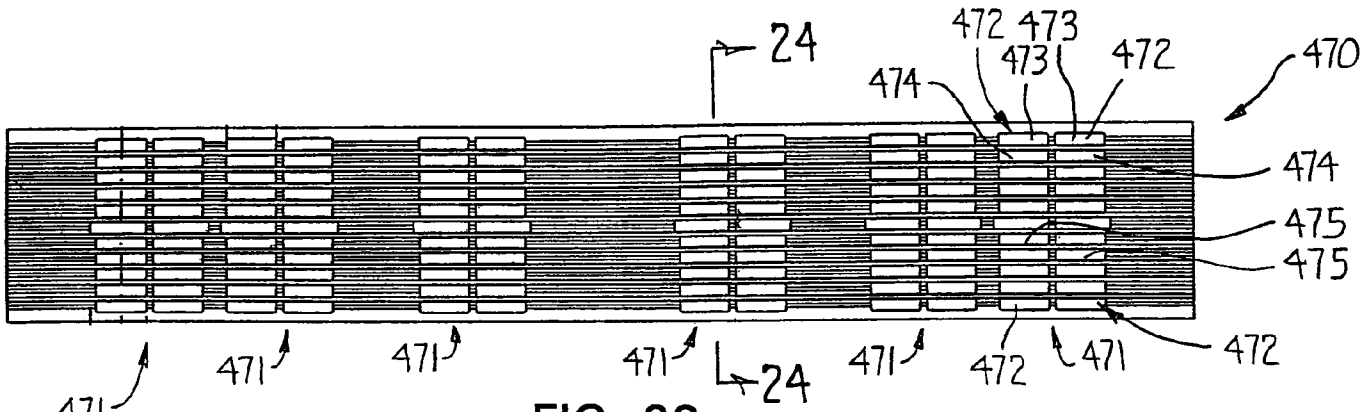
FIG. 23 is a front view of an extruded, one-piece power distribution assembly.
Figure 25:
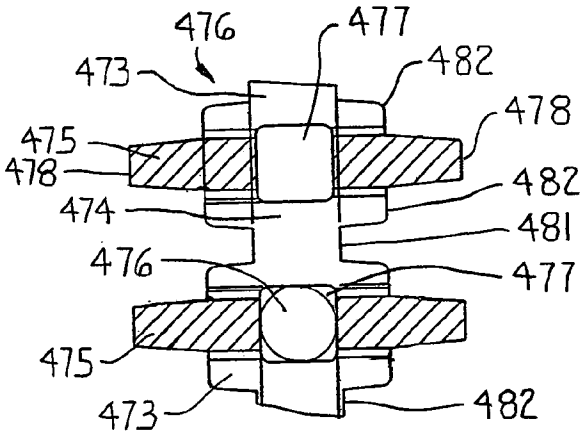
FIG. 25 is an enlarged partial view of the side cross section.
Figure 24:
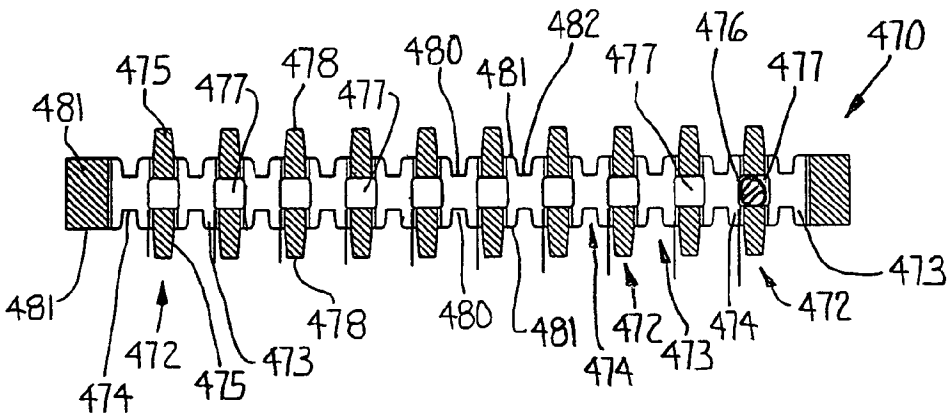
FIG. 24 is a side cross sectional view of the power distribution assembly as taken along line 24-24 of FIG. 23.

Referring to FIGS. 23-25, an additional power distribution assembly construction is illustrated therein wherein power distribution assembly 470 structurally and functionally operates substantially the same as the power distribution assemblies described above. The PDA 470 embodies additional inventive features in the structure and manufacture thereof.

More particularly, the PDA 470 includes groups 471 of openings 472 which are arranged in a substantially similar pattern to those groups of openings illustrated in FIG. 11. In this arrangement, each opening 472 that provides access to a conductor is defined by a first opening half 473 and a second opening half 474 wherein each interior electrical conductor 476 extends between a pair of opening halves 473 and 474. Therefore, each opening 472 in effect is defined by two opening halves 473 and 474 and the openings 472 in one column of the grouping 471 are aligned in side by side relation with the respective openings 472 of the next adjacent row of openings. However, they still functionally operate the same as that described above in that the receptacles, flex connectors, jumpers and other components engage with these openings 472 and have posts that are staggered and engage with a staggered pattern of the openings 472. Further the pattern of PDA openings allows the staggered configuration of the connectors to plug-in from either side of PDA.

Referring to FIG. 24, the PDA 470 preferably is formed of a one-piece extruded construction with the cross sectional shape illustrated in FIG. 24. This profile includes a plurality of upstanding parallel ribs 475 which extend along the entire length of the PDA 470 and separate the respective opening halves 473 and 474 one from the other. These ribs 475 thereby span the opening halves 473 and 474 and overlie the electrical conductor 476 (FIG. 24) which extends therebetween. Thus, when a receptacle or the like is plugged into an opening 472, the fingers of an electrical contact engage or straddle the opposite sides of the conductor 476.

Each conductor 476 spans the entire length of the PDA 470 through the parallel, rectangular bores 477 provided therein. The rectangular bores 477 are formed during the extrusion process and thereafter the conductors 476 are slid longitudinally therein. As seen in FIG. 25, the four corners of the rectangular bores 477 are disposed radially outwardly of the conductor 476 and provide the additional function of receiving any access plastic material or debris which might be generated within the bore 477 during insertion of the conductor 476 or during the extrusion process. As such, each conductor 476 is in four-point contact with the side walls of the bore 477 which reduces friction during the insertion process.

As to the thickness of the PDA 470, this PDA 470 has a maximum thickness defined by the terminal side faces 478 of the ribs 475 which thereby defines a maximum thickness for the PDA which thickness generally corresponds to the thickness of the PDA's described above. These surfaces 478 define the face against which the receptacles abut when engaged therewith.

The PDA 470 also includes inwardly extended grooves 480 (FIG. 24) which define the narrowest PDA thickness with intermediate PDA surfaces 481 being defined between the bottom face 482 of the grooves 480 and the outer faces 478 of the ribs 475. The faces 481 and 482 thereby define a thin region through which the opening halves 473 and 474 may be formed by mechanical punching through the extruded PDA material. This provides an improved profile during the manufacturing process such that less material is used during extrusion of the PDA 470 and punching is made easier by the thinner regions.

In this manner, the PDA 470 is formed which PDA is adapted for engagement by the various components described herein.

Turning next to FIGS. 26-30, an additional PDA construction is illustrated wherein the PDA 500 is formed with a two-piece extruded profile. More particularly, the PDA 500 has a similar arrangement of opening groups 501 wherein each opening 502 is defined by opening halves 503 and 504. Here again the openings 502 are formed in side by side relation but are engaged in a staggered manner by a receptacle, flex connector or the like.

Figure 27:
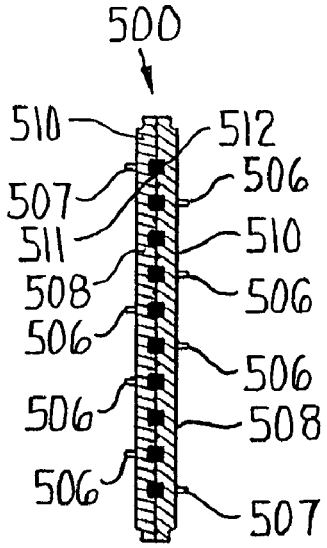
FIG. 27 is an end cross sectional view of the power distribution assembly as taken along line 27-27 of FIG. 28.

The PDA 500 is formed by a thin body section 505 and has a plurality of upstanding ribs 506 and 507 with relatively thin flat lands 508 and 509 being formed therebetween. Referring to FIG. 27, the PDA 500 is defined by opposed extrusion halves 510 which are formed identical to each other but mate together in inverted relation as seen in FIG. 27. The extrusion halves 510 include rectangular bores 511 therethrough like the rectangular bores described above which each receive an electrical conductor 512 longitudinally therethrough.

Figure 28:
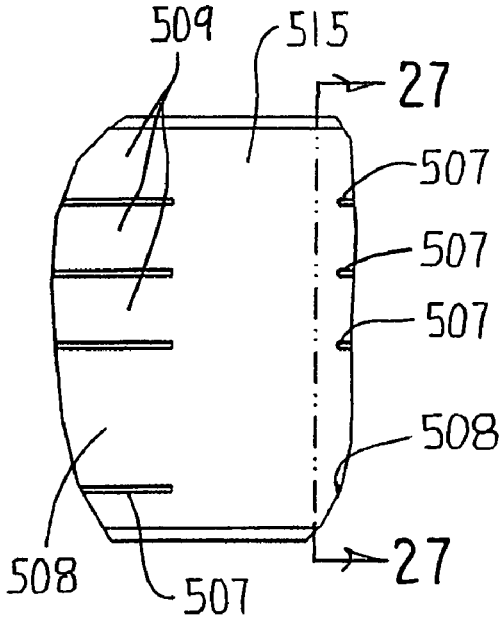
FIG. 28 is an enlarged front view of a portion of the power distribution assembly.

Referring to FIG. 28, the PDA 500 is grooved as illustrated in FIG. 28 to define a mounting bracket groove 515 which generally extends vertically. A number of such grooves 515 are provided spaced apart from each other depending upon the number of mounting brackets needed to mount a particular length of PDA to a wall panel or other furniture component. Each groove 515 is provided in pairs on opposite sides of the PDA 500 and allow for a mounting bracket to be clamped therebetween against the uniform flat face of the groove 515. The ribs 507 and 508, however, still extend between such grooves 515.

Figure 30:
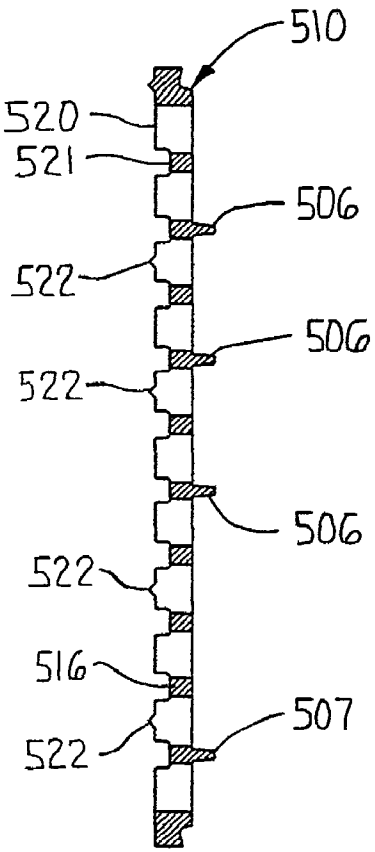
FIG. 30 is a cross sectional view of one of the extrusion halves.
Figure 29:
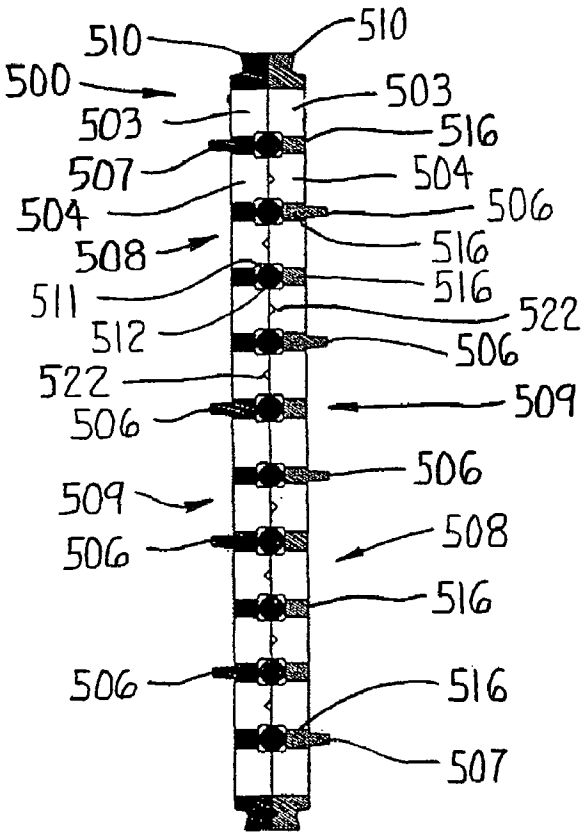
FIG. 29 is an end cross sectional view as taken along line 29-29 of FIG. 26.

Referring more particularly to FIGS. 29 and 30, the ribs 506 and 507 define the maximum thickness of the PDA 500, against which the system component such as a receptacle abuts when mounted thereto. These extrusion halves 510 thereby define the opening halves 503 and 504 therein which extend entirely through the thickness of the PDA 500. These opening halves 503 and 504 are separated from each other by horizontal bridge sections 516 which align longitudinally with the electrical conductor 512 that extends through the rectangular bores 511. Some of these bridge portions 516 align with the ribs 506 or 507 while others do not in the region of the flat lands 508 and 509.

Referring to the single extrusion half 510 illustrated in FIG. 30, this extrusion half 510 includes the structures described above and further has an inside face 520 which is grooved so as to define a bore section 521 that defines one half of the rectangular conductor bore 511. Additionally, this inside face 520 includes energy directors 522 which project inwardly to an apex and are configured to facilitate sonic welding of the extrusion halves 510 together. During assembly, the extrusion halves 510 are first extruded as a single piece as seen in FIG. 30 and then two opposed bearing halves 510 are disposed together in facing relation and ultrasonically welded wherein the energy directors 522 are disposed alternatingly as seen in FIG. 29 and serve to contact the other extrusion half 510 and assist in fusing the two extrusion halves 510 together during the assembly process.

The rectangular shape of each bore 511 causes less friction on the conductor wire being inserted therethrough while the square shape is easier to extrude and maintain the size thereof during this process. Additionally, the open spaces at the corners define dumping regions or pockets for debris. This debris may result from the punching process when punching the openings wherein burrs may extend into the bore, or may result from scraping of the conductor along the bore surfaces during longitudinal insertion through the bore 511. Also, with the two piece construction of FIGS. 29 and 30, the ultrasonic weld process may result in excess material flow into the bores which excess material may flow or squirt into these bores 511.

The construction of FIGS. 26-30 provides an improved PDA construction 500 which provides an improved result during the punching process and construction of the PDA 500.

Referring to FIGS. 31-36, a third type of PDA construction is illustrated which essentially uses a one-piece extrusion wherein the post-receiving openings instead are defined by insert assemblies 542 that fit within relatively large windows within a PDA 530.

Figure 26:
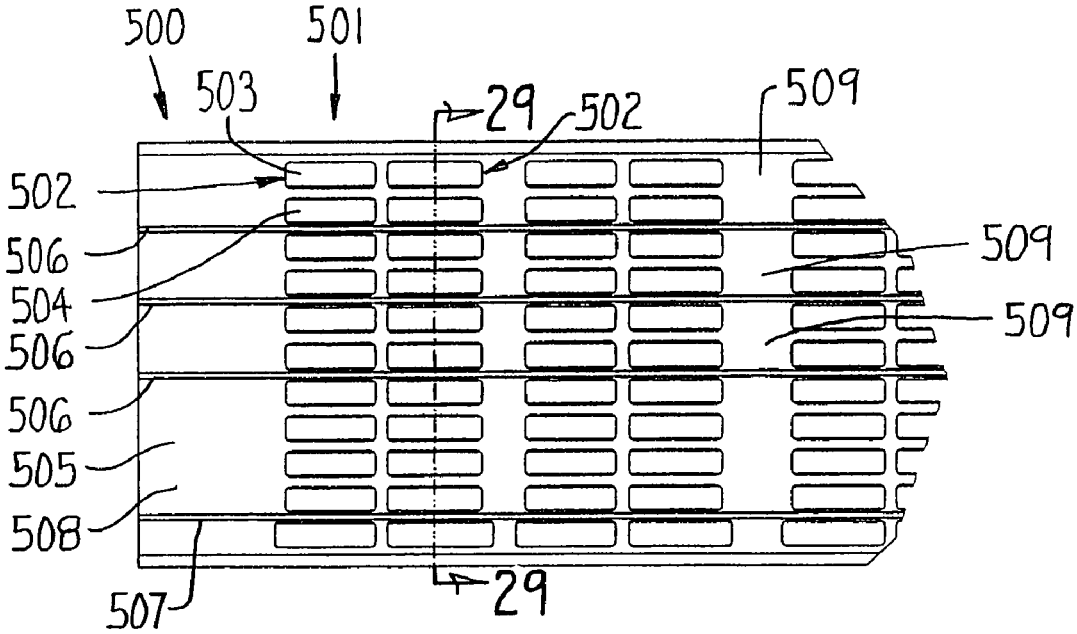
FIG. 26 is a partial front view of an extruded, two-piece power distribution assembly.
Figure 31:
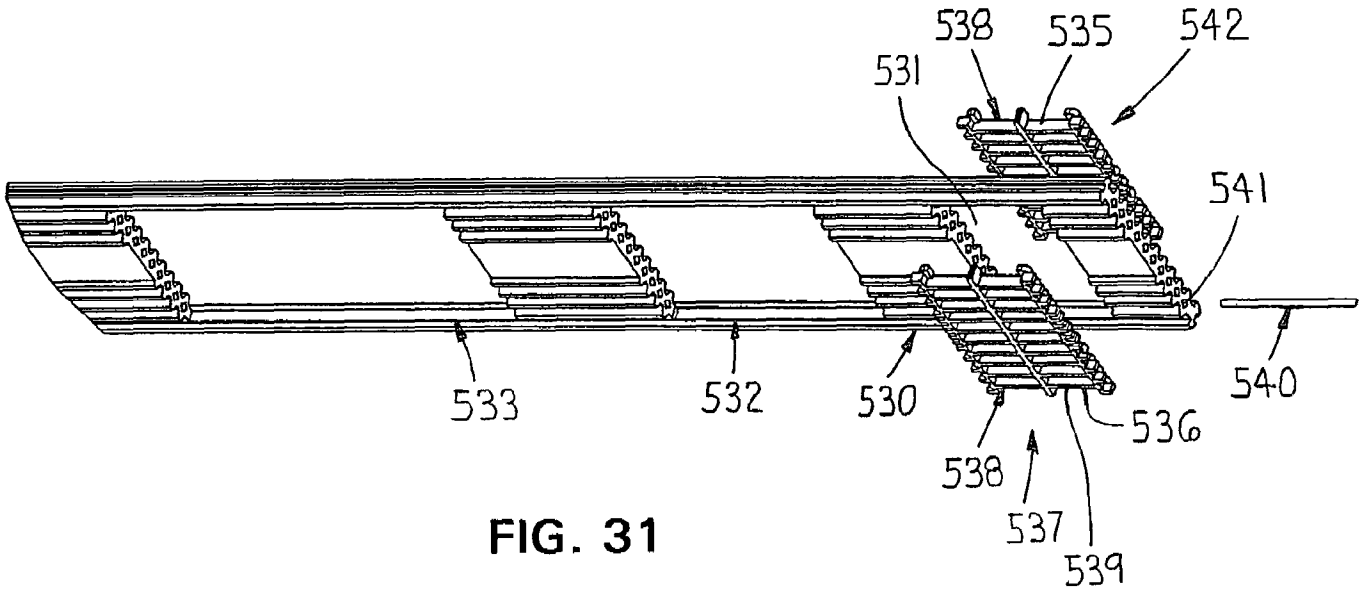
FIG. 31 is an isometric view of an extruded multi-component power distribution assembly having inserts which define groups of openings.

More particularly, the PDA 530 is illustrated with three such windows 531, 532 and 533 being present in various sizes. The single opening 531 is adapted to receive two inserts 535 and 536 to define an insert assembly 542 which inserts 535 and 536 together define a respective group 537 of openings 538. Inserts 535 and 536 thereby define the same pattern of openings as described above relative to the PDA's 470 (FIG. 23) and 500 (FIG. 26). These openings 538 essentially have opening halves separated by bridges 539 that overly the conductor 540 that extends through the length of the PDA 530. In FIG. 31, an end of the conductor 540 is illustrated just prior to insertion into a corresponding bore 541 in the PDA 530. The inserts 535 and 536 are discussed in further detail herein. It will be understood that while a single width insert assembly 542 is provided, this insert assembly 542 may be provided as a double-width for the opening 532 or a triple-width for the opening 533 either of which would have additional opening groups 537.

Figure 32:
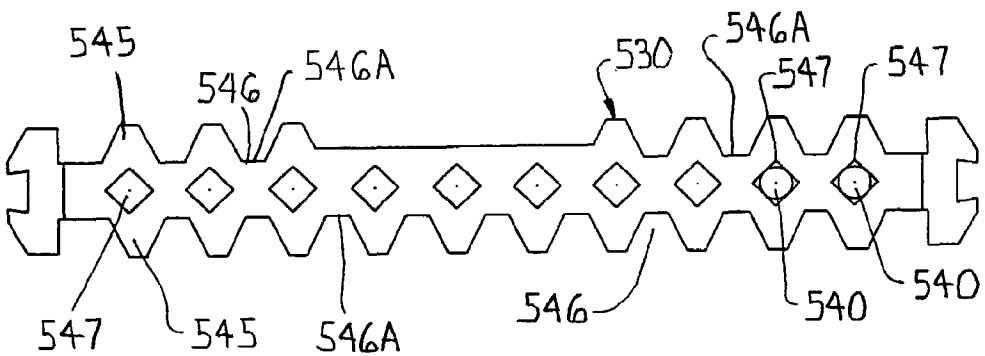
FIG. 32 is an end view of the power distribution assembly.

Referring to FIG. 32, the PDA extrusion 530 is formed with a pattern of ribs 545 and grooves 546 which primarily are provided to improve the extrusion process. The ribs 545 define the maximum thickness of the PDA 530 while the grooves 546 define the minimum thickness thereof at the groove surface 546A.

In the region disposed between each opposite pair of such ribs 545, a rectangular conductor bore 547 is provided which is substantially similar to those bores described above and further discussion thereof is not believed to be required. Notably, these bores 547 are rotated 45° from the orientation of the bores 477 shown previously. Either orientation may be applied to all the PDA constructions disclosed herein and provide the same advantages relative to debris. These parallel bores 547 are adapted to receive the conductors 540 longitudinally through the entire length of the PDA 530.

Figure 33:
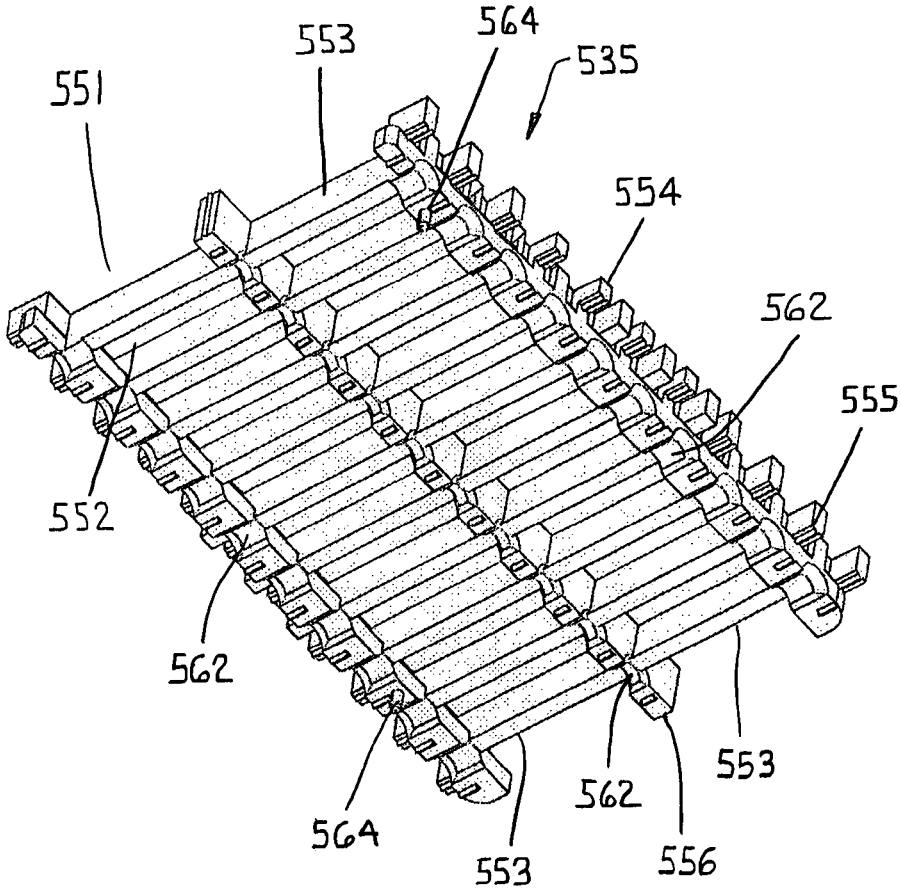
FIG. 33 is an inside isometric view of the first insert.
Figure 34:
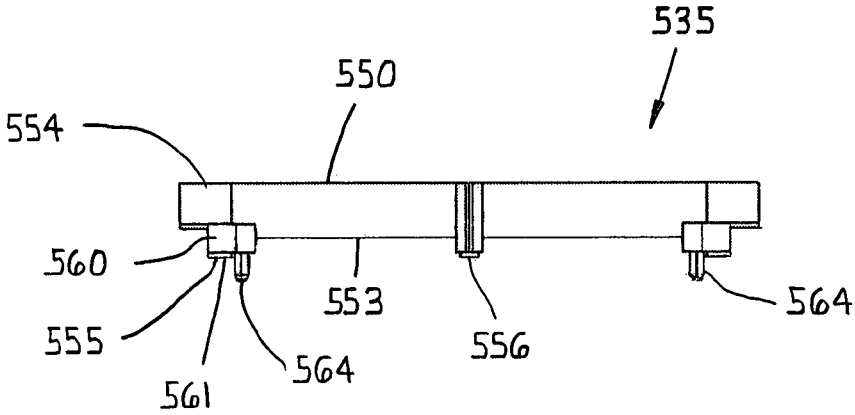
FIG. 34 is a top view of the insert.
Figure 35:
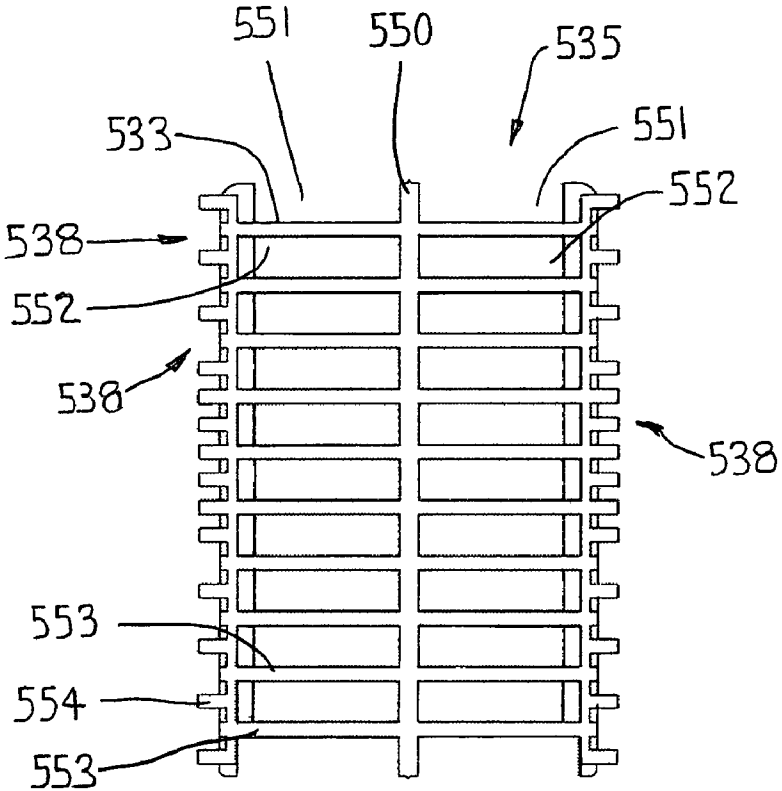
FIG. 35 is an outside view of the insert.

Referring to FIGS. 33-35, the first insert 535 is illustrated. This insert 535 is adapted to be received within the respective opening 531 while resting against the face of the PDA 530. In this regard, insert 535 includes an outer face 550 in which the opening halves 551 and 552 are provided in vertically aligned pairs to essentially define an opening 538. A plurality of such opening halves are provided to define a plurality of openings 538 which are aligned in vertical grooves and also arranged in side by side relation. This allows for staggered engagement by the staggered posts of the receptacles as fully described above. Each of these opening halves 551 and 552 are separated by a bridge portion 553 which is adapted to overlie a respective conductor 540.

A plurality of additional locator flanges 554 are provided which are each located between an adjacent pair of the bridged portions 553. The locator flanges 554 are each adapted to fit into a respective one of the PDA grooves 546 and abut against the bottom groove face 546A (FIG. 32) to thereby locate the insert 535 within the opening 531 so that the bridged portions 553 of the insert 535 overlie and are aligned with their respective conductors 540. The bottom or interior face of each flange 554 includes an energy director 555 while additional energy directors 556 are provided in the middle of the insert 535. These allow for ultrasonic welding of the flanges 554 to the groove face 546A by the directors 555 and the opposing inserts 535 and 536 directly together by the directors 556.

Additionally as seen in FIG. 34, the insert 535 is formed with a generally rectangular projecting portion 560 that is adapted to closely fit within the rectangular PDA window 531. The inside face 561 of this projecting portion includes arcuate grooves 562 which generally align with the bridged portions 553 and receive the conductors 540 such that the conductors 540 are sandwiched within these grooved portions 562 between the inserts 535 and 536.

Figure 36:
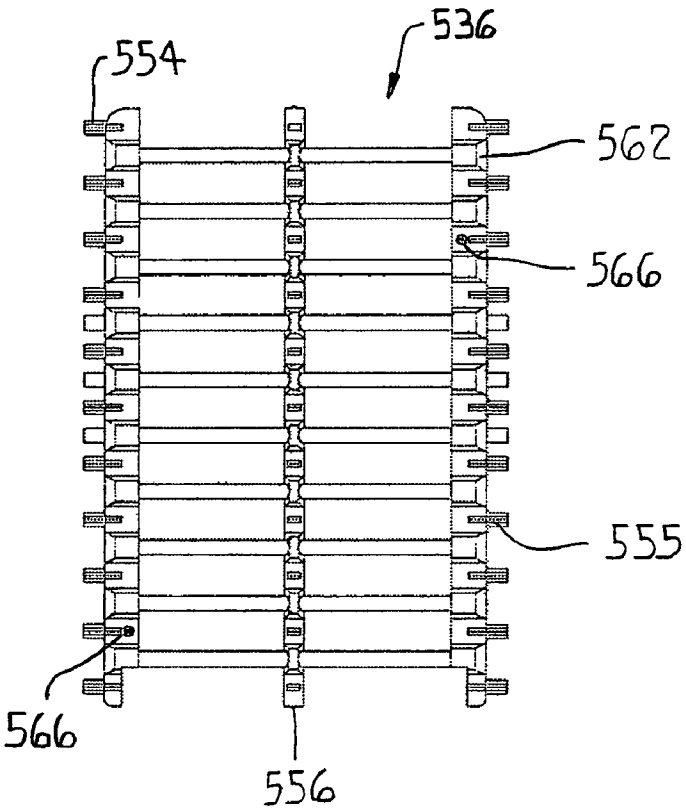
FIG. 36 is an inside view of a second insert that mates with the first insert of FIG. 33.

To align the inserts 535 and 536 when fitting together, a pair of connector posts 564 are provided which project inwardly or rearwardly. Referring to FIG. 36, the opposite second insert 536 is formed substantially identical to the first insert 535 as described above and thus has common structural features. However the insert 536 includes a pair of alignment bores 566 which are adapted to receive the posts 564. The insert 536 also includes the same arrangement of energy directors 555 and 556. Thus, the inserts 535 and 536 are inserted into their respective window 531 from opposite sides of the PDA 530, aligned and then rigidly affixed together by welding to enclose the window 531 and to provide a PDA assembly 530 which functions similar to those PDA's described above.

With the above described arrangements, several PDA constructions are illustrated in FIGS. 23-36.

Also, additional improved components for the power distribution system are described hereinafter.

Figure 39:
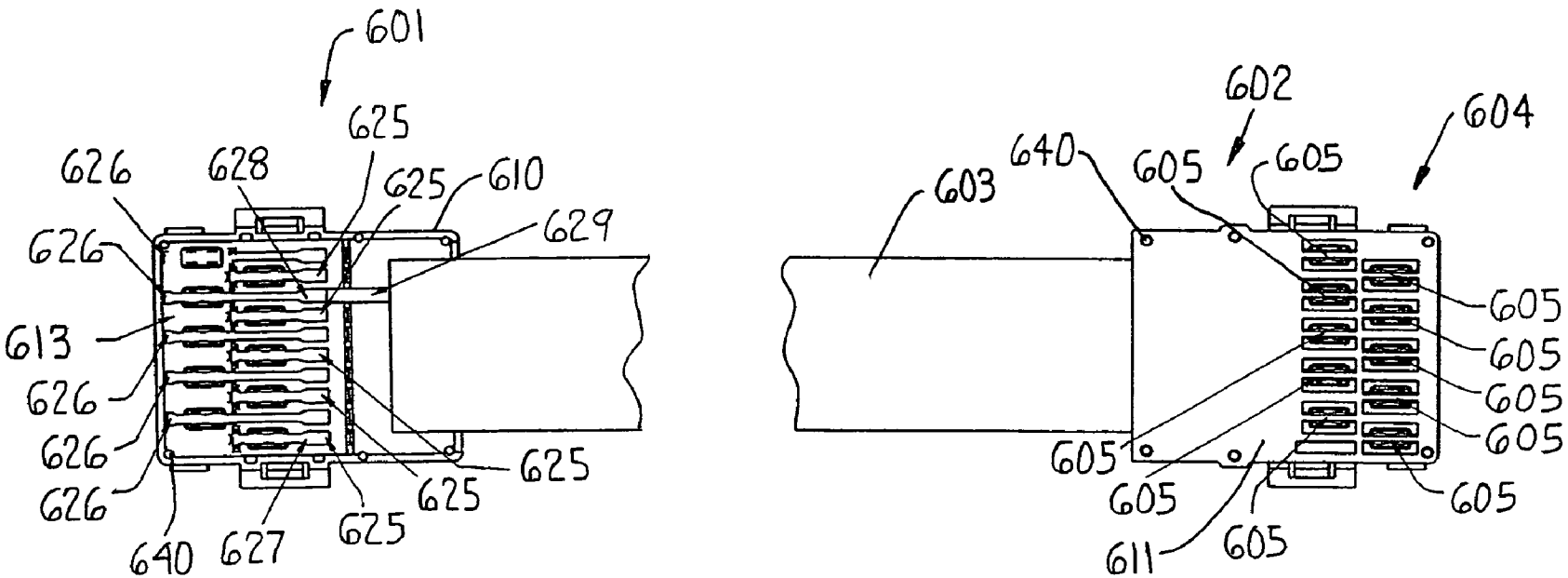
FIG. 39 is a back view of the flex connector with a top cover removed from one end thereof.

Referring to FIGS. 38-39, an improved flex connector 600 is illustrated. This flex connector 600 includes a pair of connector plugs 601 and 602 at the opposite ends thereof which are joined together by a bendable or flexible conductor body 603. Each plug 601 and 602 includes a group 604 (FIG. 39) of openings 605, which group 604 is defined by two vertical rows of such openings 605 in substantially the same pattern as that described above. Hence, the discussion of such components as already described above is equally applicable to the flex connector 600 and a detailed discussion of the structure and function is not believed to be required. Notably, however, the openings 605 are generally staggered.

Additionally, each plug 601 and 602 includes a staggered set of contact posts 606 (FIGS. 37 and 38). These posts 606 are also provided in a staggered relation that corresponds to the opening 605 and are adapted to engage any of the openings described above relative to the PDA's 470, 500 and 530. Each of these posts 606 is split so as to straddle the conductors of the above described PDA's from opposite sides. A more detailed discussion of such components is not required herein.

Figure 40:
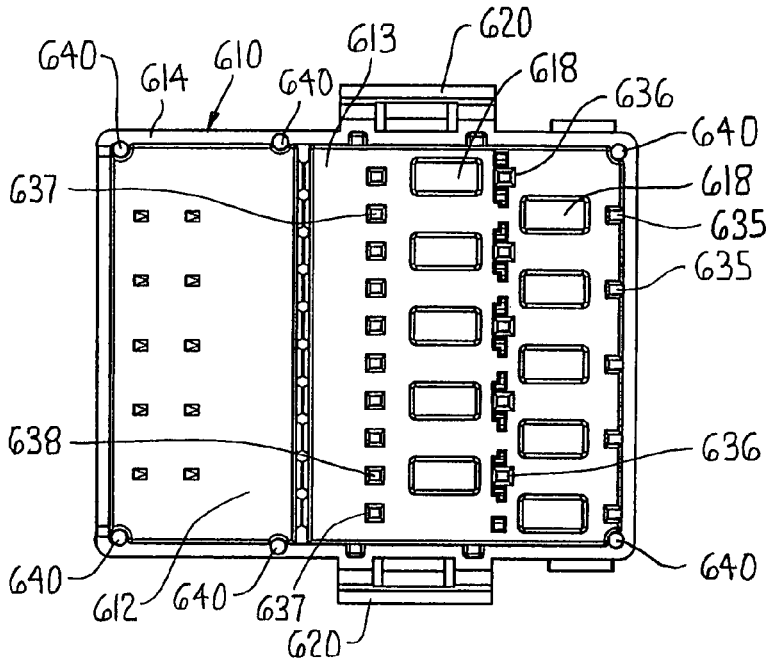
FIG. 40 is a front view of the connector housing.
Figure 41:
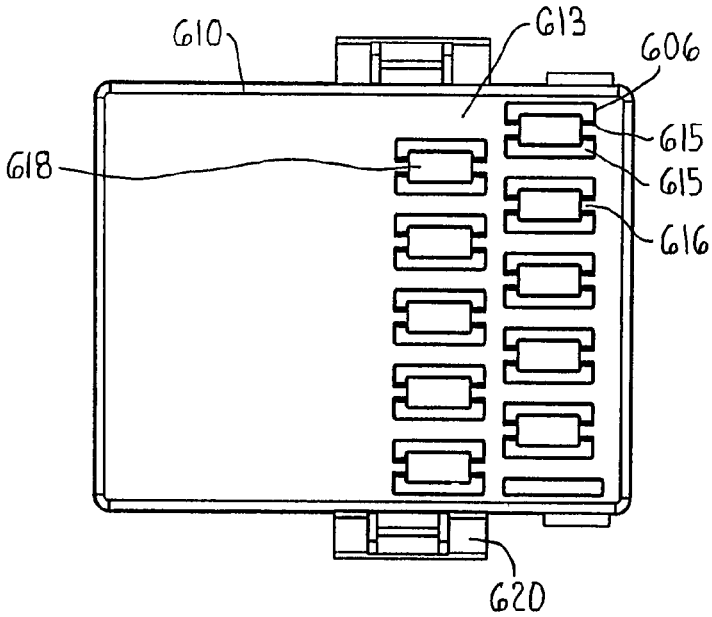
FIG. 41 is a back view of the connector housing.
Figure 42:
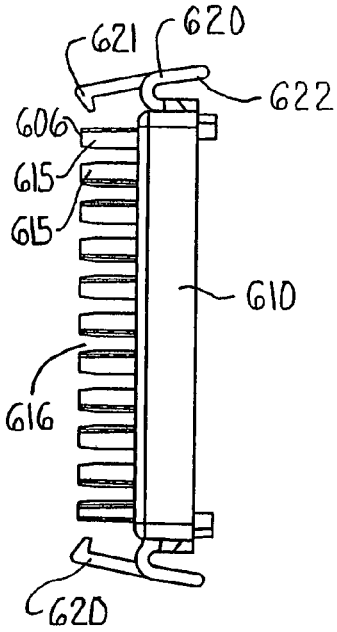
FIG. 42 is an end view of the connector housing.

Each plug 601 and 602 generally is defined by a plug housing 610 and a cover 611. Referring to the plug housing 610 as illustrated in FIGS. 40-42, this plug housing 610 defines a hollow interior 612 defined by bottom wall 613 and a side wall 614. A bottom wall 613 includes the slotted posts 606 projecting downwardly therefrom. These posts 606 are defined by post sections 615 that are provided in pairs and define a slot 616 therebetween. Further, these posts 606 are aligned with the access openings 618 which are provided in a staggered relation for engagement with a corresponding staggered set of openings in the PDA's 470, 500 and 530.

The housing sidewall 614 also includes a pair of latches 620 that are integrally formed in cantilevered relation with the sidewall 614. These latches 620 have a hooked end portion 621 and a depressible finger pad 622 which may be pressed toward the side wall 614 to pivot the hook 621 outwardly and allow for disengagement of the plug 601 or 602 from the respective PDA or another component to which it may be engaged.

Referring to FIG. 39, the housing 610 is adapted to receive a plurality of contacts or terminals therein. Preferably, the plugs 601 and 602 include a plurality of short terminals 625 and a plurality of long terminals 626 which are arranged in alternating relation. As such, each connector in 627 or 628 is aligned with each other as seen in FIG. 99 for uniform engagement with the conductors 629 of the conductor body 603. These terminals 625 and 626 are illustrated in further detail in FIGS. 48 and 49 and are provided with four contact fingers 630 that essentially define a quad-point configuration such as that discussed previously. It is noted that the barrel 631 or 632 of the respective terminals 625 or 626 are adapted for engagement with another terminal of another system component as will be described in further detail herein. The common reference numeral 630 is used to identify any of the contact fingers referenced above.

To locate the terminals 625 or 626 within the plug housing 610, a plurality of alignment ribs 635, 636, 637 and 638 are provided. The ribs 635 and 637 are provided in aligned pairs for cooperation with the long contact terminal 626 while the ribs 636 and 638 are provided in pairs for cooperation with the short terminals 625.

Figure 44:
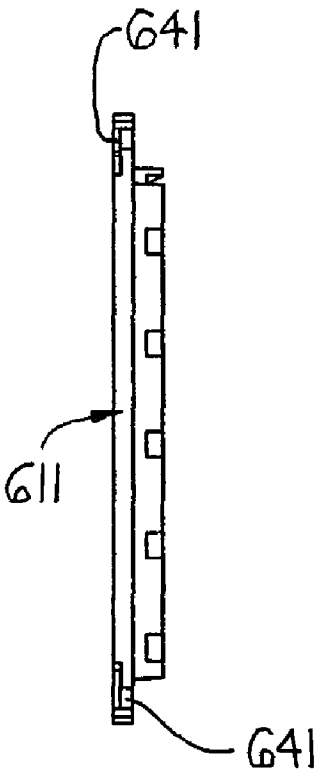
FIG. 44 is an end view of the housing cover.
Figure 43:
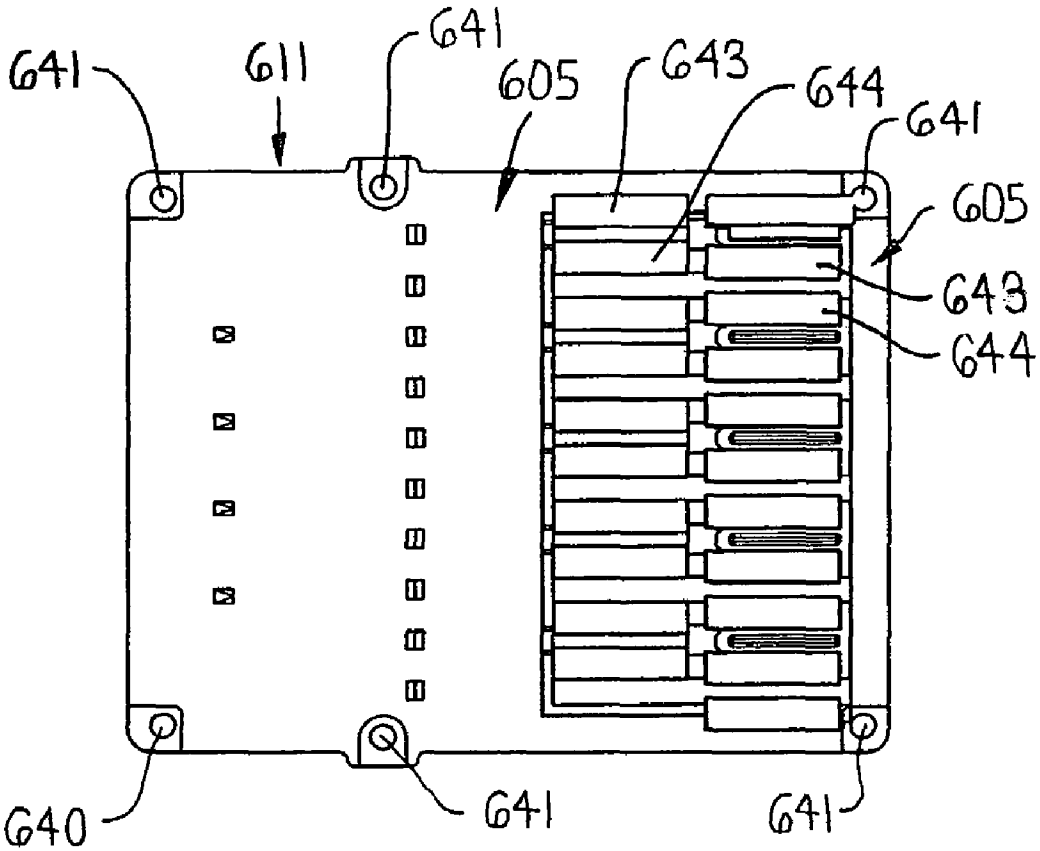
FIG. 43 is an inside view of the housing cover.

To secure the cover 611 in place, the plug housing 610 also includes connector posts 640 about the periphery thereof which project upwardly and project through the cover 611. Referring more particularly to FIGS. 43 and 44, the cover 611 includes corresponding connector bores 641 through which they post 640 are received. The posts 640 may then be mechanically deformed such as by heat-staking or cold forming to secure the cover 611 fixedly on the housing 610.

The housing 611 includes the above-identified post openings 605 therethrough which openings 605 are defined by rectangular opening halves 643 and 644. These opening halves 643 and 644 thereby permit access to the terminal barrels 631 and 632 of the respective terminals 625 or 626.

Referring to FIG. 51, a representative cross section of either of the terminals 625 or 626 is illustrated with the contact fingers 630 projecting downwardly therefrom. These contact fingers 630 are illustrated in an initial undeflected position as indicated by the cross-hatching. However, when the plugs 606 are inserted into the respective openings of the PDA's described above, these fingers 630 are deflected outwardly by the PDA conductor such as conductor 476 to the condition identified by phantom outline reference lines 630. Initially, even when the plugs 601 or 602 are engaged with a respective PDA, an additional system component may be engaged thereto through the openings 605. Hence, FIG. 51 illustrates an additional contact 625 or 626 engaged therewith as indicated in the position 650 wherein the contact fingers 630 engage the respective terminal barrel 631 or 632. In this manner, the system components may be stacked one on top of the other since these plugs 601 and 602 include both male connectors and female connectors.

Figure 45:
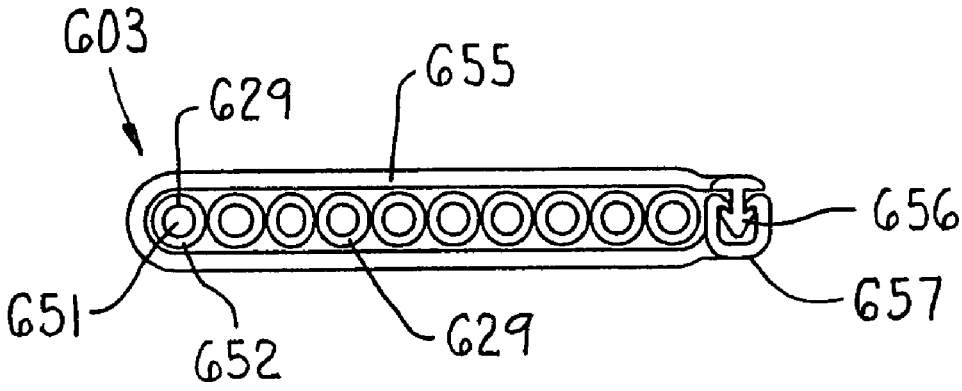
FIG. 45 is an end view of a conductor body for the flex connector having a foldable cable carrier or sleeve.

More particularly as to FIGS. 39 and 45-47, the conductor body 603 includes a plurality of individual conductor wires 629 extending longitudinally therethrough that are each engaged with a respective one of the terminals 625 or 626 at each opposite end. In this regard, FIG. 45 illustrates a plurality of such wires 629 which are each defined as having an interior conductor 651 surrounded by a wire sheath 652. Individual wires 629 are each connected to a respective pair of such terminals 625 or 626 and then arranged in a bore as illustrated in FIG. 45.

An outer wire carrier 655 is provided as a foldable enclosure having a snap-fit rib 656 extending along one edge thereof and a corresponding groove 657 along the other edge there which engage within each other as seen in FIG. 45. Thus, this cable carrier 655 may be folded over the wires 629 and then snapped to a closed position.

Figure 46:
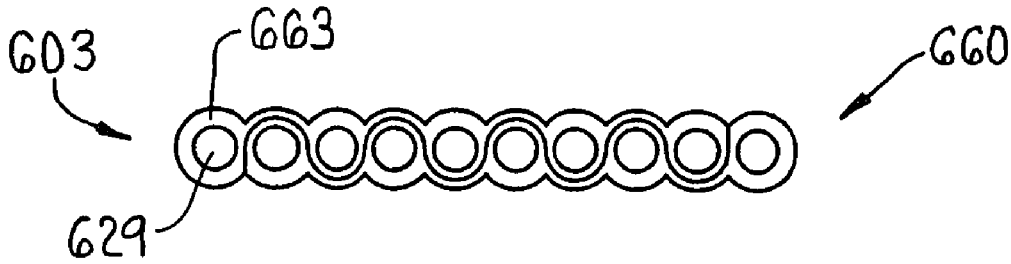
FIG. 46 is an end view of a festoon conductor body having interfitting festoon sections.
Figure 47:
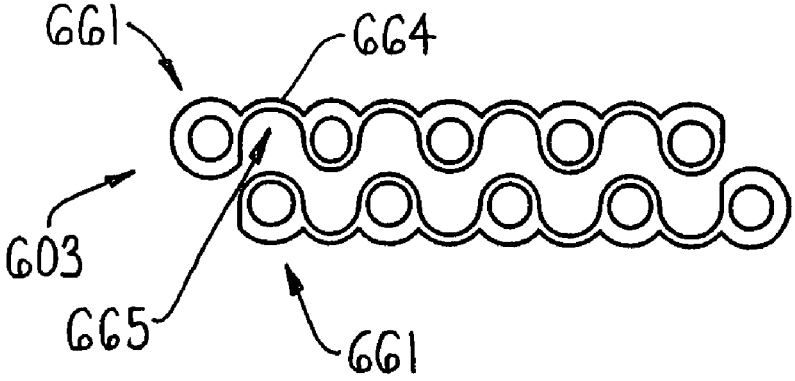
FIG. 47 is an exploded view of the festoon conductor body.

Referring to FIGS. 46 and 47, the conductor body 603 alternatively may be formed with a festoon configuration. This festoon cable 660 is formed from two cable sections 661 which are formed identical to each other but are inverted in opposing relation as seen in FIG. 47 so as to be mated together to define the festoon cable assembly illustrated in FIG. 46. Each cable section 661 has a plurality of spaced apart conductor wires 662 extending along the longitudinally length thereof which are enclosed or over molded by molded plastic 663 as an insulator. Each wire 662 is joined by a thin intermediate wall 664 which thereby defines a wire-receiving groove 665 therein. A plurality of such grooves 665 are provided which are each adapted to tightly receive a corresponding wire of the other cable section 661 as seen in FIGS. 46 and 47. As such, the cable sections 661 are first sidewardly offset as seen in FIG. 47 and then tight fittingly engaged together as seen in FIG. 46. When engaged together, the wires 662 have free ends which extend outwardly from the plastic over molded material as seen generally in FIG. 39 so that the free end of the wire 629 may be secured to a respective one of the terminals 625 and 626. As such, each of the wires 629 projects outwardly of the outer insulative layer 663 or the carrier 655 wherein the opposite free ends of each wire each have a respective terminal 625 or 626 fixedly secured thereto to define an electrical connection therebetween.

During the assembly process, the cable section 603 has its opposite ends threaded inwardly into the plug housings 610 as seen in FIG. 39 and then the cover 611 is secured thereto to effectively clamp the end of the cable carrier 603 to define a rigidly interconnected assembly of the plugs 601 and 602 and the conductor carrier 603.

As such, the above-described plug connector 601 is assembled and is useable with the above-described PDA's for 470, 500 and 530.

Figure 52:
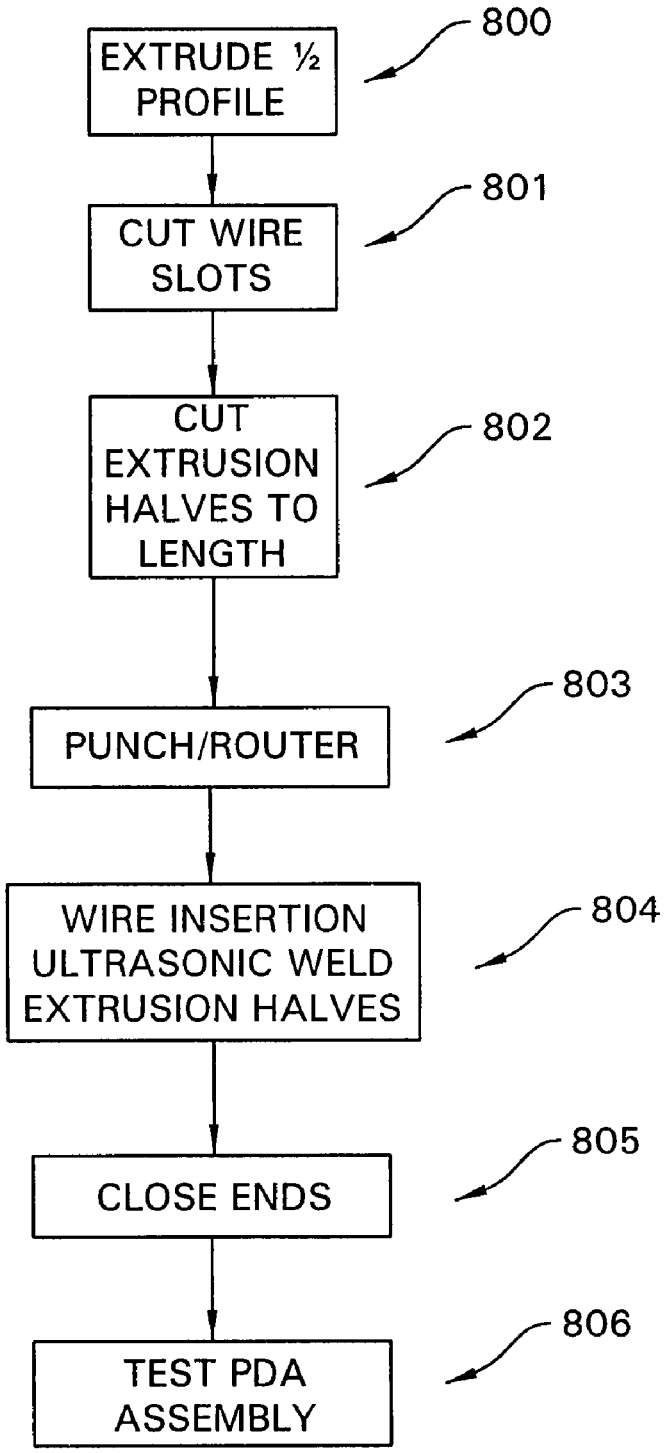
FIG. 52 is a flowchart illustrating the process steps for manufacturing the two-piece PDA of FIG. 29.

Referring to the manufacturing processes for the PDA's, FIG. 52 is a flowchart of the process for manufacturing the two-piece PDA 500 of FIGS. 26-30. Generally, the two separate extrusion halves 510 are extruded in step 800 which ultimately are joined together to define the casing of the PDA 500. Thereafter, the wire slots 521 (FIG. 30) are cut into the inside extrusion face 520 by a common arbor having ten saw blades in step 801.

In step 802, the long lengths of extruded halves are cut to desired lengths, and then the holes 503 and 504 are punched into the extrusion halves 510 through the thickness thereof. Simultaneously or separately, the mounting bracket grooves 515 are also formed in the outer faces of the extrusion halves 510 in step 803. Then the extrusion halves 510 are positioned in opposing relation in an ultrasonic weld unit which holds the halves together and permits the insertion or shooting of conductors 512 into the conductor bores 511 in step 804. In this station, the halves 510 are also welded together to define a complete assembly comprising the extrusion halves 510 and the ten conductors 512.

In step 805, the ends of the extrusion 501 and in particular, the ends of the bores 511 are closed to insulate the ends of the conductors 512. Lastly, the PDA assembly is electrically tested in step 806.

Figure 53:
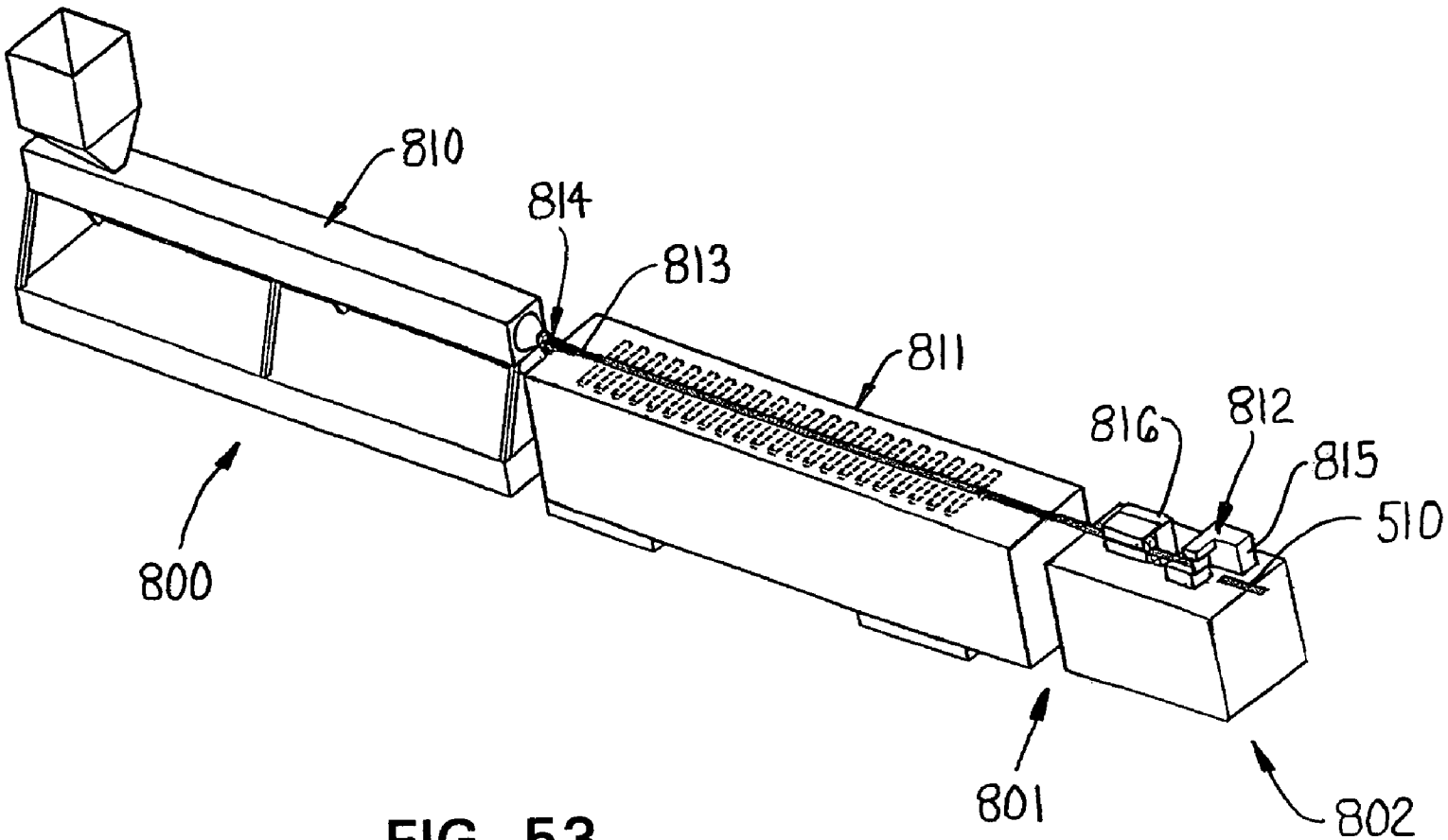
FIG. 53 is an isometric view of an extrusion machine and cutoff machine for the process.

More particularly as to the individual steps and machines therefore, FIG. 53 illustrates an extrusion machine 810, a transfer station 811, and a cutoff machine 812. In step 800, the extrusion machine 810 extrudes a long length or stock 813 of the half extrusion profile through an outlet 814. The extrusion stock 813 travels linearly along the transfer station 811 to the cutoff machine 812, which machine 812 includes appropriate blades in a cutter 815 to cleanly cut the stock 813 into desired lengths of extrusion halves 510.

Either before or after cutoff, the extrusion stock 813 is machined or cut in step 801 by arbor mount slitting cutters which define the bore grooves 521. These grooves 521 define half of the dimension of the bores 511 for receipt of the conductors 512 therein. Such a cutter may be provided at location 816 or at other suitable locations upstream and downstream of the cutoff machine 815, although preferably this occurs before the cutoff machine 815.

The cutoff machine 815 would be controlled by a control system that determines the part number being produced, and cuts the extrusion stock 813 to a length corresponding to such part number. In this regard, the extrusion stock 813 could also be cut to a stock length of, for example, 20 feet and then this length would be cut down to the specific length associated with the part number.

Figure 54:
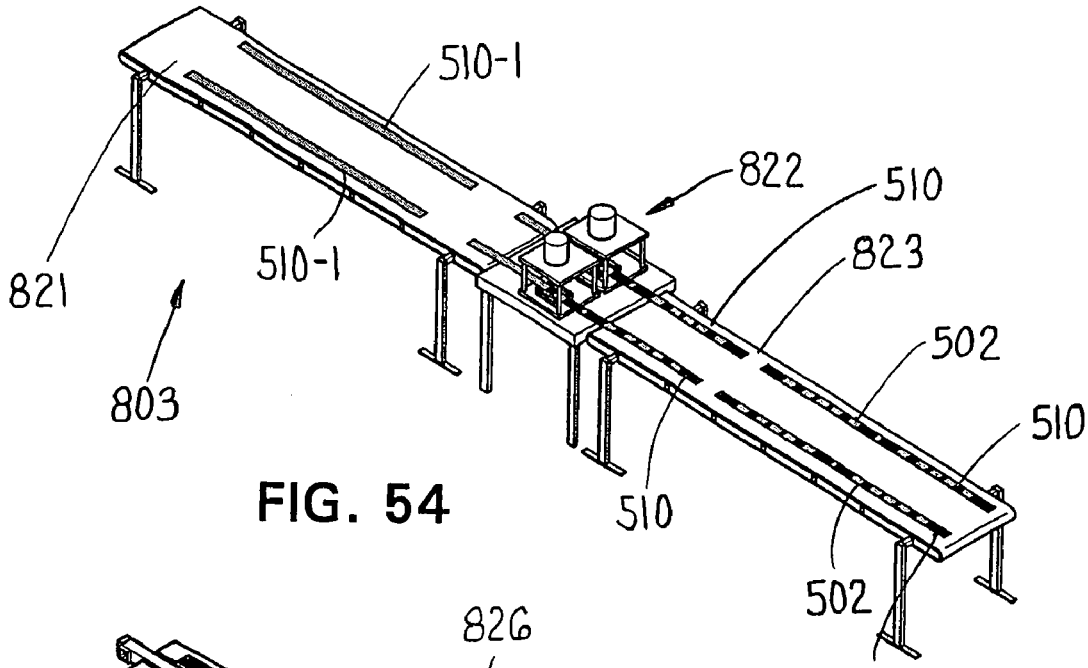
FIG. 54 is an isometric view of a servo punch machine.

Referring to FIG. 54, a servo punch machine 820 is illustrated which is provided to punch the holes 503 and 504 into the extrusion halves 510 in step 802. This punch machine 820 includes an upstream table 821 that receives pairs of unpunched extrusion halves 510-1, and a punch unit 822 which punches multiple groups of the openings 503 and 504 along each extrusion half 510. The punched halves 510 are then discharged to a downstream support table 823.

Figure 55:
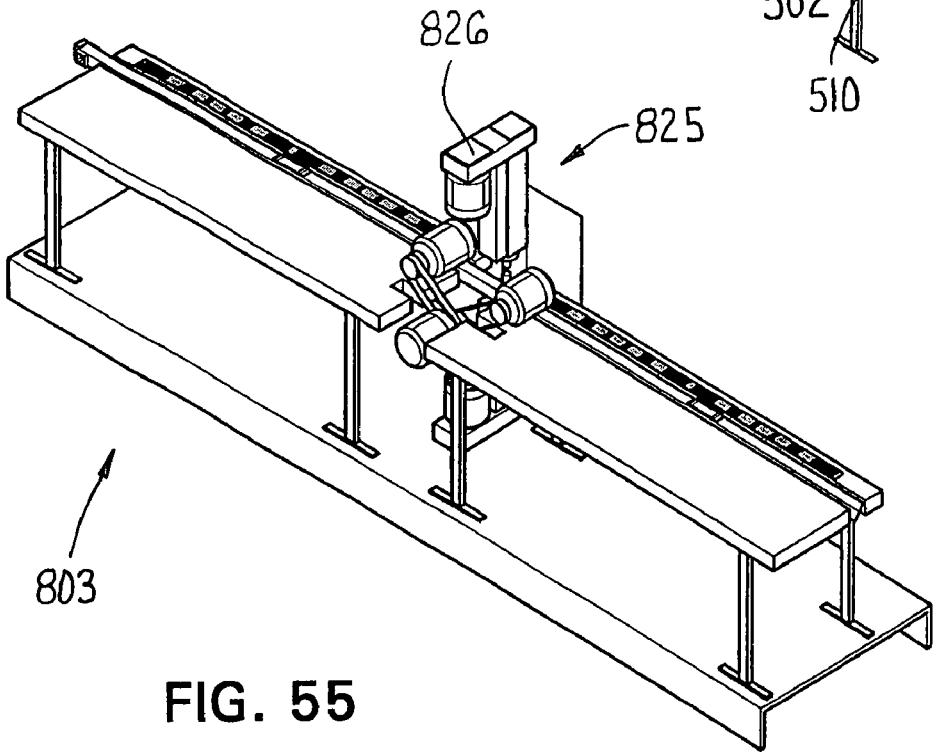
FIG. 55 is an isometric view of a servo mill for milling bracket grooves in the PDA.

Additionally, a servo mill machine 825 is provided in FIG. 55 to machine the grooves 515 into the PDA 500. This mill machine 825 includes a router unit 826 which is adapted to remove the grooves 507 and 508 from the extrusion halves 510 at selected spaced apart locations along the length of the PDA 500. Such grooves 515 accommodate mounting brackets for mounting the PDA's 500 to a wall panel 12 or the like. The mill machine 825 includes two milling heads on opposite sides of the PDA extrusions 510 to cut grooves 515 on both sides of the PDA 500 at the same time.

Figure 63:
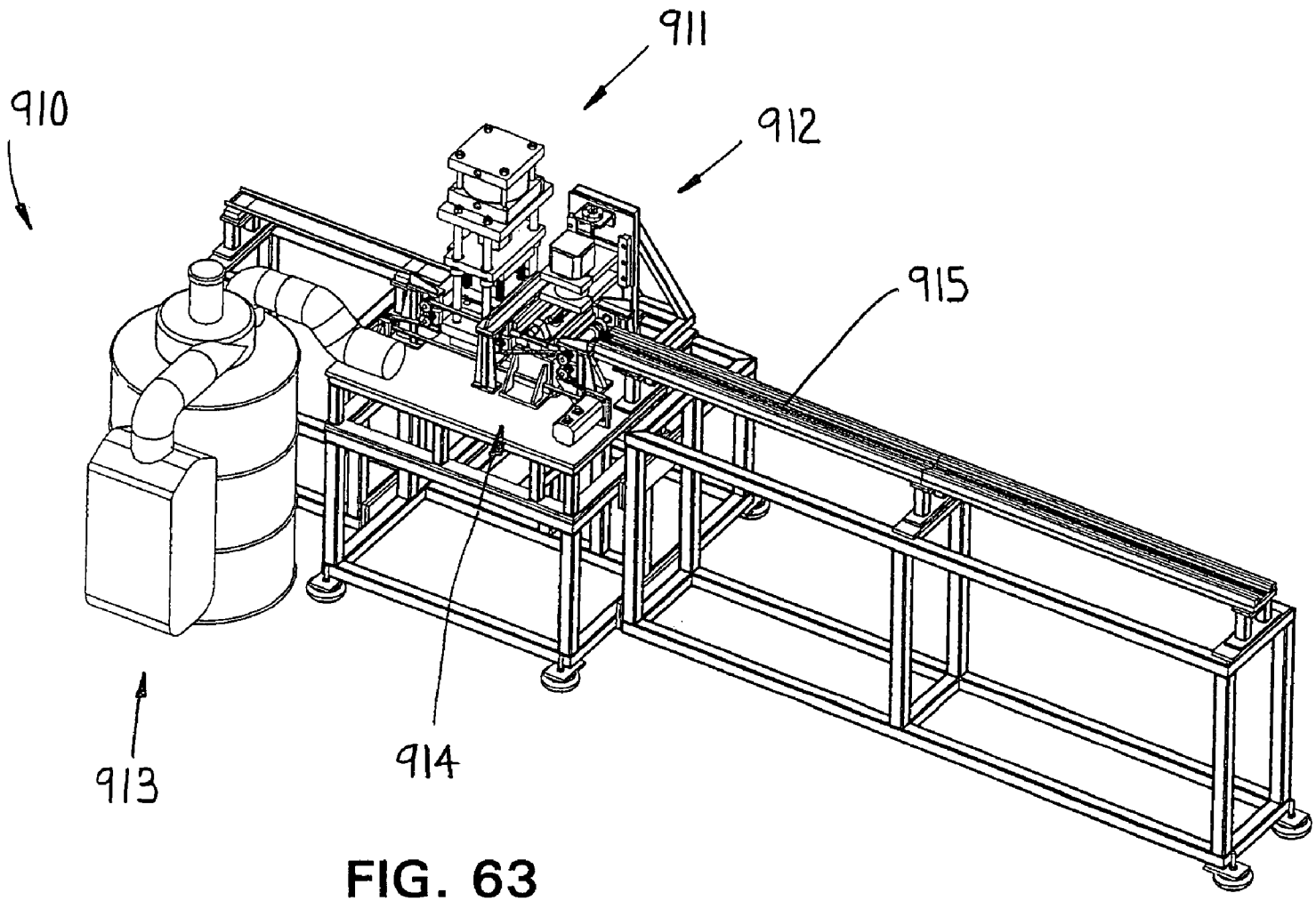
FIG. 63 is an isometric view of combined punching/milling machine.

It is noted that the punch machine 820 and the mill machine 825 may be combined into a single machine as described below relative to FIG. 63, or may be made separate as seen in FIGS. 54 and 55. When separated, the milling may be completed at a later time than the punching portion of step 803, such as after the wire is inserted in step 804, and even after the PDA ends are closed in step 805.

Figure 56:
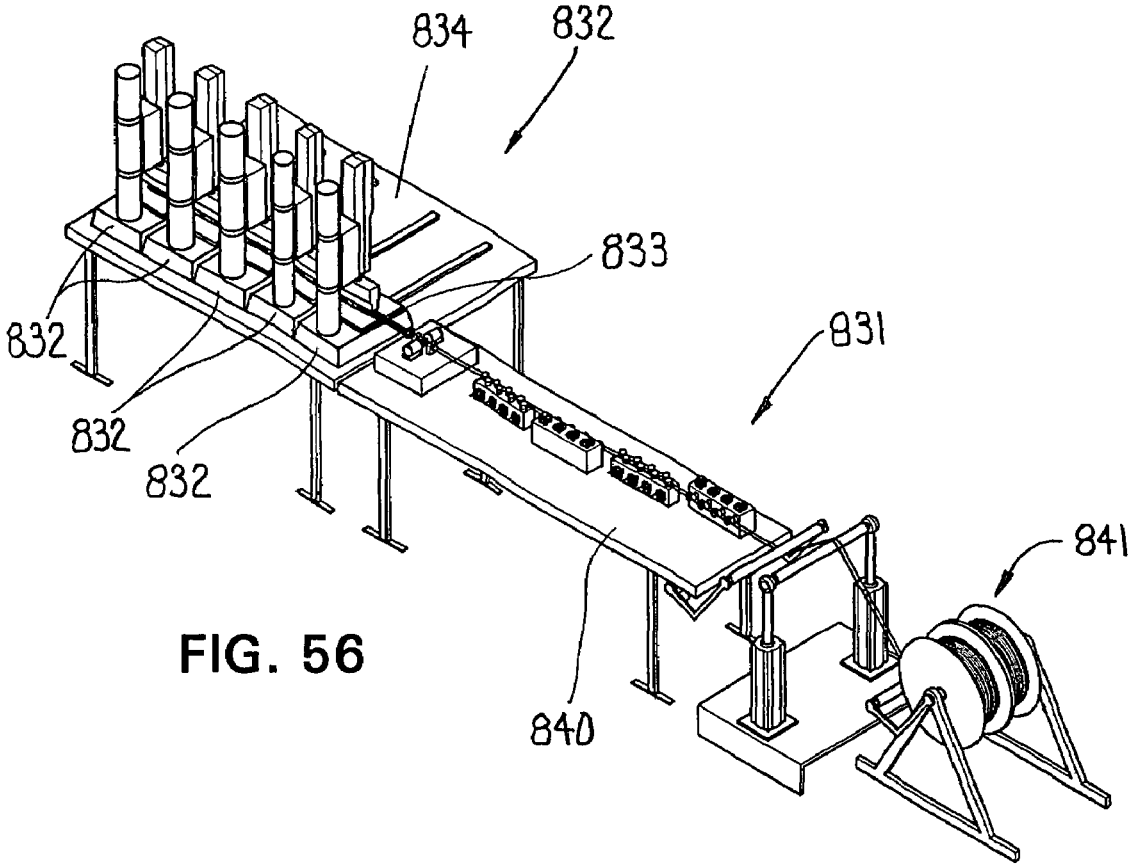
FIG. 56 is an isometric view of a wire straightening and insertion machine.
Figure 57:
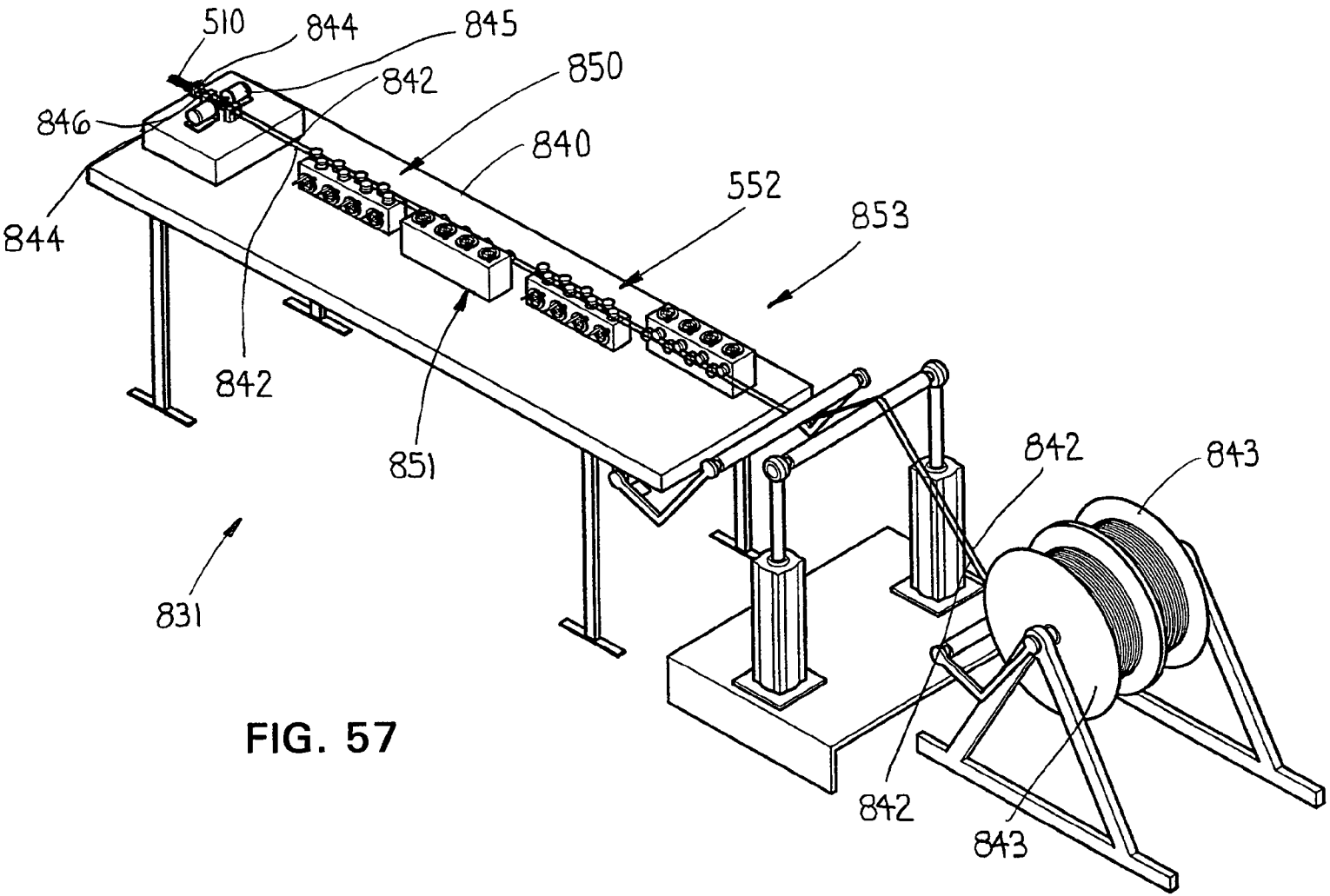
FIG. 57 is an enlarged isometric view of the wire insertion machine and straightener.
Figure 58:
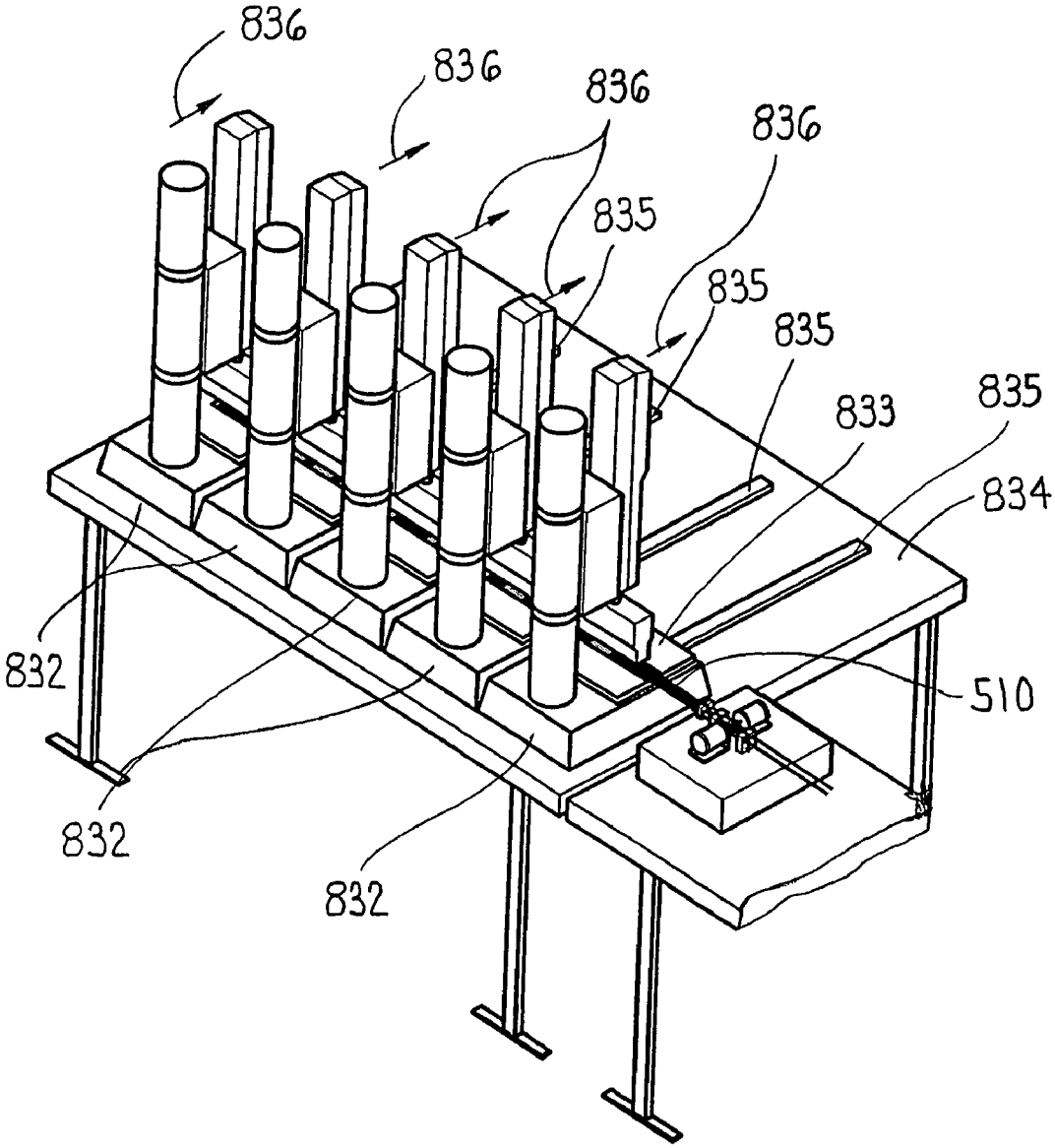
FIG. 58 is an enlarged view of the sonic welder unit of the wire insertion machine.

Referring to FIGS. 56-58, a wire insertion machine 830 and an ultrasonic weld machine 831 are provided together to perform step 804. In this regard, the weld machine 831 includes a plurality of weld units 832 which include a bottom nest 833 that supports a pair of extrusion halves 510 one above the other. Thus, two extrusion halves 510 are stacked together and positioned into the weld nests with the open ends of the bores 511 opening toward the wire insertion machine 830.

The weld units 832 are supported on a table 834 by slides 835 which allow for synchronized sideward movement of the nests 833 transversely across the table 834 in the direction of respective reference arrows 836. Generally, the wire insertion machine 830 is configured to insert two conductors 811 at a time into the PDA 500 wherein the nests 533 may be incrementally shifted so that all ten conductors 511 are inserted into the ten bores 512, two at a time, without having to displace the components of the wire insertion machine 830. During the insertion process, the extrusion halves 510 are held stationary by the clamping action of the weld units 832 which press downwardly on the halves 510 to maintain same in alignment.

Once the conductors 811 are shot into the bores 812, the weld units 832 are operated to sonically weld the separate extrusion halves 510 together with the conductors 811 sandwiched therebetween.

More particularly as to the wire insertion machine 830, this machine 830 includes a support table 840 disposed between the weld machine 831 and a multi-spool supply 841 of wires 842. The wire supply 841 comprises two continuous spools 843 of conductor wires 842 such that the wires 842 extend parallel to each other across the table 840. The leading ends 844 of the wires 842 extend through a wire puller unit 855 and a cutoff device 856. The wire puller unit 855 comprises a pair of rollers which frictionally engage the top and bottom of the wires 842 to drive or shoot the wires 842 at a high rate of speed into the PDA bores 811. The leading wire ends 844 are spaced apart so as to feed the first and sixth bores 811 in one operation, the second and seventh bores in the next operation, the third and eighth, the fourth and ninth and the fifth and tenth bores in the final operation. After each wire feeding operation, the weld nests are incrementally shifted to allow for feeding of the wires 842 into the next successive set of bores 811.

After each pair of wires 842 is fed, the cutoff unit 846 is actuated to break the wires 842, with the cutoff portions now defining the conductors 812 and conductors 812 being seated within the bores 811. During feeding of the wires 842, the weld units 835 have respective, opposing weld plates which clamp the two extrusion halves 510 together to prevented displacement as the wires 842 pass along the entire length of the bores 811. Thereafter, the weld units 835 are actuated to ultrasonically weld the extrusion halves 510 together.

The wire insertion machine 830 further includes sets of wire straightening rollers 850-853 which remove or reduce any curvature imparted to the wires 842 by the spools 843 and ensure the wires 842 are substantially linear during the insertion process.

Figure 60:
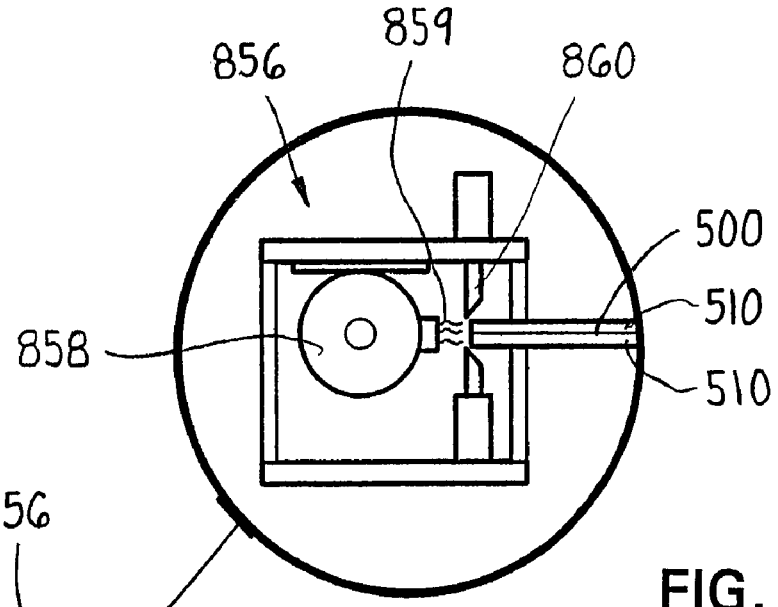
FIG. 60 is an enlarged front view of the closure machine.
Figure 59:
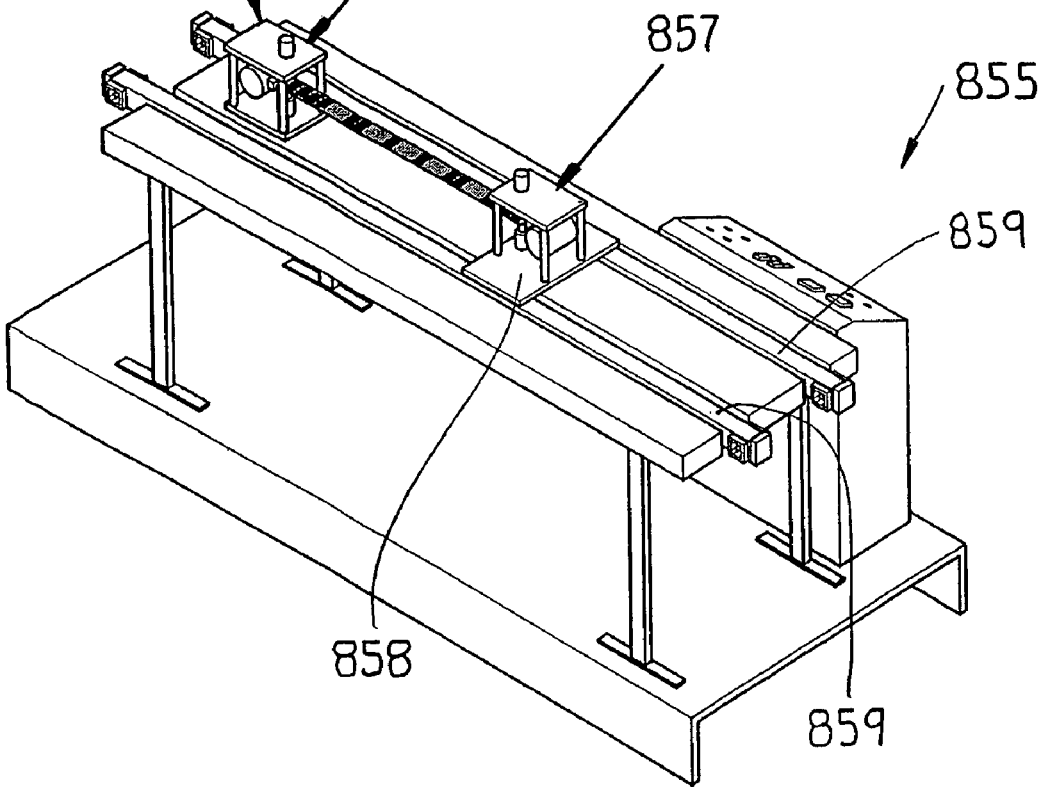
FIG. 59 is an isometric view of end closure machine.

Referring to FIGS. 59 and 60, the PDA 500 is then transferred to the end closure machine 855 for closing off the ends of the PDA 500 and sealing the conductor ends within the extrusion material. The end closure machine 855 preferably is a hot air type sealing machine.

In particular, the machine 855 includes two end seal assemblies 856 and 857 wherein end seal assembly 856 is in a fixed position. The opposite end seal assembly 857 is mounted by a base plate 858 on slides 859 which allow the relative distance between the assemblies 856 and 857 to be adjusted to accommodate different size PDA's 500.

Each of the end seal assemblies 856 and 857 includes a blower 858 which blows hot air 859 against the end of the PDA 500. Thereafter, closure jaws 860 are actuated to seal off the opposite ends of the bores 811. In this same operation, test plugs are inserted into the sets of openings at each end of the PDA 500 se that continuity and Hipot testing may be done in step 806.

With the foregoing process, the PDA 500 may be constructed using extrusions that may be readily cut to appropriate length.

Figure 61:
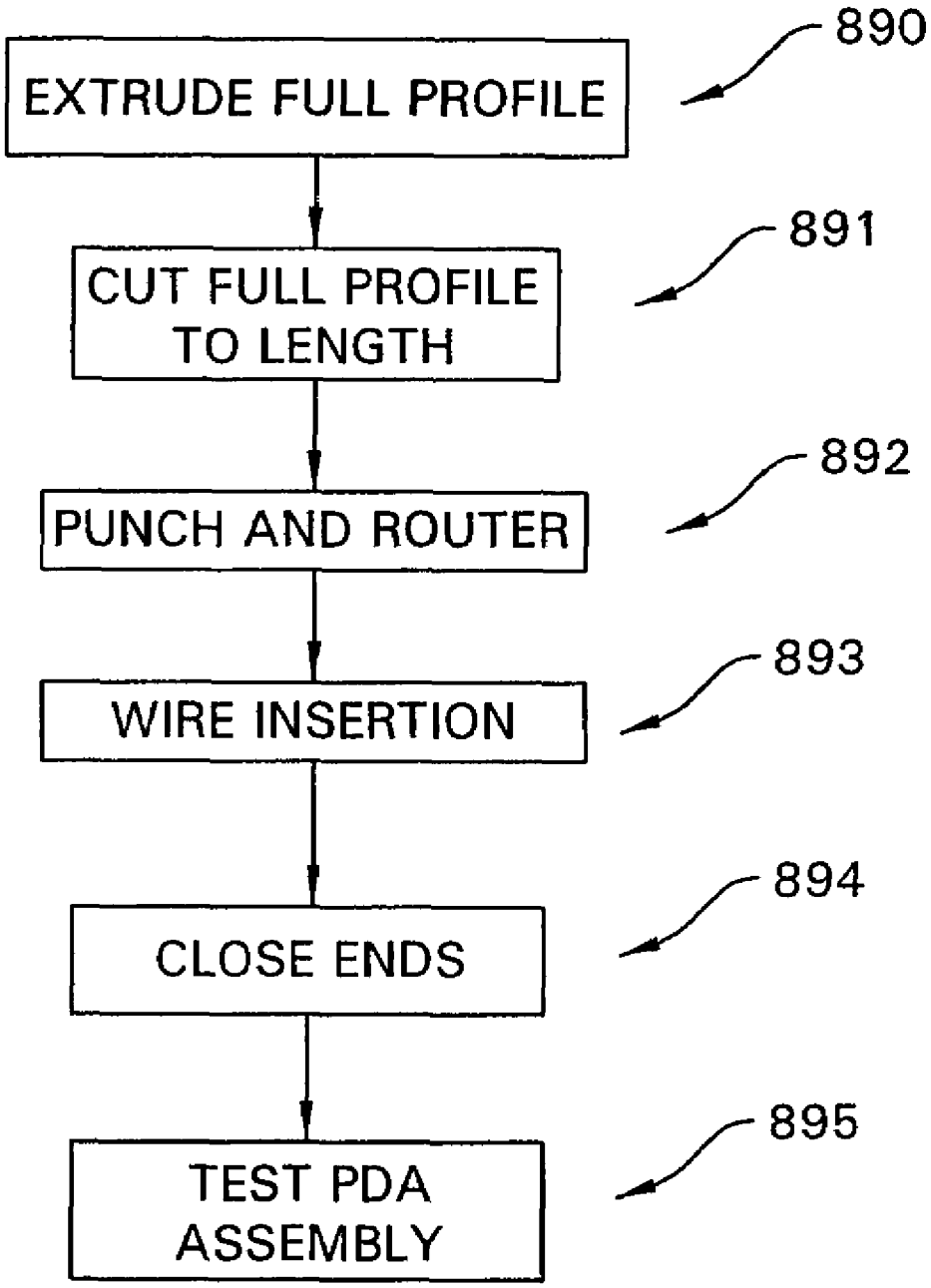
FIG. 61 is a flowchart illustrating the process steps for manufacturing the one-piece PDA of FIG. 24.

Referring to FIG. 61, the single piece PDA 470 (FIGS. 23-25) may be constructed using similar components. In the process of FIG. 61, the PDA 470 is first extruded in step 890 by essentially using the same equipment of FIG. 53. In this regard, the extrusion for PDA 470 would be a full profile extrusion rather than an extrusion half. Also, it would not be necessary to slit bore grooves with a cutter 816 since PDA extrusion 470 already has the bores 477 completely formed therein by the extrusion process. The PDA profile would then be cut to length in step 891 by the cutoff machine 815.

In step 892, the holes 473/474 would be punched therein and appropriate bracket slots would be milled in the extrusion faces with the equipment of FIGS. 54 and 55. It is noted that the substeps of this process step could be completed simultaneously with the machine shown in FIG. 63 and described further herein.

In step 893, the PDA 470 would be clamped or held stationary on a support table and the wires 476 inserted or shot therein by the wire insertion machine 831 of FIG. 57. Since the PDA 470 is a one-piece extrusion, the sonic welding machine 830 is not necessary and a supplemental clamping device would instead be provided on the support table 833.

In step 894, the ends of the PDA 470 are closed off by the end closure machine 855 of FIGS. 59 and 60, after which testing would be completed in step 895.

Figure 62:
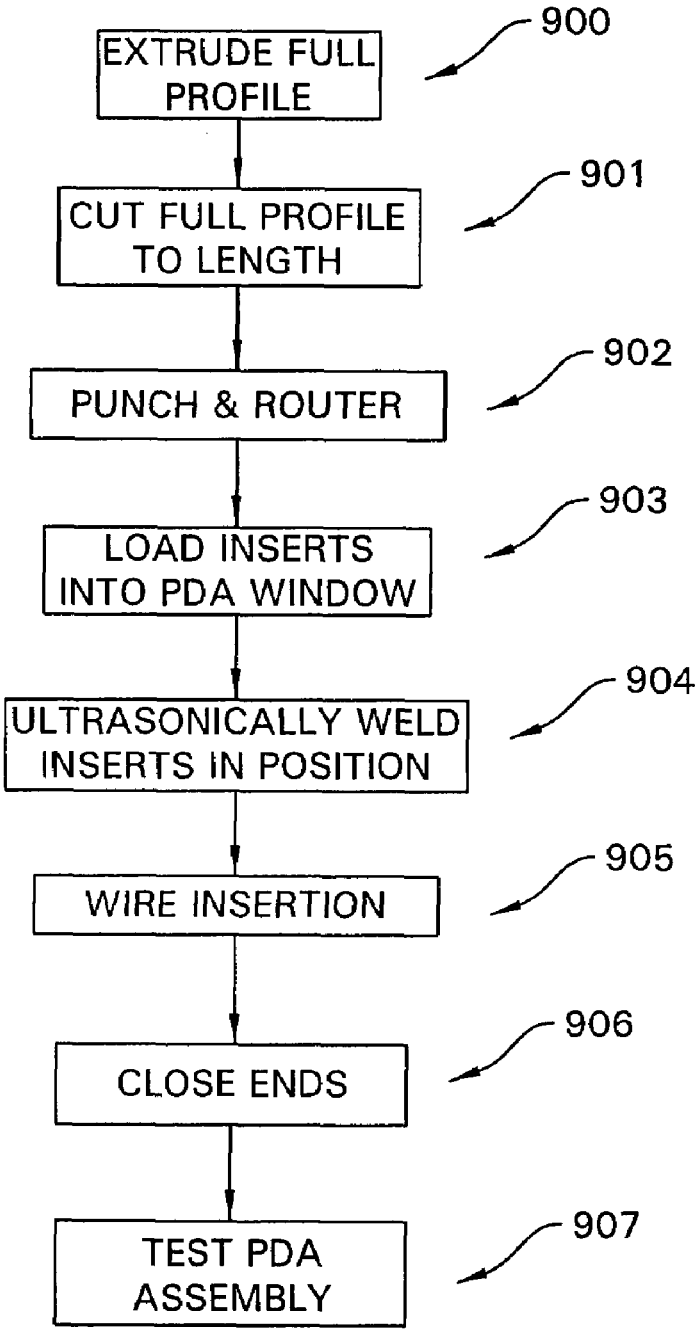
FIG. 62 is a flowchart illustrating the process steps for manufacturing the multi-piece PDA of FIG. 31.

Referring to FIG. 62, a further process is illustrated for the assembly of the multi-piece extrusion for PDA 530 (FIGS. 31-36). In this process, machines similar to those described above would be provided wherein additional alternate machine configurations are disclosed in FIGS. 63-66.

More particularly, in step 900 of FIG. 62, the one-piece PDA extrusion 530 would be formed and cut with the machine of FIG. 53. Like the extrusion for PDA 470 described above, the extrusion 530 would be a full piece extrusion rather than an extrusion half. Also, it would not be necessary to slit grooves with the cutter 816 since PDA extrusion 530 already has the bores 477 completely formed therein. Preferably, the outer grooves 546 are formed by the extrusion process although it is possible to form such grooves 546 by the slitting cutter 816 if necessary. After the extrusion profile is formed, the PDA profile would then be cut to length in step 901 by the cutoff machine 815.

In step 902, the windows 531, 532 and 533 would be cut into the extrusion profile, while additional mounting bracket grooves like grooves 515 would be machined in the extrusion faces. While the machines of FIGS. 54 and 55 are usable for this step, the combined punch/router machine 910 is provided as seen in FIG. 910. This machine 910 includes a punch unit 911 for forming the large rectangular windows 531, 532 or 533 and includes a router unit 912 for the bracket grooves. Also, a blower 913 is provided to clear debris from the work area 914. A track 915 is provided to guide the PDA 530 into and out of the machining units 911 and 912.

It will be noted that the punch unit 911 also could be formed so as to provide small openings such as for the PDA's 470 and 500 such that this machine 910 may be used to perform the punching and milling operations performed by the machines 822 and 825 of FIGS. 54 and 55.

Figure 64:
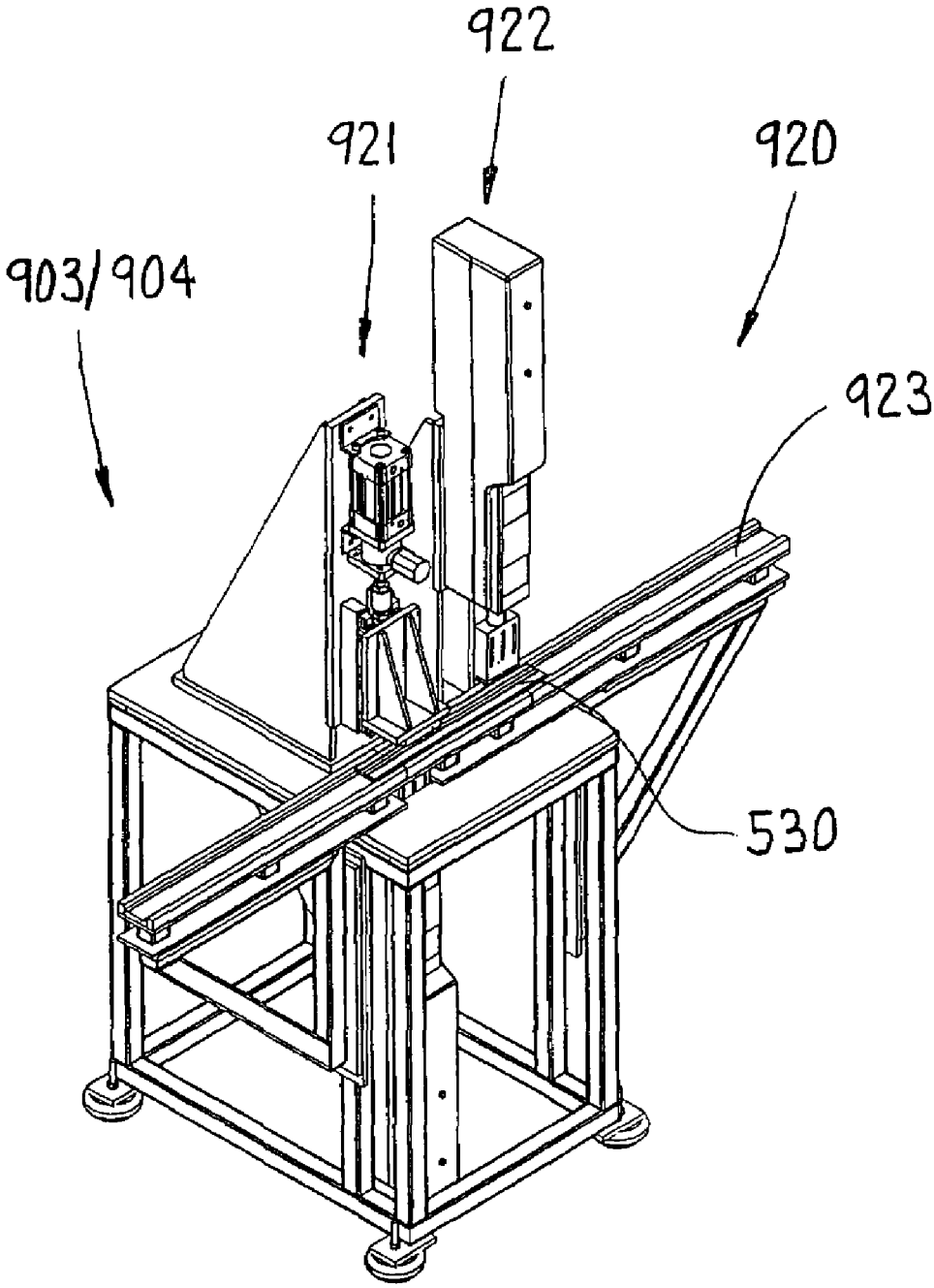
FIG. 64 is an isometric view of a sonic welder.
Figure 65:
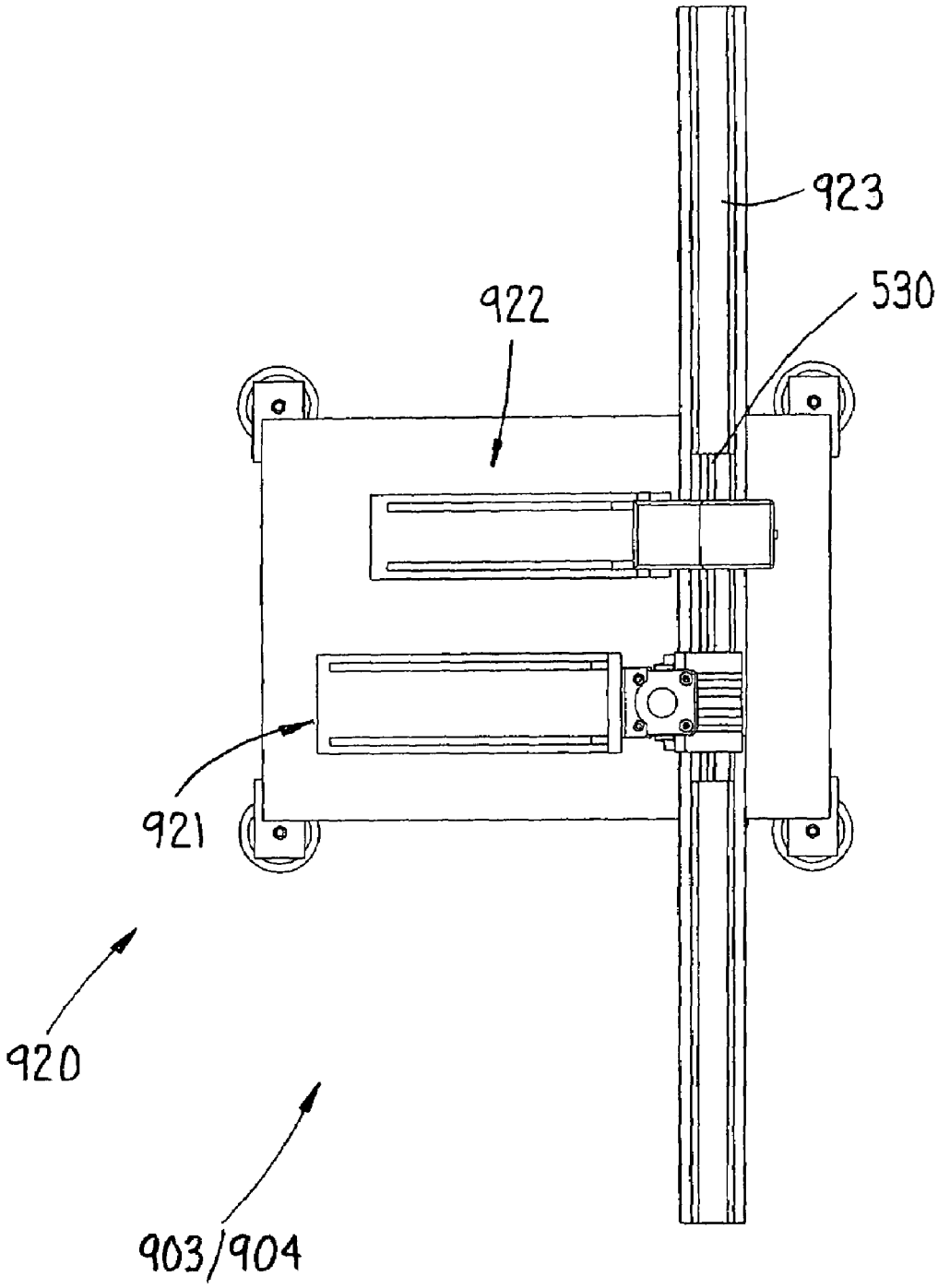
FIG. 65 is a plan view of the sonic welder.

Next in step 903, the inserts 535 and 536 are loaded into the window 530 and then ultrasonically welded in place in step 904 by the sonic welder 920 of FIGS. 64 and 65. The sonic welder 920 includes two weld stations 921 and 922 to first weld one insert 535 to the extrusion by one of the weld stations 921 and 922 and then the extrusion is incrementally indexed or shifted along track 923 and then the other insert 536 is welded to the extrusion by the other of the weld stations 921 and 922. As such, a two-stage weld process occurs for each mated pair of inserts 535 and 536.

Next in step 905, the conductors 540 are shot into the bores 547 by the wire insertion machine 831 described above. The conductors 540 would be loaded into the bores 547 in the same manner as described above relative to FIG. 57.

Figure 66:
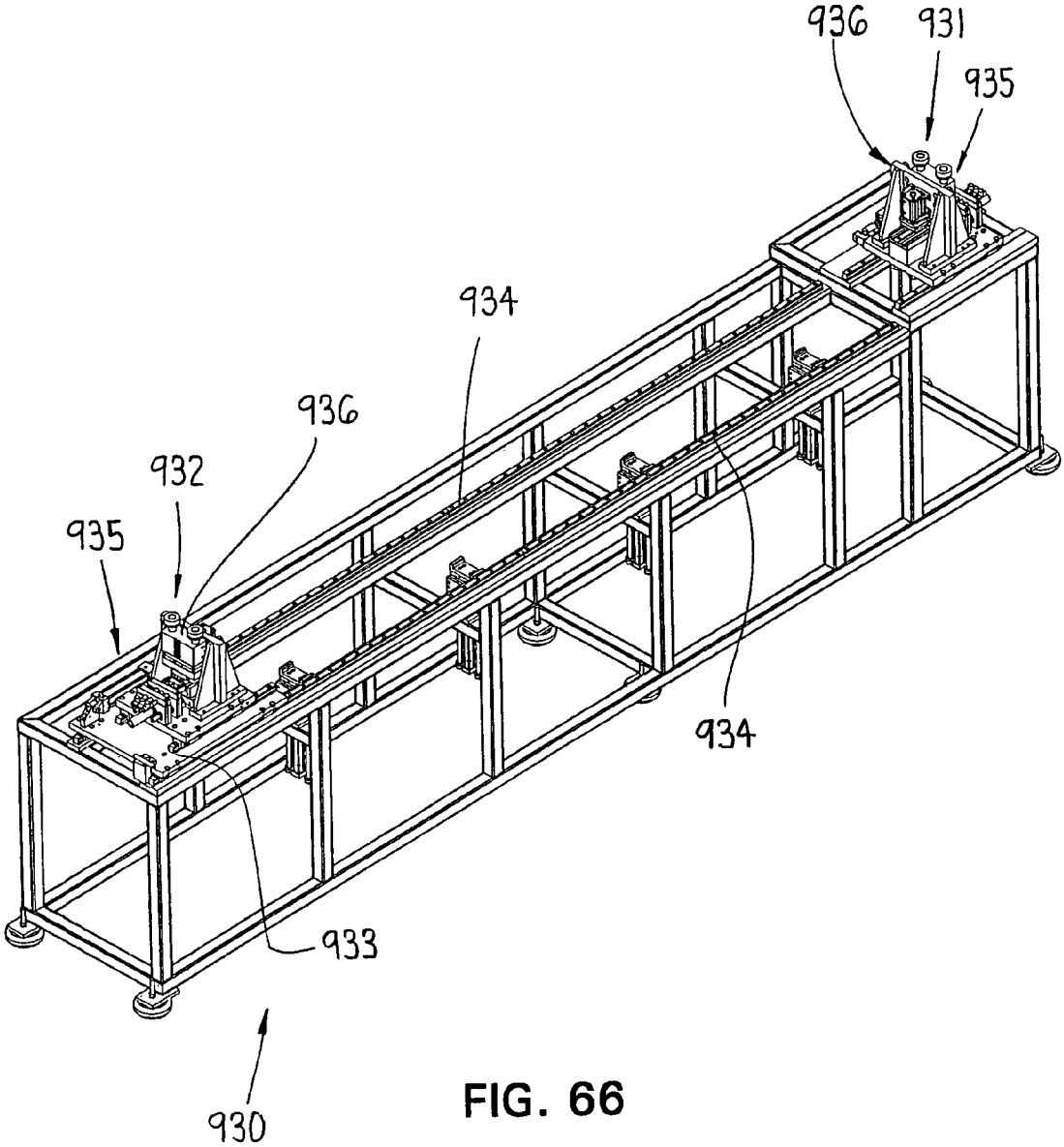
FIG. 66 is an isometric view of another end closure machine.

Thereafter, the PDA ends would be closed by the end closure machine 930 of FIG. 66. This end closure machine 930 is structurally the same as that described above. In particular, this machine 930 includes two end seal assemblies 931 and 932 wherein end seal assembly 931 is in a fixed position. The opposite end seal assembly 932 is mounted by a base plate or carriage 933 on slides 934 which allow the relative distance between the assemblies 931 and 932 to be adjusted to accommodate different size PDA's 530.

Each of the end seal assemblies 931 and 932 includes a blower 935 which blows hot air against the end of the PDA 530. Thereafter, a closer unit 936 is actuated to seal off the opposite ends of the bores 547. In this same operation, test plugs are inserted into the sets of openings at each end of the PDA 530 so that continuity and Hipot testing may be done in step 907.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In an electrical system comprising an elongate power distribution assembly (PDA) having an elongate casing with a plurality of electrical conductor wires therein, said casing having groups of openings providing access to said wires, and one or more electrical components adapted to plug into said openings for electrical connection to said wires, a manufacturing process for a power distribution assembly comprising the steps of:

extruding a longitudinal length of an extrusion profile which is configured to define a PDA casing, said extrusion profile configured to define a plurality of elongate bores extending through said PDA casing wherein said bores have open ends which open through at least one of the opposite ends of said PDA casing;

cutting said extrusion profile to a length which defines the length of said PDA casing;

forming patterns of openings in said extrusion profile to define said groups of openings in said PDA casing; and providing a plurality of said wires to be seated respectively within said bores of said PDA casing and be accessible through said openings to permit electrical connection of a said electrical component by plugging engagement with said openings, said providing step comprising the step of positioning each of said wires into said open ends of said bores and inserting said wires into said bores through said open ends so as to extend along the longitudinal length of said PDA casing.

2. The method according to claim 1, wherein said extrusion profile defines one half of a finished profile of said PDA casing wherein two said extrusion profiles are mated together to define said finished profile.

3. The method according to claim 2, further including the steps of positioning said extrusion profiles in facing relation and affixing said extrusion profiles together to define said PDA casing.

4. The method according to claim 1, wherein said extrusion profile defines a finished profile of said PDA casing with said bores being formed therein during said extrusion step.

5. The method according to claim 4, further comprising the steps of punching one or more windows into said PDA casing, positioning one or more inserts within said window to define said plurality of said openings that are adapted to engage said electrical component.

6. The method according to claim 5, further including the step of ultrasonically welding a plurality of said inserts within a respective said window to fixedly secure said inserts to said PDA casing.

7. The method according to claim 1, wherein said providing step further comprises the steps of:

providing a wire insertion machine which includes a stock of wire material provided on one or more wire supply spools for defining said wires in said bores;

positioning said PDA casing with said open ends of said bores being disposed adjacent to a free end of a longitudinal length of feed wiring extending from said wire supply spool;

operating said wire insertion machine to withdraw said feed wiring from said wire supply spool and drive said feed wiring into an aligned one of said bores of said PDA casing for said positioning of said wire in said bore; and cutting said feed wiring after positioning into each of said bores to define said wire in said bore.

8. The method according to claim 7, comprising the steps of repositioning one of said PDA casing and said wire insertion machine relative to the other to reposition said feed wiring adjacent to another said bore for positioning said respective wire therein.

9. The method according to claim 8, wherein said feed wiring is inserted successively into said bores to insert one said wire into each said bore.

10. The method according to claim 9, wherein a plurality of adjacent free ends of feed wiring are provided for alignment with the corresponding plurality of said bores and a plurality of said free ends are inserted into said plurality of said bores simultaneously to define said wires.

11. The method according to claim 10, wherein said wiring insertion machine includes a wire puller unit and a cutoff device and said method includes the step of pulling said wiring from said wire supply spools during feeding into said bores and said cutting of said feed wiring is performed by said cutoff device after said wires are inserted fully into each said bore to sever said respective wire therefrom.

12. The method according to claim 7, wherein said wire insertion machine comprises a wire straightener disposed between a wire puller and said wire supply spool to straighten said feed wiring pulled from said wire supply spool.

13. The method according to claim 7, further including the step of enclosing said open ends of said bores by reforming each of the opposite ends of said PDA casing having said open ends of said bores to enclose said bores with said extrusion material.

14. The method according to claim 7, wherein said extrusion profile defines one half of a finished profile of said PDA casing wherein two said extrusion profiles are mated together to define said finished profile, a securing machine being provided adjacent to said wire insertion machine wherein said securing machine performs the steps of maintaining said PDA casing stationary during said insertion of said wiring therein and securing said two extrusion profiles together to define said finished profile.

15. The method according to claim 1, wherein:

said forming of said patterns of said openings in said extrusion profile is performed prior to said positioning of said wires within said bores to define said groups of openings in said PDA casing;

said wires are cut to a length which corresponds to a length of said extrusion profile so as to extend substantially along the length of said PDA casing; and said method further comprises the step of selectively repeating said cutting step on said extrusion profile to define different lengths for said PDA casing, and performing said step of forming said openings depending upon the selected length of said PDA casing, said wires having a uniform longitudinal shape which is independent of the patterns of said openings.

16. The method according to claim 15, wherein said extrusion profile defines one half of a finished profile of said PDA casing wherein two said extrusion profiles are mated together to define said finished profile.

17. The method according to claim 16, wherein said wires are inserted into said extrusion profiles after said extrusion profiles are positioned together in facing relation.

18. In an electrical system comprising an elongate power distribution assembly PDA) having an elongate casing with a plurality of electrical conductor wires therein, said casing having groups of openings providing access to said wires, and one or more electrical components adapted to plug into said openings for electrical connection to said wires, a manufacturing process for a power distribution assembly comprising the steps of:

extruding a longitudinal length of an extrusion profile which is configured to define a PDA casing, said extrusion profile configured to define a plurality of elongate bores extending through said PDA casing;

cutting said extrusion profile to a length which defines the length of said PDA casing;

forming patterns of openings in said extrusion profile to define said groups of openings in said PDA casing, said forming step comprising the steps of punching one or more windows into said PDA casing, positioning one or more inserts within said window to define said plurality of said openings that are adapted to engage said electrical component, and ultrasonically welding each of said inserts within a respective said window to fixedly secure said inserts to said PDA casing; and providing a plurality of said wires to be seated within respectively said bores of said PDA casing and be accessible through said openings to permit electrical connection of a said electrical component by plugging engagement with said openings.

19. The method according to claim 18, wherein said extrusion profile defines a finished profile of said PDA casing with said bores being formed therein during said extrusion step.

* * * * *